US012180731B2

(12) United States Patent
Jones et al.

(10) Patent No.: US 12,180,731 B2
(45) **Date of Patent: *Dec. 31, 2024**

(54) HYBRID BUILDING SYSTEM, BUILDING AND METHOD

(71) Applicant: SANO DEVELOPMENT LIMITED, Wilmslow (GB)

(72) Inventors: David Lee Jones, Wilmslow (GB); Edward Ross Shenton, Wilmslow (GB); Anthony Robert Cherry, Wilmslow (GB)

(73) Assignee: SANO DEVELOPMENT LIMITED, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/562,669

(22) PCT Filed: May 19, 2022

(86) PCT No.: PCT/GB2022/051270
§ 371 (c)(1),
(2) Date: Nov. 20, 2023

(87) PCT Pub. No.: WO2022/243693
PCT Pub. Date: Nov. 24, 2022

(65) Prior Publication Data

US 2024/0229450 A1 Jul. 11, 2024

(30) Foreign Application Priority Data

May 20, 2021 (GB) ..... 2107243
May 20, 2021 (GB) ..... 2107244
(Continued)

(51) Int. Cl.
*E04H 1/12* (2006.01)
*E04B 1/348* (2006.01)
(Continued)

(52) U.S. Cl.
CPC ..... *E04H 1/12* (2013.01); *E04B 1/34815* (2013.01); *E04B 1/34869* (2013.01);
(Continued)

(58) Field of Classification Search
None
See application file for complete search history.

(56) References Cited

U.S. PATENT DOCUMENTS 2,644,203 A 8/1949 Donahue
3,587,197 A 6/1971 Renfro
(Continued)

FOREIGN PATENT DOCUMENTS

AU 2011101242 A4 11/2011
AU 2016231625 A1 4/2017
(Continued)

OTHER PUBLICATIONS

SIP Building Systems Limited: Sbs Sip Building Systems, Mar. 2021, available online at: "https://www.sipbuildingsystems.co.uk/pdf/SBS-Design-Guide.pdf", downloaded on Nov. 9, 2021 (28 pages).

(Continued)

*Primary Examiner* — Ko-Wei Lin
(74) *Attorney, Agent, or Firm* — Merchant & Gould P.C.

(57) ABSTRACT

Hybrid buildings, hybrid building systems, methods of constructing hybrid buildings, and a method of ventilating such a building are disclosed. First and second building sections forming part of such buildings are also disclosed. One such hybrid residential building (1800) comprises a first building section (1810) and a second building section (1820). The first building section is an on-site construction at a final location for the building and defines an internal volume (1813) that provides a living space (1815) within the building. The second building section defines an internal volume
(Continued)

(1823) and is transportable to the final location in a substantially assembled form. The first and second building sections are connected at the final location to form the building. The building comprises a ventilation system (1860) which is configured to supply external air into the building, and to withdraw internal air from the building and to discharge it to the building exterior, to thereby control ventilation of the building.

18 Claims, 16 Drawing Sheets

(30) Foreign Application Priority Data

May 20, 2021 (GB) ..... 2107245
May 20, 2021 (GB) ..... 2107247
May 20, 2021 (GB) ..... 2107248

(51) Int. Cl.
*E04H 1/00* (2006.01)
*E04H 1/02* (2006.01)
*E04H 1/04* (2006.01)
*F24F 12/00* (2006.01)

(52) U.S. Cl.
CPC ..... *E04H 1/005* (2013.01); *E04H 1/02* (2013.01); *E04H 1/04* (2013.01); *E04B 2001/34884* (2013.01); *E04B 2001/34892* (2013.01); *F24F 12/001* (2013.01)

(56) References Cited

U.S. PATENT DOCUMENTS 3,593,469 A 7/1971 Wall
3,694,977 A 10/1972 Verman
3,716,954 A 2/1973 Kelbish
3,952,465 A 4/1976 Masiello et al.
3,971,172 A 7/1976 Gentil
4,118,905 A 10/1978 Shelley
4,250,669 A 2/1981 Freeauf
4,335,558 A 6/1982 Caldwell et al.
4,447,996 A 5/1984 Maurer, Jr. et al.
4,501,098 A 2/1985 Gregory
4,513,545 A 4/1985 Hopkins, Jr.
4,788,802 A 12/1988 Wokas
5,111,626 A 5/1992 Fortune
5,127,201 A 7/1992 Skvaril
5,353,558 A 10/1994 Shea et al.
5,375,380 A 12/1994 Jones
6,073,401 A 6/2000 Iri et al.
6,073,404 A 6/2000 Norfleet
6,253,504 B1 7/2001 Cohen et al.
6,389,778 B1 5/2002 Strange
6,925,761 B1 8/2005 De La Marche
8,621,787 B2 1/2014 Barry et al.
8,621,818 B1 1/2014 Glenn et al.
8,919,049 B2 12/2014 Meserini
9,097,030 B1 * 8/2015 Manterfield ..... E04B 1/34869
9,441,357 B1 9/2016 Vafaee
9,556,632 B2 * 1/2017 Malakauskas ..... E04B 1/34838
9,617,748 B2 4/2017 Wilson et al.
9,695,608 B2 7/2017 French
10,301,813 B1 5/2019 Hawkins
10,450,739 B1 10/2019 Schlagel
10,526,781 B2 1/2020 Lestini et al.
10,590,671 B1 3/2020 Jee et al.
10,858,817 B2 12/2020 Wong et al.
11,103,406 B1 * 8/2021 Channell ..... E04H 3/08
11,274,464 B2 3/2022 Mather et al.
11,629,491 B1 4/2023 Meagher et al.
2002/0073637 A1 6/2002 Stewart et al.
2003/0024174 A1 2/2003 Bonds et al.
2005/0108957 A1 5/2005 Quesada
2005/0198915 A1 9/2005 Walters
2006/0016139 A1 1/2006 Beck et al.
2007/0163184 A1 7/2007 Olesch
2007/0271857 A1 11/2007 Heather et al.
2008/0134589 A1 6/2008 Abrams et al.
2008/0264095 A1 10/2008 Combs
2009/0120021 A1 5/2009 Hill
2009/0145079 A1 6/2009 Cortazar et al.
2009/0293384 A1 12/2009 Miller
2010/0043339 A1 2/2010 Van Dijk
2010/0126082 A1 5/2010 McLuskey
2010/0325971 A1 12/2010 Leahy
2011/0041418 A1 2/2011 Meserini
2011/0056147 A1 3/2011 Beaudet
2011/0214361 A1 9/2011 Ingjaldsdottir et al.
2011/0265396 A1 11/2011 Heather
2011/0283656 A1 11/2011 Faber et al.
2011/0296778 A1 12/2011 Collins et al.
2012/0221492 A1 8/2012 Herro et al.
2013/0152485 A1 6/2013 Austin et al.
2013/0305628 A1 11/2013 Warner et al.
2014/0059947 A1 3/2014 Rothwell et al.
2014/0298745 A1 10/2014 Rechenmacher et al.
2015/0152634 A1 6/2015 Unger et al.
2015/0240475 A1 8/2015 Malakauskas et al.
2016/0010349 A1 1/2016 Edward
2016/0017609 A1 1/2016 Bottin
2016/0376784 A1 12/2016 Timur
2017/0002579 A1 * 1/2017 French ..... E04B 1/34807
2018/0051459 A1 2/2018 Clarke et al.
2018/0142460 A1 5/2018 Gaudio et al.
2019/0284795 A1 9/2019 Vanaman
2019/0345711 A1 11/2019 Hawkins
2020/0048904 A1 2/2020 Dombowsky et al.
2020/0190791 A1 6/2020 McCormack
2020/0362550 A1 * 11/2020 Schlagel ..... E04F 11/02
2020/0392731 A1 12/2020 Sloane et al.
2021/0025156 A1 1/2021 Dombowsky et al.
2021/0148115 A1 5/2021 Haller et al.
2021/0164227 A1 6/2021 Zhou et al.
2021/0180317 A1 6/2021 Shields
2021/0238843 A1 8/2021 Dombowsky et al.
2021/0239828 A1 8/2021 Cohen et al.
2021/0301527 A1 9/2021 Dombowsky et al.
2021/0301528 A1 9/2021 Dombowsky et al.
2021/0301529 A1 9/2021 Dombowsky et al.
2021/0348387 A1 11/2021 Dombowsky et al.
2021/0355674 A1 11/2021 Marin et al.
2021/0372117 A1 12/2021 Littow
2021/0383033 A1 12/2021 Glenn et al.
2022/0049488 A1 2/2022 Dombowsky et al.
2022/0049496 A1 2/2022 Dombowsky et al.
2022/0049502 A1 2/2022 Dombowsky et al.
2022/0049504 A1 2/2022 Dombowsky et al.
2022/0058862 A1 2/2022 Glenn et al.
2022/0090380 A1 3/2022 Dombowsky et al.
2022/0120081 A1 4/2022 Zhou et al.
2022/0120082 A1 4/2022 Zhou et al.
2022/0186496 A1 6/2022 Fidel et al.
2022/0205235 A1 6/2022 Chapman
2022/0266065 A1 8/2022 Stewart
2022/0381050 A1 12/2022 Jaycox et al.

FOREIGN PATENT DOCUMENTS

AU 2017100895 A4 8/2017
AU 2018264129 A1 6/2018
CA 2197032 8/1998
CN 106522372 A 3/2017
CN 110725412 A 1/2020
CN 213654353 U 7/2021
CN 113530303 A 10/2021
DE 3226742 A1 1/1984
DE 19516751 A1 7/1996
DE 19700302 A1 7/1997
DE 10000713 A1 7/2000
EP 0365512 A1 4/1990
EP 0595135 A1 5/1994

(56) References Cited

FOREIGN PATENT DOCUMENTS

| | | | |
|---|---|---|---|
| EP | 1395715 | A1 | 3/2004 |
| EP | 1899542 | A1 | 3/2008 |
| EP | 2964855 | A1 | 1/2016 |
| EP | 3004478 | A1 | 4/2016 |
| EP | 3521525 | A1 | 8/2019 |
| EP | 3978697 | A1 | 4/2022 |
| FR | 2621943 | A1 | 4/1989 |
| FR | 3030589 | A1 | 6/2016 |
| GB | 569053 | A | 5/1945 |
| GB | 1307131 | A | 2/1973 |
| GB | 1314948 | A | 4/1973 |
| GB | 1340059 | A | 12/1973 |
| GB | 1364309 | A | 8/1974 |
| GB | 1494617 | A | 12/1977 |
| GB | 1516794 | A | 7/1978 |
| GB | 2158483 | A | 11/1985 |
| GB | 2191517 | A | 12/1987 |
| GB | 2427417 | A | 12/2006 |
| GB | 2440286 | A | 1/2008 |
| GB | 2526688 | A | 12/2015 |
| GB | 2552206 | A | 1/2018 |
| GB | 2557869 | A | 7/2018 |
| GB | 2570480 | A | 7/2019 |
| GB | 2571504 | A | 9/2019 |
| GB | 2586185 | A | 2/2021 |
| GB | 2601391 | A | 6/2022 |
| JP | H04319136 | A | 11/1992 |
| JP | H0638841 | A | 2/1994 |
| JP | H06346517 | A | 12/1994 |
| JP | H07279255 | | 10/1995 |
| JP | H10115008 | A | 5/1998 |
| JP | 2001303784 | A | 10/2001 |
| JP | 2002115327 | A | 4/2002 |
| JP | 3359417 | | 12/2002 |
| JP | 2003041763 | A | 2/2003 |
| JP | 2009243260 | A | 10/2009 |
| JP | 2010018964 | A | 1/2010 |
| JP | 2012012882 | A | 1/2012 |
| JP | 2013127148 | A | 6/2013 |
| JP | 2015081470 | A | 4/2015 |
| JP | 2020176432 | A | 10/2020 |
| KR | 20150072650 | A | 6/2015 |
| KR | 20200102217 | A | 8/2020 |
| NL | 8500136 | A | 8/1986 |
| RU | 2312191 | C1 | 12/2007 |
| SE | 2100178 | A1 | 5/2023 |
| WO | 94/12746 | A1 | 6/1994 |
| WO | 95/11356 | A1 | 4/1995 |
| WO | 00/01898 | A1 | 1/2000 |
| WO | 00/57004 | A1 | 9/2000 |
| WO | 02/097206 | A1 | 12/2002 |
| WO | 2005/109472 | A2 | 11/2005 |
| WO | 2006/098709 | A1 | 9/2006 |
| WO | 2007/030881 | A1 | 3/2007 |
| WO | 2008/027234 | A2 | 3/2008 |
| WO | 2008/039054 | A1 | 4/2008 |
| WO | 2011/126850 | A2 | 10/2011 |
| WO | 2014/008551 | A1 | 1/2014 |
| WO | 2014/121359 | A1 | 8/2014 |
| WO | 2014/134684 | A1 | 9/2014 |
| WO | 2014/187838 | A1 | 11/2014 |
| WO | 2017/078539 | A1 | 5/2017 |
| WO | 2017/122072 | A1 | 7/2017 |
| WO | 2017193179 | | 11/2017 |
| WO | 2018174825 | A1 | 9/2018 |
| WO | 2020/020963 | A1 | 1/2020 |
| WO | 2020/056276 | A1 | 3/2020 |
| WO | 2021/099591 | A1 | 5/2021 |
| WO | 2021/247502 | A1 | 12/2021 |
| WO | 2021/252148 | A2 | 12/2021 |
| WO | 2022/003679 | A1 | 1/2022 |
| WO | 2022/039816 | A1 | 2/2022 |
| WO | 2022/054051 | A1 | 3/2022 |
| WO | 2022/070178 | A1 | 4/2022 |
| WO | 2023067346 | | 4/2023 |
| WO | 2023067347 | | 4/2023 |

OTHER PUBLICATIONS

Cast Real Estate & Construction Consultancy: PMV Technical Manual, available online at: "https://www.cast-consultancy.com/wp-content/uploads/2021/03/PMV-technical-manual_FINAL-1.pdf", downloaded on Dec. 14, 2021 (15 pages).

eMagazine Jan. 2022: Light Gauge Steel Frame, available online at: "https://www.constrofacilitator.com/wp-content/uploads/2022/01/light-gauge-steel-frame.pdf", downloaded on Feb. 9, 2022 (20 pages).

CoreHaus Limited: Modular Housing Solutions, available online at: "https://www.corehaus.co.uk/", downladed on Apr. 25, 2022 (12 pages).

Inozemtcev et al. "Technical and economic efficiency of materials using 3D-printing in construction on the example of high-strength lightweight fiber-reinforced concrete", E3S Web of Conferences 97, 02010 (2019), available online at: "https://www.e3s-conferences.org/articles/e3sconf/pdf/2019/23/e3sconf_form2018_02010.pdf", downloaded on Feb. 19, 2021 (10 pages).

Urbansplash: Town House, available online at "https://s3-eu-west-1.amazonaws.com/us-website-content/Downloads/town-house/Townhouse_Brochure_Reprint_Dec18_LR.pdf", downloaded on Oct. 15, 2021 (35 pages).

Kingspan Insulation Ltd: Kingspan TEK Building System, Jul. 2021, available online at "https://ks-kentico-prod-cdn-endpoint.azureedge.net/kingspan-live/kingspangreatbritain/media/kil/tek-specification-manual-15th-issue-july-2021.pdf?ext =.pdf", downloaded on Jan. 21, 2022 (28 pages).

Kingspan AB: QuadCore KS1000/1100/1200NC Product Data Sheet, Feb. 2022, available online at: https://www.insulationshop.co/image/catalog/pdf/Kingspan/Kingspan_QuadCore_426.pdf, downloaded on Feb. 15, 2022 (5 pages).

Tata Steel UK Limited: Catnic (A Tata Steel Enterprise)—Steelwork Datasheet, Feb. 2015, available online at: "https://catnic.com/assets/downloads/Steelwork-Datasheet_CCP0366-1.pdf", downloaded on May 2, 2021 (1 page).

Building Materials & Technology Promotion Council: Technology Profile—Light Gauge Steel Frame Structures, available online at: "https://bmtpc.org/DataFiles/CMS/file/PDF_Files/TP_08_LGSS_small.pdf", downloaded on Jan. 11, 2021 (8 pages).

HTA Design LLP: Modular Manufactured Housing, 2019, available online at: "https://www.hta.co.uk/storage/app/media/modular-manufactured-housing.pdf", downloaded on Apr. 1, 2021 (44 pages).

International Search Report and Written Opinion, International Patent Application No. PCT/GB2022/051270, Dec. 19, 2022 (22 pages).

* cited by examiner

HYBRID BUILDING SYSTEM, BUILDING AND METHOD

The present disclosure relates to a hybrid building system, a hybrid building and a method of constructing a hybrid building. The present disclosure also relates to first and second building sections forming part of such buildings.

In 2018, the construction industry contributed £117 billion to the UK economy. 6% of total GDP. In 2019, there were 2.4 million construction industry jobs in the UK, accounting for 6.6% of all jobs. New orders to the construction industry were worth £61.7 billion in 2017. Notably, new housing orders accounted for 35% of all construction orders. Commercial orders accounted for 25% and infrastructure orders accounts for 19%.

Despite this substantial valuation and level of activity, little advancement has been made in the methods of construction of housing. The majority of new homes in the UK are built using traditional blockwork/masonry construction. Housing built entirely using traditional masonry construction, whilst having a long life-span and other advantages, are slow to construct, expensive, and can have considerable environmental impact due to the materials involved. Timber frame construction is becoming increasingly popular for the construction of housing. However, such methods do not substantially reduce build times, and have other associated disadvantages.

In conventional housing construction, services, including electricity and water supply, are installed on-site during a "First Fix" and a "Second Fix". In electrical installation, a "Third Fix" is sometimes performed, wherein conductors are terminated at accessories and protective devices. Electricians, plumbers, and other skilled tradespeople are required to be on-site during the aforementioned fixes to ensure correct installation of the services and perform necessary tests. This adds to complexity of the build, and can increase build times and, ultimately, build costs. In addition, differences in the skill levels of tradespeople from one site to another, and even from one building to another, can lead to significant variations in quality.

In light of increasing housing demand, skills shortages and higher sustainability standards, the UK Government is encouraging the construction sector to use and develop modern methods of construction in an attempt to meet these challenges. Other governments, in other countries, are taking the same approach.

Prefabricated housing has been developed in an attempt to meet these challenges. Prefabricated housing may refer to buildings having built in components (e.g. panels), modules, or transportable sections. However, commercially available prefabricated houses and methods of construction do not suitably address the problems identified above.

Examples of known prefabricated housing include so-called "modular" buildings. These are buildings which are assembled using an arrangement of prefabricated units or sections that have been constructed in a factory or facility, and then shipped to a final location for the building. Whilst manufacture of the building units in a factory addresses some of the problems with conventional construction methods, there remain significant disadvantages with buildings of this type.

In particular, there is a requirement to construct a series of building units in the factory which, when assembled at the final location, form the entire volume of the finished building. The building units each comprise an internal void or volume which defines part of the total volume of the assembled building, and are transported to the building site in that form. A consequence of this is that there is a requirement to construct and store all of the finished building units at the factory location, which takes up significant space. A large premises is therefore required.

In addition, it is necessary to transport all of the relatively bulky building units from the factory to the final location for subsequent assembly. This can be a time-consuming and expensive procedure. Further, the building units must be both large enough to minimise final assembly, and small enough to be handled and transported (typically by rail and/or road) to their final location.

Some modular buildings comprise pre-constructed building units of this type, and a flat panel or frame-type structure which is connected to the pre-constructed building unit at the final location, in order to form the completed building. However, these panel or frame-type structures still have to be stored at a factory, and transported to the final location for subsequent assembly. Although this can reduce the volume of some of the structures that have to be transported, they are still comparatively bulky, and can be relatively costly to manufacture. Also, the part of the building formed from the flat panel/frame-type structure is not self-supporting, and relies on the pre-constructed unit for support. As a result, the pre-constructed unit must be placed at the final location before any further assembly work can take place.

For these and other reasons, modular building options have often been discounted as being unsuitable by many housebuilders, particularly on housing sites comprising a significant number of properties.

According to the present invention there are provided hybrid residential buildings and systems, first and second building sections of such a building, and methods as set forth in the appended claims. Other features of the invention will be apparent from the dependent claims, and the description which follows.

According to a first aspect of the present invention, there is provided a hybrid residential building comprising a first building section and a second building section, in which:

- the first building section is an on-site construction at a final location for the building and comprises a lower storey defining an internal volume that provides a lower living space within the building, and an upper storey defining an internal volume that provides an upper living space within the building;
- the second building section defines an internal volume and is transportable to the final location in a substantially assembled form;
- the first and second building sections are connected at the final location to form the building;
- and optionally in which the first and second building sections are configured so that an access route between the upper and lower living spaces of the first building section passes through the second building section.

It will be noted that the word 'storey' is used throughout this document. In some territories the term 'story' has an equivalent meaning, and may be used in its place.

According to a second aspect of the present invention, there is provided a hybrid residential building system comprising:

- a first building section configured to be constructed on-site at a final location for a building and comprising a lower storey defining an internal volume that provides a lower living space within the building, and an upper storey defining an internal volume that provides an upper living space within the building: and a second building section defining an internal volume, and which is transportable to the final location in a substantially assembled form;

in which the first and second building sections are adapted to be connected at the final location to form the building;

and optionally in which the first and second building sections are configured, in use, so that an access route between the upper and lower living spaces of the first building section passes through the second building section.

The access route may facilitate movement between the upper and lower living spaces of the first building section by an occupant of the building (and so may provide a 'walkable' route or space). The access route may pass from the internal volume of one of the upper and lower storeys of the first building section, into the internal volume of the second building section, and from the internal volume of the second building section to the internal volume of the other one of the upper and lower storeys. A majority or all of the access route may be defined by the second building section. However, part of the access route may be defined by the first building section.

According to a third aspect of the present invention, there is provided a hybrid residential building comprising a first building section and a second building section, in which:

the first building section is an on-site construction at a final location for the building and comprises a lower storey and an upper storey, each storey defining a respective internal volume that provides a living space within the building, the internal volume of the lower storey optionally being isolated from the internal volume of the upper storey;

the second building section defines an internal volume and is transportable to the final location in a substantially assembled form;

the first and second building sections are connected at the final location to form the building;

and optionally in which:

the second building section is configured to provide access between the internal volumes of the upper and lower storeys of the first building section when the first and second building sections are connected;

or the first and second building sections are configured so that access between the internal volumes of the upper and lower storeys of the first building section is provided through the second building section when the first and second building sections are connected;

or the second building section is configured so that its internal volume communicates with both the internal volume defined by the upper storey of the first building section and the internal volume defined by the lower storey of the first building section, when the first and second building sections are connected, to thereby connect the internal volumes of the upper and lower storeys.

According to a fourth aspect of the present invention, there is provided a hybrid residential building system comprising:

a first building section configured to be constructed on-site at a final location for a building and comprising a lower storey and an upper storey, each storey defining a respective internal volume that provides a living space within the building, the internal volume of the lower storey optionally being isolated from the internal volume of the upper storey; and a second building section defining an internal volume, and which is transportable to the final location in a substantially assembled form;

in which the first and second building sections are adapted to be connected at the final location to form the building;

and optionally in which:

the second building section is configured, in use, to provide access between the internal volumes of the upper and lower storeys of the first building section;

or the first and second building sections are configured, in use, so that access between the internal volumes of the upper and lower storeys of the first building section is provided through the second building section;

or the second building section is configured, in use, so that its internal volume communicates both with the internal volume defined by the upper storey of the first building section, and the internal volume defined by the lower storey of the first building section, to thereby connect the internal volumes of the upper and lower storeys.

The second building section may facilitate movement between the upper and lower living spaces of the first building section by an occupant of the building. An occupant may pass from the internal volume/living space of one of the upper and lower storeys of the first building section into the internal volume of the second building section, and from the internal volume of the second building section to the internal volume/living space of the other one of the upper and lower storeys.

The internal volumes may be isolated in that they may be physically out of communication with one another, so that it is not possible to pass from one of the internal volumes to the other internal volume solely within the first building section. The second building section may provide a 'walkable' route or space between said volumes/living spaces.

According to a fifth aspect of the present invention, there is provided a hybrid residential building comprising a first building section and a second building section, in which:

the first building section is an on-site construction at a final location for the building and defines an internal volume that provides a living space within the building;

the second building section defines an internal volume and is transportable to the final location in a substantially assembled form;

the first and second building sections are connected at the final location to form the building;

and optionally in which:

the second building section is configured to provide an access route between an exterior of the building and the internal volume of the first building section;

or the first and second building sections are configured so that access between an exterior of the building and the internal volume of the first building section is provided through the second building section;

or the second building section is configured so that its internal volume communicates both with the exterior of the building and the internal volume of the first building section, to thereby connect the internal volume of the first building section with the building exterior.

According to a sixth aspect of the present invention, there is provided a hybrid residential building system comprising:

a first building section configured to be constructed on-site at a final location for a building and defining an internal volume that provides a living space within the building; and a second building section defining an internal volume, and which is transportable to the final location in a substantially assembled form;

in which the first and second building sections are adapted to be connected at the final location to form the building;

and optionally in which:

the second building section is configured, in use, to provide an access route between an exterior of the building and the internal volume of the first building section;

or the first and second building sections are configured, in use, so that access between an exterior of the building and the internal volume of the first building section is provided through the second building section;

or the second building section is configured, in use, so that its internal volume communicates both with the exterior of the building and the internal volume of the first building section, to thereby connect the internal volume of the first building section with the building exterior.

The access route may be or may provide a main accessway into the first building section and/or the building (and so again may provide a 'walkable' route or space). The access that is provided may be a main access into the first building section and/or the building.

The second building section may comprise a doorway which: provides the access route into the first building section; facilitates access between the exterior of the building and the first building section; or facilitates communication between the internal volume of the second building section and the building exterior. The doorway may be a main doorway of the building. The first building section may be devoid of a doorway (or at least a main doorway) to the building exterior.

The second building section may define a circulation space/zone or transition space/zone for the building. The circulation space may: define or comprise at least part of the access route; provide the required access; and/or facilitate the communication between the internal volume of the second building section and the building exterior. Access into the first building section from the building exterior may be provided via the circulation space.

The first building section may be free-standing and/or self-supporting.

According to a seventh aspect of the present invention, there is provided a hybrid residential building comprising a first building section and a second building section, in which:

the first building section is an on-site construction at a final location for the building and comprises an internal volume that provides a first living space within the building and at least one further living space within the building, the first living space and the at least one further living space optionally being isolated from one another within the first building section;

the second building section defines an internal volume and is transportable to the final location for the building in a substantially assembled form;

the first and second building sections are connected at the final location to form the building;

and optionally in which:

the second building section is configured to provide access between the first living space and the at least one further living space of the first building section when the first and second building sections are connected;

or the first and second building sections are configured so that access between the first living space and the at least one further living space of the first building section is provided through the second building section, when the first and second building sections are connected;

or the second building section is configured so that its internal volume communicates both with the first living space of the first building section and the at least one further living space of the first building section, when the first and second building sections are connected, to thereby connect said living spaces.

According to an eighth aspect of the present invention, there is provided a hybrid residential building system comprising:

a first building section configured to be constructed on-site at a final location for the building and comprising an internal volume that provides a first living space within the building and at least one further living space, the first living space and the at least one further living space optionally being isolated from one another within the first building section;

a second building section which defines an internal volume, and which is transportable to the final location for the building in a substantially assembled form;

in which the first and second building sections are adapted to be connected at the final location to form the building;

and optionally in which:

the second building section is configured, in use, to provide access between the first living space and the at least one further living space of the first building section (when the first and second building sections are connected);

or the first and second building sections are configured, in use, so that access between the first living space and the at least one further living space of the first building section is provided through the second building section (when the first and second building sections are connected);

or the second building section is configured, in use, so that its internal volume communicates both with the first living space of the first building section and the at least one further living space of the first building section (when the first and second building sections are connected) to thereby connect said living spaces.

The first and further living spaces may be isolated in that they may be physically out of communication with one another, so that it is not possible to pass from one of the living spaces to the other living space solely within the first building section. The second building section may again provide a 'walkable' route or space between said living spaces.

The first and further living spaces may be provided in a common storey, and/or at a common level, within the first building section.

According to a ninth aspect of the present invention, there is provided a hybrid residential building comprising a first building section and a second building section, in which:

the first building section is an on-site construction at a final location for the building and comprises a lower storey defining an internal volume that provides a lower living space within the building, and an upper storey defining an internal volume that provides an upper living space within the building;

the second building section defines an internal volume and is transportable to the final location in a substantially assembled form;

the first and second building sections are connected at the final location to form the building;

and optionally in which the second building section defines a circulation space for the building, access between the upper and lower living spaces of the first building section being provided via the circulation space.

According to a tenth aspect of the present invention, there is provided a hybrid residential building system comprising:

a first building section configured to be constructed on-site at a final location for the building and comprising a lower storey defining an internal volume that provides a lower living space within the building, and an upper storey defining an internal volume that provides an upper living space within the building;

a second building section defining an internal volume, and which is transportable to the final location in a substantially assembled form;

in which the first and second building sections are adapted to be connected at the final location to form the building;

and optionally in which the second building section is configured, in use, to define a circulation space for the building, access between the upper and lower living spaces of the first building section being provided via the circulation space.

Access into the first building section from the outside of the building may be provided via the circulation space. An access route between an exterior of the building and the first building section may be provided by the circulation space. The circulation space may be arranged to provide access between an exterior of the building and the first building section.

The circulation space (also referred to herein as a circulation zone or transition space/zone) of the second building section may define or comprise at least part of an access route between the upper and lower living spaces of the first building section; and/or may facilitate communication between the internal volume defined by the upper storey of the first building section, and the internal volume defined by the lower storey of the first building section, to thereby connect the internal volumes.

The circulation space may comprise one or more of: a staircase/stairs, hallway, landing, and one or more doorway. The circulation space may comprise a doorway into the second building section, which may provide a main access route into the first building section (and so the building). The doorway may form a main or front doorway of the building. The first building section may be devoid of a main or front doorway, the doorway being provided by the second building section, when connected to the first building section.

According to an eleventh aspect of the present invention, there is provided a hybrid residential building comprising a first building section and a second building section, in which:

the first building section is an on-site construction at a final location for the building and defines an internal volume that provides a living space within the building;

the second building section defines an internal volume and is transportable to the final location in a substantially assembled form;

the first and second building sections are connected at the final location to form the building;

and optionally in which:

the second building section defines a circulation space for the building, access into the first building section from the outside of the building being provided via the circulation space;

or the second building section defines a circulation space for the building, an access route between an exterior of the building and the first building section being provided by the circulation space;

or the second building section defines a circulation space for the building, the circulation space being arranged to provide access between an exterior of the building and the first building section.

According to a twelfth aspect of the present invention, there is provided a hybrid residential building system comprising:

a first building section configured to be constructed on-site at a final location for the building and comprising an internal volume that provides a living space within the building;

a second building section defining an internal volume, and which is transportable to the final location in a substantially assembled form;

in which the first and second building sections are adapted to be connected at the final location to form the building;

and optionally in which:

the second building section, in use, defines a circulation space for the building, access into the first building section from the outside of the building being provided via the circulation space;

or the second building section, in use, defines a circulation space for the building, an access route between an exterior of the building and the first building section being provided by the circulation space;

or the second building section, in use, defines a circulation space for the building, the circulation space being arranged to provide access between an exterior of the building and the first building section.

According to a thirteenth aspect of the present invention, there is provided a hybrid residential building comprising a first building section and a second building section, in which:

the first building section is an on-site construction at a final location for the building and comprises an internal volume that provides a first living space within the building and at least one further living space, the first living space and the at least one further living space optionally being isolated from one another within the first building section;

the second building section defines an internal volume and is transportable to the final location for the building in a substantially assembled form;

the first and second building sections are connected at the final location to form the building;

and optionally in which:

the second building section defines a circulation space which provides an access route between the first living space and the at least one further living space of the first building section;

or the second building section defines a circulation space which provides access between the first living space and the at least one further living space of the first building section;

or the second building section defines a circulation space which communicates with both the first living space of the first building section and the at least one further living space of the first building section, to thereby connect said living spaces.

According to a fourteenth aspect of the present invention, there is provided a hybrid residential building system comprising:

a first building section configured to be constructed on-site at a final location for the building and comprising an internal volume that provides a first living space within the building and at least one further living space, the first living space and the at least one further living space optionally being isolated from one another within the first building section;

a second building section defining an internal volume and which is transportable to the final location for the building in a substantially assembled form;

in which the first and second building sections are adapted to be connected at the final location to form the building;

and optionally in which:

the second building section defines a circulation space which provides an access route between the first living space and the at least one further living space of the first building section, when the first and second building sections are connected;

or the second building section defines a circulation space which provides access between the first living space and the at least one further living space of the first building section, when the first and second building sections are connected;

or the second building section defines a circulation space which communicates with both the first living space of the first building section and the at least one further living space of the first building section, when the first and second building sections are connected, to thereby connect said living spaces.

Optional further features of the hybrid residential buildings and systems set out in the first to fourteenth aspects of the invention are set out below.

Reference is made in this document to a 'hybrid' residential building. The residential building is a hybrid in that part of the building is an on-site construction at the final location (the first building section), and part is constructed separately and transported to the final location (the second building section). The building is formed at the final location by connecting the first and second building sections together.

Reference is made in this document to the first building section being an on-site construction. This should be taken to mean that the first building section is constructed at the site using an arrangement of parts, components and/or materials which are provided at the site. This is in contrast for example to modular buildings which are assembled at a final location using building units or sections that have been constructed off-site (e.g. in a construction facility or factory) and which, in their constructed form, define part of an internal volume of the finished building.

The second building section may be constructed away from the final location. The second building section may be an off-site construction, and may be transportable to the site in the substantially assembled form.

The first building section may be constructed first, and the second building section subsequently connected to the first building section to form the building. Alternatively, the second building section may be located on the site, and the first building section subsequently constructed and connected to the second building section (suitably during the construction process). The first building section may be built on or from the second building section, for example using the second building section as a support or platform for part or parts of the first building section.

Reference is made in this document to a site for the building, and to on-site and off-site constructions. It will be understood that the site may be or may define the final location for the building (which may be a fixed location), or may be a larger building/construction site comprising a plurality of plots (the final location being provided by one of said plots). In either case, it is envisaged that the second building section will generally be constructed away from the site. Options include a factory or facility that is distanced from the site, and accessible by road and/or rail from the site. Other options include a factory or facility provided on or as part e.g. of such a larger building site (but distanced from the plot), for constructing a plurality of second building sections which are to be used in the construction of a plurality of buildings.

The provision of a hybrid residential building comprising the first and second building sections offers numerous advantages over prior buildings and associated construction techniques, including over prior modular buildings.

For example, construction of the first building section at the final location enables the use of conventional (non-modular) construction techniques. These can be relatively simple, enabling construction of the first building section in a time and cost-effective manner. A relatively large proportion of the total building volume may be provided by the first building section, and so construction using conventional techniques can be beneficial in minimising costs.

Furthermore, and in contrast to prior modular buildings, it is not necessary to construct relatively large/bulky modular building units off-site (to be used to form the first building section), e.g. in a modular construction facility or factory. Prior units of this type each define an internal void or volume which forms part of the total volume of the assembled building. This can provide the related benefits that: it is not necessary to provide a large assembly space within the facility for constructing the modular building units; it is not necessary to transport such bulky units from the facility to the site (e.g. by road/rail); and it is not necessary to provide space for storing such bulky units either at the facility, or at the site where the building is to be formed.

Construction of the second building section away from the final location has the benefit that skilled tradespeople need not be constantly in attendance on-site, and can instead work remotely in a specialised facility. The second building section can be transported on-site for use in construction of the hybrid residential building as and when required. As will be described below, the second building section may comprise more complex parts of the finished building, such as a staircase/stairs, bathroom, ensuite, and a W.C./washroom, amongst other things. Construction away from the final location by dedicated workers may facilitate the construction process and improve quality control. Limiting such construction to the more complex second building section enables these positive outcomes to be achieved whilst minimising transportation of bulky components to the final location. It may also simplify construction of the first building section. A balance can therefore be reached in which the first building section can be constructed at the final location in a cost and time-effective manner using simple conventional techniques, whereas the more complex second building section can be constructed in a reliable and quality-controlled manner whilst minimising the size (volume) of components that need to be transported to the final location.

Wear and tear occurring e.g. due to the movement of people between the upper and lower living spaces may occur primarily (and optionally entirely) in the second building section. The second building section may be releasably connected to the first building section. Constructing the second building section away from the final location and making it transportable means that it can readily be removed and replaced, for example in the event of maintenance being required to address such wear and tear, and/or if replacement of the section is required. This contrasts to the first building section, which is constructed on site and so of a fixed nature.

Providing an access route/access passing through the second building section, and the second building section so that it provides the specified communication, may also reduce the complexity of the first building section, enabling it to be constructed relatively quickly and cheaply. In particular, it is possible to construct the first building section without a stairs/staircase and/or a main or front doorway, simplifying on-site construction.

The second building section may comprise or contain a staircase/stairs, which may: define at least part of the access route; provide the required access; and/or facilitate the internal volume relationship/internal communication. Provision of the staircase in the second building section may enhance the structural stiffness/rigidity of the building section, which may in-turn facilitate its transportation. The staircase/stairs may be in or may provide part of the circulation space.

Construction of the second building section away from the final location may facilitate reliable construction in a controlled environment, with enhanced quality control.

The first building section may be of any type that is suitable for on-site construction, but may exclude modular-type constructions. A modular-type construction, in this context, should be taken to mean a construction in which all (or substantially all) of a final volume of a building is pre-formed, comprising a series of building parts or units each defining a portion of the final volume of the building, for subsequent transportation to a final location for the building. The first building section may be of a construction selected from the group comprising: a blockwork/masonry construction e.g. of clay bricks and/or cement blocks; a timber frame and blockwork/masonry construction; a timber frame and cladding construction; a metal frame construction (optionally comprising panels coupled to the frame e.g. structural insulated 'SIP' panels); a time-setting 3D printed construction e.g. of a cementitious material; and combinations thereof. The first building section may be or may comprise a kit of building materials (e.g. blocks, timber frame components, metal structural elements) which can be used in the on-site construction of the building section.

Reference is made to the second building section being transportable to the final location in a substantially assembled form. This may be taken to mean that the second building section is constructed to a state in which: it can be transported safely (i.e. it has sufficient structural integrity/rigidity for transport purposes); minimal further work is required to be carried out on the second building section in order to connect it to the first building section; and/or minimal (optionally no) further work is required to complete a portion of the building formed by the second building section. Such further work may be of a structural and/or weatherproofing nature, and may exclude work associated with a final fit-out of the second building section, for example of a decorative nature (in particular the application of 'perishable' materials such as plaster/plasterboard, decorative panels and surface finishes such as paint). As will be explained elsewhere in this document, the second building section may comprise a plurality of subsections or units which may be configured to be fitted or coupled together to form the completed building section. The subsections may be independently transportable, and connected at the site to form the completed second building section. In this context, the reference to the second building section being transportable to the final location in a substantially assembled form should be taken to mean that the subsections are each transportable in a substantially assembled form (and does not require the subsections to be connected prior to transport to the final location). The reference to the second building section being transportable to the final location in a substantially assembled form therefore encompasses constructing such subsections to substantially assembled forms, transporting the subsections to the final location in their assembled forms, and then connecting the subsections at the final location to form the second building section.

The first building section may have a total internal volume, which may be the sum of: the internal volume defined by its lower storey: and the internal volume defined by its upper storey (or all its storeys where there are more than two). If there is only one storey then the total internal volume is the volume of that storey. The hybrid residential building may have a total internal volume, which may be the sum of the total internal volume of the first building section, and the internal volume of the second building section. The second building section may define at least around 15% of the total internal volume of the building, optionally at least around 20%, optionally at least around 25%, and optionally up to around 30% of said volume. The first building section may define no more than around 85% of the total internal volume of the building, optionally no more than around 80%, optionally no more than around 75%, and optionally no more than around 70% of said volume. A ratio of the total internal volume of the building provided by the second building section relative to the total internal volume of the building provided by the first building section may be around 15:85, optionally around 20:80, optionally around 25:75, and optionally around 30:70. In a variation, which may apply particularly to smaller buildings, the second building section could provide up to around 50% of the total internal volume of the building (and so around a 50:50 ratio of second building section volume relative to the total).

Arranging the second building section to provide between around 15% to 30% of the total internal volume of the building, and in particular up to around 30% of the internal volume, may provide sufficient volume for a usable space (optionally a living space) within the second building section, and for the required access to be provided passing through it. Restricting the proportion of the total living space provided by the second building section to no more than around 30% may also facilitate construction of the second building section, and/or its transportation to the final location (by effectively limiting its size).

The access route which is provided by the second building section may be the sole access route, and/or the second building section may provide sole access (between the upper and lower storeys of the first building section: between the building exterior and the internal volume of the first building section: and/or between living spaces of the first building section). The first building section may be devoid of an access route, and/or may not provide access (absent the second building section). In a variation however, another access route may be provided directly from the exterior into the first building section, e.g. it may include a back or side door.

Reference is made in this document to living spaces defined by parts of the building (e.g. by storeys of the first building section, and by the second building section). In the context of the invention, a living space should be taken to mean an area within which a person can live, and which may exclude: storage areas (e.g. cupboards, closets, garage); technical areas (e.g. boiler rooms or cupboards, water storage tank cupboards); attics, lofts, basements and cellars (unless they provide a livable space e.g. a bedroom); and outdoor spaces (e.g. decks, patios, balconies and verandas). Living spaces will typically be covered or enclosed (in the completed building), and heated. A non-limiting list of rooms or areas that may fall within the definition of 'living space' includes: kitchens, bedrooms, living/sitting rooms and leisure areas, dining rooms, bathrooms, W/Cs and ensuites.

The second building section internal volume may provide a further living space within the building. The second building section may provide usable space within the building, which may be non-living space such as storage or technical space (and which for example may comprise one or more of a boiler room/cupboard, a storage cupboard/closet, a water storage tank cupboard, a delivery drop-off area, and a porch).

The second building section may comprise or contain one or more of a hallway and a landing, each of which may: define at least part of the access route; at least partly provide the required access; or facilitate the internal volume relationship/communication. The hallway and/or landing may be provided in, or may define at least part of, the circulation space.

The second building section may comprise or contain one or more of: a W/C, a washroom, a delivery drop-off area, a bathroom, an ensuite, a front or main doorway and/or door, a further (e.g. side) doorway and/or door, and one or more window. In traditional construction, replacement of components in these areas or performing upgrades and/or testing in these areas is costly and time consuming. As a result of these areas being contained in the second building section, upgrade and modification can be made easier, as the second building section may be capable of being removed from connection with the first building section. The provision of doors and/or windows in the second building section may be particularly beneficial. This is because the fitting of doors and windows is a skilled operation and subject to significant variations in quality. Performing installation of doors and windows away from the final location provides a degree of reliability and effective quality control, particularly to ensure adequate air-tightness of a fit between a frame of the door/window and a wall of the building section. The second building section can optionally include one or more bedroom.

Living space or spaces provided by the first building section may form at least part of one or more room. The one or more room may be selected from the group comprising: a kitchen; a dining room; a living or sitting room or leisure room; a bedroom; and an open plan room comprising a plurality of different usage areas. The usage areas may be selected from the group comprising: a kitchen area: a dining area; and a living, sitting or leisure area. Whilst it may be preferable to provide a kitchen in the first building section, the second building section could optionally include a kitchen.

Typically, the upper living space will form at least part of one or more bedroom, and the lower living space will form at least part of: a kitchen; a dining room; a living or sitting room; and/or an open plan room comprising a plurality of different usage areas of the type set out above. Depending on factors including building design and ground conditions (e.g. a slope or inclination of the land), the room or rooms provided by the upper and lower living spaces may be reversed. For example, the lower living space may provide at least part of a bedroom or bedrooms, and the upper living space may provide at least part of a kitchen, dining room and/or living room. Bedrooms could be provided in both living spaces.

The internal volume defined by the second building section (in particular a living space of the section) may form at least part of one or more room. The one or more room may be selected from the group comprising: a W/C; a washroom; a bathroom; an ensuite (which may comprise a bath and/or shower, and optionally a toilet); and a kitchen.

The first building section may comprise a kitchen. At least part of the kitchen (e.g. kitchen units) may be adjacent the second building section. At least part of the kitchen may be connected or coupled to the second building section. Services for the kitchen (including electrical power, water supply, sewerage/wastewater outlet and/or gas supply) may be provided by the second building section. The second building section may comprise connectors for providing the services to the kitchen. At least part of the kitchen may be mounted to or on a wall of the second building section, which may be an external wall of the section (said wall optionally forming an internal wall of the building when the building sections are connected). The kitchen may comprise a mounting panel to which at least part of the kitchen (e.g. some kitchen units) is mounted, the panel being coupled or connected to the external wall of the second building section. In a variation, the second building section may comprise a kitchen, or at least part of a kitchen. This may apply particularly to smaller buildings.

At least one room may be defined jointly by a living space of the first building section and by the second building section (suitably its living space). Connection of the building sections may therefore complete the room or rooms. For example, the upper living space of the first building section may define part of a bedroom, and the living space of the second building section may define a further part of the bedroom. When the building sections are connected, said parts may together define the complete bedroom.

The first building section may be configured so that the internal volume defined by the lower storey is isolated from the internal volume defined by the upper storey. Said internal volumes may be isolated in that they may be physically out of communication with one another, so that it is not possible to pass from one of the internal volumes to the other internal volume solely within the first building section. The first and second building sections may be configured so that access between the internal volumes of the upper and lower storeys of the first building section is provided through the second building section. The access route passing through the second building section may permit passage between the isolated volumes.

The second building section may be configured to provide access between the internal volumes of the upper and lower storeys of the first building section when the first and second building sections are connected. The first and second building sections may be configured so that access between the internal volumes of the upper and lower storeys of the first building section is provided through the second building section. Access may be via the access route.

The second building section may be configured so that its internal volume communicates with both the internal volume defined by the upper storey of the first building section, and the internal volume defined by the lower storey of the first building section, to thereby connect or couple the internal volumes of the upper and lower storeys, when the building sections are connected.

The second building section may be configured so that its internal volume communicates with the building exterior, and with the internal volume of the first building section.

The second building section, in particular its internal volume, may define at least part of a circulation space/zone (or transition space/zone) for the building. Access into the first building section from the outside of the building may be provided via the circulation space. Access between the upper and lower living spaces of the first building section may be provided via the circulation space. The circulation space may: define or comprise at least part of the access route; provide the required access; and/or facilitate the internal volume relationship/communication. The circulation space may comprise one or more of: a staircase/stairs, hallway, landing, and one or more doorway. The circulation space may comprise a doorway into the second building section, which may provide a main access route into the first building section (and so the building). The doorway may form a main or front doorway of the building. The first building section may be devoid of a main or front doorway, the doorway being provided by the second building section, when connected to the first building section.

The second building section, in particular the circulation space, may be configured to provide all of the doorways within the building, or at least a majority of the doorways. This may simplify construction of the first building section. The doorways may be internal and/or external doorways. Doorways provided by the second building section may be at least around 800 mm in width, and optionally up to around 900 mm in width. A sum of the widths of the doorways provided by the second building section, optionally for each storey of the first building section, may be greater than about 1800 mm (i.e. more than two doorways per storey), may be at least about 2400 mm (i.e. at least three doorways), and may be at least about 2700 mm.

The circulation space may be configured to provide access to a plurality of rooms of the building (optionally three or more), which rooms may all be provided by a living space of the first building section, optionally by a living space of one of the storeys of the first building section and/or at a common level in said section. The circulation space may be configured to provide access to a plurality of rooms of the building provided by the lower storey living space of the first building section, and/or a plurality of rooms of the building provided by the upper storey living space of the first building section. Where further storeys are provided, the circulation space may provide access to a plurality of rooms of the further storey. Access may be via doorways.

The circulation space may be configured to provide access to a plurality of different areas (which may be usage areas) of a single room, each area optionally being accessed by a different doorway.

The circulation space may comprise one or both of a hallway and a landing, and a plurality of doorways (which may each open on to a respective room or area of one room). The hallway/landing and doorways may provide the required access route/access. The circulation space may include all doorways required to gain access to the rooms/areas within the first building section. This may be of particular benefit as the fitting of doorways (and mounting of doors in the doorways) is a skilled job which can be carried out in a verifiable manner in an off-site facility. Also, it is well known that light switches are typically provided adjacent doorways. The invention may allow all (or most) of the switches associated with lights in the first building section rooms/areas to be provided in or by the second building section. A benefit of this is that power for operating the lights can be routed into the second section and then to the light switches, simplifying construction of the first building section. It may then only be necessary to connect light fittings in the rooms to the switches, which may be via connectors provided on or in the second building section.

The first building section, optionally one of its storeys, may comprise all (or a majority) of the bedrooms of the building. Access between all (or at least a majority) of the bedrooms may be provided by the second building section circulation space, or by the access route/access which said section provides. This may simplify on-site construction of the first building section. The same principle may apply to room types other than bedrooms, e.g. to kitchen, living/sitting rooms, dining rooms, bathrooms. WCs and ensuites. Access to such rooms will therefore depend on the particular layout of rooms in the building.

The or a living space of the first building section may comprise a first living space part and at least one further living space part. The living space parts may be isolated from one another within the first building section. The living space parts may be isolated in that they may be physically out of communication with one another, so that it is not possible to pass from one of the living space parts to the other one of said living space parts solely within the first building section. The second building section may be configured to provide access between the first living space part and the at least one further living space part when the first and second building sections are connected. Access may be via an access route (which may be a further access route), and/or provided by the circulation space, of the second building section. The second building section may be configured so that its internal volume communicates both with the first living space part and with the further living space part of the first building section, to thereby connect said living space parts, when the first and second building sections are connected.

The lower living space of the first building section may comprise a first lower living space part and at least one further lower living space part. The second building section may be configured to provide access between the first lower living space part and the at least one further lower living space part of the first building section when the first and second building sections are connected. Access may be via an access route, and/or provided by the circulation space, of the second building section.

The upper living space of the first building section may comprise a first upper living space part and at least one further upper living space part. The second building section may be configured to provide access between the first upper living space part and the at least one further upper living space part of the first building section when the first and second building sections are connected. Access may be via an access route, and/or provided by the circulation space, of the second building section.

The second building section may be configured so that its internal volume communicates both with the lower living space of the first building section and the upper living space of the first building section, to thereby connect said living spaces, when the first and second building sections are connected.

The second building section may comprise a plurality of subsections or units which may be configured to be fitted or coupled together to form the completed building section. Each subsection may define a respective part of the internal building volume of the second building section. The subsections may be configured so that said parts of the internal building volume communicate with one-another, to permit movement (i.e. access) between the different parts. Two or more (and optionally each) of said parts may: define a respective portion of the access route; together provide for the required access; together facilitate the internal volume relationship/communication; or provide the circulation space or spaces.

The subsections may be independently transportable and adapted to be connected at the site. The subsections may be stackable (directly or indirectly), and may be arranged so that they can be stacked one on top of the other. The subsections may interconnect. An intermediate component may be provided between the subsections, e.g. a floor or frame section, which might form a part of the first building section. At least some subsections may have common floor plans and/or shapes. One subsection may comprise or form a roof, or may be configured to receive a roof.

The second building section may comprise a lower subsection and an upper subsection. The lower subsection may form a lower storey of the second building section, which may communicate with the internal volume defined by the lower storey of the first building section. The lower storey formed by the lower subsection may comprise a floor, and the floor may be at a level which is substantially the same as that of a floor of the first building section lower storey. The upper subsection may form an upper storey of the second building section, which may communicate with the internal volume defined by the upper storey of the first building section. The upper storey formed by the upper subsection may comprise a floor, and the floor may be at a level which is substantially the same as that of a floor of the first building section upper storey. It will be understood that the floor level of the first building section upper storey is typically vertically above the floor level of the first building section lower storey.

The lower subsection may comprise a staircase/stairs. The upper subsection may comprise an aperture or opening which communicates with the staircase when the subsections are connected, to permit passage between the lower and upper subsections via the staircase. The aperture may open on to a landing defined by or provided within the upper subsection. The staircase and the aperture may both be provided on/in, or may form part of, the circulation space: the access route; may provide for the required access; or may facilitate the internal volume relationship/communication.

The second building section may comprise more than one upper subsection, and may comprise: a lower subsection, a first upper subsection, and a second upper subsection. The first upper subsection may form a middle subsection, and the second upper subsection may form a top subsection. The top subsection may be stacked or seated on the middle subsection. The middle subsection may be stacked or seated upon the lower subsection. The lower subsection may comprise a lower staircase/stairs. The middle subsection may comprise a middle staircase/stairs. The lower staircase and the middle staircase may communicate with one another, or be otherwise associated, so to permit passage between the lower and upper subsections. The middle subsection may comprise an aperture or opening which communicates with the staircase in the lower subsection, when the subsections are connected, to permit passage between the lower and middle subsections via the lower staircase. The aperture may open on to a middle landing defined by or within the middle subsection. The top subsection may comprise an aperture or opening which communicates with the staircase in the middle subsection, when the subsections are connected, to permit passage between the middle and top subsections via the middle staircase. The aperture may open on to a top landing defined by or within the top subsection.

In a variation, the second building section may be provided as a single unit or structure defining a lower subsection/portion and an upper subsection/portion, and optionally at least one further subsection/portion (e.g. lower, middle and top). The subsections may be provided within a single or unitary outer structure or envelope which contains all of the subsections.

Where the second building section comprises middle and upper subsections, the first building section may comprise a middle storey defining an internal volume, which may provide a middle living space within the building. The middle subsection may form a middle storey of the second building section, which may communicate with the internal volume defined by the middle storey of the first building section. The middle storey formed by the middle subsection may comprise a floor, and the floor may be at a level which is substantially the same as that of a floor of the first building section middle storey.

The first and/or second building sections may comprise more than two storeys. The number of storeys in the first and second building sections may be equal. However, one of the first and second building sections may comprise more stories than the other section. For example, one of the building sections may comprise a top (third) storey which is positioned above the upper storey of the other building section when the sections are connected.

The building may comprise a ventilation system. The ventilation system may be configured: to supply external air into the building; and/or to withdraw internal air from the building and to discharge it to the building exterior, to thereby control ventilation of the building. The ventilation system may be provided in the first or second building section. Parts of the ventilation system may be provided in both of the building sections. It may however be preferable that the ventilation system is provided in the second building section, so that the system can be installed in an off-site facility as discussed elsewhere in this document (providing similar benefits).

The ventilation system may be configured to supply external air into the (or each) internal volume of the first building section. The ventilation system may be configured to supply external air directly or indirectly into said internal volume.

The external air may be supplied directly into said internal volume via at least one vent provided in a wall of the second building section.

The external air may be supplied indirectly into said internal volume via one or more duct/conduit in the first building section. The ventilation system may comprise one or more duct/conduit in the second building section, which may connect with the or a duct/conduit in the first building section for the supply of air.

The ventilation system may be configured to supply external air into the internal volume of one of the building sections (e.g. the second building section), for subsequent flow/bleed into the other one of the building sections (e.g. the first building section). The bleed may occur e.g. under positive pressure applied to the air in the internal volume of the building section into which the external air is supplied. The ventilation system may be configured to supply external air into a space or cavity between the first and second building sections, for subsequent flow/bleed into the first building section (e.g. under positive pressure), and optionally into the second building section.

The ventilation system may be configured to withdraw internal air from the (or each) internal volume of the first building section. The ventilation system may be configured to withdraw internal air directly or indirectly from said internal volume.

The internal air may be withdrawn directly from said internal volume via at least one vent provided in a wall of the second building section.

The internal air may be withdrawn indirectly from said internal volume via one or more duct/conduit in the first building section. The ventilation system may comprise one or more duct/conduit in the second building section, which may connect with the or a duct/conduit in the first building section for the withdrawal of air. The ventilation system may be configured to withdraw internal air from the internal volume of the second building section, to thereby draw internal air from the first building section (e.g. under negative pressure applied to the air in the or each internal volume of the second building section). The ventilation system may be configured to withdraw internal air from a space or cavity between the first and second building sections (e.g. under negative pressure).

The ventilation system may be configured to supply air into a first area of the building, and to withdraw air from a further area which is spaced or distanced from the first area. This may promote a flow of air within the building.

The ventilation system may be configured to draw external air from an exterior of the building, and to discharge the air into the building. The ventilation system may be configured to discharge internal air drawn from the interior of the building to an exterior of the building.

The ventilation system may comprise a control unit for controlling the supply of external air into, and the withdrawal of internal air from, the building. The ventilation system may comprise a heat exchanger, which may be for transferring thermal energy: from internal air drawn from the building to the incoming external air (to heat the incoming external air); and/or from incoming external air to the internal air drawn from the building (to cool the incoming external air). The heating or cooling effect applied will depend on factors including a temperature differential between the external and internal air, and a desired temperature for the air within the building. The ventilation system may take the form of a Mechanical Ventilation and Heat Recovery (MVHR) system, also known as an MHRV system. The ventilation system may comprise a filter for filtering the external air prior to supplying the air into an internal volume of the building. The ventilation system may comprise, or may be configured to cooperate with, a heating and/or cooling device, for heating or cooling the external air prior to discharge into the building. The heat exchanger, filter and/or heating/cooling device may form part of a conditioning unit of the ventilation system.

The ventilation system may be configured to supply external air into the internal volume of the second building section, and to withdraw internal air from the internal volume of the second building section.

The ventilation system may comprise at least one supply duct in the second building section, and at least one extraction duct in the second building section. The ventilation system may comprise at least one supply duct in the second building section, which connects with the supply duct in the first building section and/or with the supply vent in the wall of the second building section; and at least one extraction duct in the second building section, which connects with the extraction duct in the first building section, and/or with the extraction vent in the wall of the second building section. The ventilation system may comprise a manifold in the second building section, which may provide the required duct/ducts.

Where the ventilation system (or at least part of it) is provided in the first building section, the arrangement of ducts (and optionally at least some vents) set out above may be reversed.

The first building section may be constructed at a final, fixed, on-site location of the building, and may be configured to receive the second building section. The second building section may be connected to and received by the first building section.

The first building section may be preconfigured, during on-site construction of the building section (i.e. at the final location), to receive the second building section. That is, the first building section is constructed in the knowledge that a second building section is to be connected. In this way, build-times are reduced as the first building section may not need to be further modified to facilitate the connection of a second building section.

The first building section may be configured to removably receive the second building section. The second building section may be portable, in a form to be connected to and received by the first building section. Providing a second building section which is portable, and configuring the first building section to removably receive it, may facilitate disconnection of the second building section from the first building section, for example for replacement and/or maintenance purposes. The second building section may be removable from the final location. The second building section may be replaceable with a third building section configured in the same way as the second building section. Accordingly, the third building section may define an internal volume, which may provide a further living space within the building, and may be transportable to the final location in a substantially assembled form. The first and third building sections may be connected at the site to form the building. The first and third building sections may be configured so that an access route passes through the third building section (or alternatively to provide the access, facilitate the internal volume relationship/communication, or provide the circulation space(s), specified above in relation to the second building section). In a variation, maintenance may be carried out on the second building section, suitably off-site, and the second building section subsequently reconnected to the first building section to provide the access route (or access/internal volume relationship or communication, or circulation space).

The first building section may have one or more open faces, and may be configured to removably receive or connect to the second building section at the one or more open faces. The second building section may be docked to or with the first building section, and may thereby close the one or more open faces of the first building section. The second building section may close two or more open faces of the first building section. The or each face may be in a vertical plane, and/or formed or defined by a vertical plane of the first building section.

The second building section may define or may form at least one corner of the building, when connected to the first building section.

The second building section may have one or more external walls, and may be connected to the first building section thereby to provide the one or more external walls as one or more internal walls of the first building section. The one or more external walls of the second building section may form a separating wall between the second building section and the first building section.

The first building section may be configured to receive the second building section, and the second building section may be connected to and received by the first building section.

The building may be serviced with one or more services via the second building section. The one or more services may be received by the second building section from external to one or more of the first building section, second building section and building. The one or more services may be: water; gas; heating; electric; telecoms; and/or air supply. The one more services may comprise an electrical power supply and/or telecoms, and the electrical power and/or telecoms may be wirelessly transmitted to the first building section from the second building section. The one or more services may comprise a heat supply. The one or more services may comprise a water supply, and all (or at least one or more) wet facilities may be (e.g. entirely) provided within the second building section.

The building, optionally the first building section, may comprise a services hub. The second building section may be serviced with one or more services via the services hub. In this way, the services can be routed to the second building section via the services hub. The services hub may be a specific hub (which could be a boiler room or plant room), which may house fuse boxes, a boiler, and other apparatus. The services hub may be provided separately, and/or may not form part of the building. The services hub may be housed within the first building section or the second building section. The services hub may be accessible from the exterior of the building. The services hub may be thermally isolated from a remainder of the building. e.g. from the first or second building section where housed within one of the sections. Thermal isolation may be via suitable insulation. The services may be terminated at the first building section, optionally in the services hub, and may then be routed from there to the second building section for supply into the first building section e.g. to its living space(s).

The first building section may take the form of a dock, and may be constructed at the final location of the building (which may be a fixed, on-site location). The dock may be configured to receive a module. The second building section may take the form of or may provide the module. The module may be connected to and received by the dock.

Reference is made in this document to a 'residential' building. In the context of the invention, this should be taken to mean a building in which sleeping accommodation is provided for normal residential purposes, preferably with cooking and dining facilities. Non-limiting examples of residential buildings falling with the scope of the invention include houses (detached, semi-detached, and terraced), as well as apartments and flats. Some of the aspects and/or principles of the invention can be applied to single storey residential buildings, which may be a single storey house/bungalow.

The first building section may be free-standing and/or self-supporting. The first building section may not therefore require the second building section to be present to ensure its structural integrity, or for support. This may facilitate on-site construction of the first building section without requiring the second building section to be present on the site. The second building section may, however, provide additional support to the first building section, and therefore to the building, once connected.

The second building section may comprise a metal (e.g. steel) frame support structure. This may facilitate construction in a factory or facility away from the final location for the building, and may provide sufficient rigidity for the second building section to be transported to the final location. The first building section may be connected to and/or supported by the second building section, in particular by the metal frame structure. The first building section may comprise structural elements such as beams and/or columns, and at least some of the structural elements may be connected to and/or supported by the second building section. The metal frame structure may comprise hot-formed (e.g. hot rolled) structural elements. This may be beneficial as such hot-formed structural elements can span reasonably large distances, which can facilitate the formation of apertures (e.g. doorways) at a perimeter of the building section. The first building section may comprise a metal (e.g. steel) frame support structure, which may have features similar to those set out above for the second building section.

The second building section may comprise one or more of: a main doorway, which may provide a main accessway into the first building section (and so the building); a stairs/staircase, which may provide access between the upper and lower storeys of the first building section; a hallway, which may connect the main doorway with the stairs/staircase: one or more internal doorways, which may each provide access to a different room of the building, or to different areas of a single room; and a landing, which may provide an accessway from the stairs/staircase to one or more doorways or rooms (or different areas of a single room) provided in the upper storey of the first building section, and/or between the rooms themselves (or different areas of a room). The hallway may also connect the main doorway with one or more internal doorways/rooms/room areas. The second building section may comprise all, or a majority of, the doorways for the building. The second building section may comprise all, or at least a majority of, the wet facilities for the building. These may include one or more of: a bathroom; a W/C; an ensuite; water supply for other purposes including to a kitchen; and sewerage/wastewater connections.

The second building section may provide a fire escape route for the building. The fire escape route may comprise the main doorway (and/or another doorway providing a route into the building), the stairs/staircase, the hallway, and optionally the landing. The second building section may comprise fire-proof or fire-resistant structures defining the fire escape route. For example, the fire escape route may be bound or bordered by fire-resistant or fire-proof walls, and optionally by fire-resistant or fire-proof doors mounted in any doorways opening on to, or provided in, the fire escape route. The second building section may comprise a fire suppression system. The fire suppression system may be selectively operable: to define the fire escape route; to suppress a fire within the fire escape route; or to suppress a fire to restrict or prevent it from spreading into the fire escape route. The fire escape route may include at least part of one or more of the circulation spaces defined elsewhere in this document.

The first and/or second building sections may be configured so that there is a substantially air-tight seal between the first and second building sections. This may be advantageous in restricting air ingress into the building, and air egress from the building, at an interface between the building sections. The seal may be between an external surface of the second building section and an external surface of the first building section (which surfaces may face each other when the sections are connected). The seal may be provided at an interface between the building sections. One of the first and second building sections may carry or may comprise one or more sealing element or structure, which may be adapted to sealingly abut the other one of the first and second building sections to provide the required seal between the building sections. Said other one of the building sections may define or may comprise a surface configured to cooperate with the sealing element to provide the required seal. The seal may be substantially air-tight in that air egress/ingress between the building sections at the region of the interface may be restricted, and optionally substantially entirely prevented. The first building section may comprise at least one open face, and the second building section may be connected to the first building section so that it closes the at least one open face. The second building section may thereby define at least part of an external surface of the building, and the interface may be at least partly disposed on, in or at the external surface. The building sections may be arranged so that the seal (in particular the sealing element/structure) is compressed when the sections are connected. The seal may be arranged to overlie at least part of one of the building sections, and may be arranged so that it overlies the interface. The seal (in particular the sealing element/structure) may overlie a roof or roof portion of one or both of the building sections.

The building may have an external surface and/or a perimeter, which may be provided by walls of the building (and may exclude a roof of the building). Part of the external surface/perimeter may be provided by the first building section, and part by the second building section. At least one wall of the second building section may therefore provide an external or outwardly facing wall of the building (or may define part of its perimeter). The second building section may define at least around 20% of the total surface area of the building (defined by the external surface/perimeter), optionally at least around 25%, and optionally up to around 30% of said surface area. In a preferred option, the second building section may define between around 24% and around 28% of said surface area. The first building section may define no more than around 80% of the total surface area of the building, optionally no more than around 75%, and optionally no more than around 70% of said surface area.

Arranging the second building section to provide between around 15% to 30% of the total surface area of the building, and in particular up to around 30% of the surface area, may provide sufficient usable internal space (optionally a living space) within the second building section, and for the required access passing through it. Restricting the proportion of the total surface area (and so internal space) provided by the second building section to no more than around 30% may also facilitate construction of the second building section, and/or its transportation to the final location. In a variation, which may apply particularly to smaller buildings, the second building section could provide up to around 50% of the total surface area of the building.

Reference is made throughout this document to the provision of a stairs or staircase in the building, suitably provided by the second building section. It will be understood that a lift or any other suitable means of moving between storeys of the building may be provided, in place of (or in addition to) a stairs/staircase. Therefore wherever a stairs or staircase is referred to, it will be understood that a lift may be provided. Where the second building section comprises a plurality of subsections, each subsection may define part of a lift (e.g. a part of a lift shaft), which parts may cooperate when the subsections are connected, so that a lift vehicle may move between the storeys (e.g. through the aligned shaft parts).

The first building section may comprise first and second portions which together define the first building section, and which may be arranged (e.g. connected) so that the first and second portions are disposed at a non-parallel angle relative to one another. The first and second portions may be substantially elongate. The first and second portions may have respective main axes. The first and second portions may be arranged so that the first portion main axis is disposed at a non-parallel angle (e.g. substantially perpendicular) relative to the second portion main axis. The second building section may be connected to both of the first and second portions. The first building section may comprise at least one further portion which may be arranged relative to an adjacent portion (e.g. the first and/or second portion) so that said portions are disposed at such a non-parallel angle relative to one another. Axes of said portions may be disposed as set out above. The second building section may be connected to two, or more than two, of such portions.

The first building section may have a cross-section, in plan view, having two substantially perpendicularly connected elongate regions. The second building section may be connected to both elongate regions.

The first building section may have a substantially L-shaped cross-section, in plan view. The second building section may be connected to both the first and second portions (or both of the elongate regions) of, or forming, the L-shaped cross-section.

The second building section may comprise first and second external walls, which may be disposed adjacent one another, and which may together form a corner of the second building section. The first and second external walls may be disposed at non-parallel angles relative to one another, e.g. substantially perpendicular. The first and second external walls may each be connected to a respective one of the first and second portions (or elongate regions) of the first building section, so that the corner of the second building section is disposed within the building when the building sections are connected. The angle between the first and second portions of the first building section may be the same as the angle between the first and second external walls of the second building section.

According to a fifteenth aspect of the present invention, there is provided a first building section of a hybrid residential building, in which the first building section is an on-site construction configured to be connected with or to a second building section of the building transported to a final location for the building in a substantially assembled form, and in which the first building section comprises a lower storey defining an internal volume that provides a lower living space within the building, and an upper storey defining an internal volume that provides an upper living space within the building: and optionally in which the first building section is configured so that it does not provide a complete access route between its upper and lower living spaces.

According to a sixteenth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use, to provide at least part of an access route between an upper living space provided by an internal volume of an upper storey of the first building section and a lower living space provided by an internal volume of a lower storey of the first building section.

The second building section may provide a living space within the building. The second building section may comprise one or more of: a main doorway, which may provide a main accessway into the first building section (and so the building); a stairs/staircase, which may provide access between storeys of the first building section; a hallway, which may connect the main doorway with the stairs/staircase; one or more internal doorways, which may each provide access to a different room of the building, or to different areas of a single room; and a landing, which may provide an accessway from the stairs/staircase to one or more doorways/rooms (or different areas of a single room), and/or between the rooms themselves (or different areas of a room).

The first building section may not provide a complete access route either in that: it only forms part of an access route and requires connection of the second building section in order to complete the route; or in that no part of an access route is provided by the first building section.

Reference is made throughout this document to access routes and access both within the building, and between the building exterior and the interior of the building (as well as to circulation space which can provide such access routes/access). It will be understood that this is intended to mean normal walkway or walking type access, and so to exclude for example windows of the building.

Further features of the first and second building sections of the fifteenth and sixteenth aspects of the invention may be derived from the text set out elsewhere in this document, including from the text set out above relating to the hybrid residential building of the first aspect.

According to a seventeenth aspect of the present invention, there is provided a first building section of a hybrid residential building, in which the first building section is an on-site construction configured to be connected with or to a second building section of the building transported to a final location for the building in a substantially assembled form, and in which the first building section comprises a lower storey defining an internal volume that provides a lower living space within the building, and an upper storey defining an internal volume that provides an upper living space within the building: and optionally in which the first building section is configured, in use:

- so that access between the upper and lower living spaces within the first building section is prevented;
- or so that access between the internal volumes of the upper and lower storeys of the first building section within the first building section is prevented;
- or so that the internal volume defined by the upper storey is out of communication with the internal volume defined by the lower storey.

According to an eighteenth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use:

- to provide access between an upper living space provided by an internal volume of an upper storey of the first building section and a lower living space provided by an internal volume of a lower storey of the first building section;
- or so that access between internal volumes of upper and lower storeys of the first building section is provided through the second building section;
- or so that its internal volume communicates with both an internal volume defined by an upper storey of the first building section, and an internal volume defined by a lower storey of the first building section, to thereby connect the internal volumes of the upper and lower storeys.

The second building section may provide a living space within the building. The second building section may comprise one or more of: a main doorway, which may provide a main accessway into the first building section (and so the building); a stairs/staircase, which may provide access between storeys of the first building section; a hallway, which may connect the main doorway with the stairs/staircase; one or more internal doorways, which may each provide access to a different room of the building, or to different areas of a single room; and a landing, which may provide an accessway from the stairs/staircase to one or more doorways/rooms (or different areas of a single room), and/or between the rooms themselves (or different areas of a room).

Further features of the first and second building sections of the seventeenth and eighteenth aspects of the invention may be derived from the text set out elsewhere in this document, including from the text set out above relating to the hybrid residential building of the third aspect.

According to a nineteenth aspect of the present invention, there is provided a first building section of a hybrid residential building, in which the first building section is an on-site construction configured to be connected with or to a second building section of the building transported to a final location for the building in a substantially assembled form, and in which the first building section defines an internal volume that provides a living space within the building: and optionally in which the first building section is configured, in use (following connection to the second building section):

- so that it does not provide a complete access route between its internal volume and an exterior of the building;
- or so that direct access between an exterior of the building and its internal volume is prevented.

According to a twentieth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use:

- to provide an access route between an exterior of the building and the first building section;
- or so that access between an exterior of the building and the first building section is provided through the second building section;
- or so that its internal volume communicates both with an exterior of the building and an internal volume of the first building section, to thereby connect the internal volume of the first building section with the building exterior.

The second building section may provide a living space within the building. The second building section may comprise one or more of: a main doorway, which may provide a main accessway into the first building section (and so the building); a stairs/staircase, which may provide access between storeys of the first building section; a hallway, which may connect the main doorway with the stairs/staircase; one or more internal doorways, which may each provide access to a different room of the building, or to different areas of a single room; and a landing, which may provide an accessway from the stairs/staircase to one or more doorways/rooms (or different areas of a single room), and/or between the rooms themselves (or different areas of a room).

The first building section may not provide a complete access route either in that: it only forms part of an access route and requires connection of the second building section in order to complete the route; or in that no part of an access route is provided by the first building section.

Further features of the first and second building sections of the nineteenth and twentieth aspects of the invention may be derived from the text set out elsewhere in this document, including from the text set out above relating to the hybrid residential building of the fifth aspect.

According to a twenty-first aspect of the present invention, there is provided a first building section of a hybrid residential building, in which the first building section is an on-site construction configured to be connected with or to a second building section of the building transported to a final location for the building in a substantially assembled form, and in which the first building section comprises an internal volume that provides a first living space within the building and at least one further living space, the first living space and the at least one further living space optionally being isolated from one another within the first building section; and optionally in which the first building section is configured, in use:

so that it does not provide a complete access route between the first living space and the at least one further living space within the first building section;

or so that access between the first living space and the at least one further living space solely within the first building section is prevented;

or so that the first living space is out of communication with the at least one further living space.

The first building section may not provide a complete access route either in that: it only forms part of an access route and requires connection of the second building section in order to complete the route; or in that no part of an access route is provided by the first building section.

The first and further living spaces may be out of communication (prior to connection of the second building section) in that it may not be possible to transit from one of the living spaces to the other within the first building section, i.e. without stepping out of the first building section.

According to a twenty-second aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use:

to provide access between a first living space and at least one further living space of the first building section when the first and second building sections are connected;

so that access between a first living space and at least one further living space of the first building section is provided through the second building section;

or so that its internal volume communicates with both a first living space of the first building section and at least one further living space of the first building section, to thereby connect said living spaces.

The second building section may provide a living space within the building. The second building section may comprise one or more of: a main doorway, which may provide a main accessway into the first building section (and so the building); a stairs/staircase, which may provide access between storeys of the first building section; a hallway, which may connect the main doorway with the stairs/staircase; one or more internal doorways, which may each provide access to a different room of the building, or to different areas of a single room; and a landing, which may provide an accessway from the stairs/staircase to one or more doorways/rooms (or different areas of a single room), and/or between the rooms themselves (or different areas of a room).

The first and further living spaces may be provided in a common storey, and/or at a common level, within the first building section.

Further features of the first and second building sections of the twenty-first and twenty-second aspects of the invention may be derived from the text set out elsewhere in this document, including from the text set out above relating to the hybrid residential building of the seventh aspect.

According to a twenty-third aspect of the present invention, there is provided a first building section of a hybrid residential building, in which the first building section is an on-site construction configured to be connected with or to a second building section of the building transported to a final location for the building in a substantially assembled form, and in which the first building section comprises a lower storey defining an internal volume that provides a lower living space within the building, and an upper storey defining an internal volume that provides an upper living space within the building; and optionally in which the first building section is configured so that it does not provide a circulation space for access between its upper and lower living spaces.

According to a twenty-fourth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use, to define a circulation space for the building which provides access between an upper living space provided by an internal volume of an upper storey of the first building section and a lower living space provided by an internal volume of a lower storey of the first building section.

Further features of the first and second building sections of the twenty-third and twenty-fourth aspects of the invention may be derived from the text set out elsewhere in this document, including from the text set out above relating to the hybrid residential building of the ninth aspect.

According to a twenty-fifth aspect of the present invention, there is provided a first building section of a hybrid residential building, in which the first building section is an on-site construction configured to be connected with or to a second building section of the building transported to a final location for the building in a substantially assembled form, and in which the first building section defines an internal volume that provides a living space within the building: and optionally in which the first building section is configured, in use:

so that it does not comprise a circulation space providing a complete access route between its internal volume and an exterior of the building;

or so that it does not comprise a circulation space providing direct access between an exterior of the building and its internal volume.

According to a twenty-sixth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use:

to define a circulation space for the building, to provide an access route between an exterior of the building and the first building section;

or to define a circulation space for the building, which provides access between an exterior of the building and the first building section;

or to define a circulation space for the building, which communicates both with an exterior of the building and an internal volume of the first building section, to thereby connect the internal volume of the first building section with the building exterior.

Further features of the first and second building sections of the twenty-fifth and twenty-sixth aspects of the invention may be derived from the text set out elsewhere in this document, including from the text set out above relating to the hybrid residential building of the eleventh aspect.

According to a twenty-seventh aspect of the present invention, there is provided a first building section of a hybrid residential building, in which the first building section is an on-site construction configured to be connected with or to a second building section of the building transported to a final location for the building in a substantially assembled form, and in which the first building section comprises an internal volume that provides a first living space within the building and at least one further living space, the first living space and the at least one further living space optionally being isolated from one another within the first building section; and optionally in which the first building section is configured, in use:

so that it does not comprise a circulation space providing a complete access route between the first living space and the at least one further living space within the first building section;

or so that it does not comprise a circulation space providing direct access between the first living space and the at least one further living space within the first building section.

According to a twenty-eighth aspect of the present invention, there is provided a second building section of a hybrid residential building, in which the second building section is transportable to a final location for the building in a substantially assembled form and configured to be connected with or to a first building section of the building which is an on-site construction, the second building section comprising an internal volume; and optionally in which the second building section is configured, in use:

to define a circulation space for the building, to provide an access route between a first living space and at least one further living space of the first building section;

or to define a circulation space for the building which provides access between a first living space and at least one further living space of the first building section;

or to define a circulation space for the building which communicates both with a first living space and at least one further living space of the first building section, to thereby connect the living spaces.

Further features of the first and second building sections of the twenty-seventh and twenty-eighth aspects of the invention may be derived from the text set out elsewhere in this document, including from the text set out above relating to the hybrid residential building of the thirteenth aspect.

According to a twenty-ninth aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with a lower storey defining an internal volume that provides a lower living space within the building, and an upper storey defining an internal volume that provides an upper living space within the building;

in which the step of constructing the second building section comprises providing the second building section with an internal volume;

and optionally in which the method comprises the further step of arranging the first and second building sections so that an access route between the upper and lower living spaces of the first building section passes through the second building section.

The method may comprise arranging the first and second building sections so that the access route passes from the internal volume of one of the upper and lower storeys of the first building section, into the internal volume of the second building section, and from the internal volume of the second building section to the other one of the internal volumes of the upper and lower storeys.

According to a thirtieth aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with a lower storey defining an internal volume that provides a lower living space within the building, and an upper storey defining an internal volume that provides an upper living space within the building, the internal volume of the lower storey optionally being isolated from the internal volume of the upper storey;

in which the step of constructing the second building section comprises providing the second building section with an internal volume;

and optionally in which the method comprises the further step of:

arranging the second building section so that it provides access between the internal volumes of the upper and lower storeys of the first building section when the first and second building sections are connected;

or arranging the first and second building sections so that access between the internal volumes of the upper and lower storeys of the first building section is provided through the second building section;

or arranging the second building section so that its internal volume communicates with both the internal volume defined by the upper storey of the first building section, and the internal volume defined by the lower storey of the first building section, to thereby connect the internal volumes of the upper and lower storeys.

According to a thirty-first aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with an internal volume that provides a living space within the building;

in which the step of constructing the second building section comprises providing the second building section with an internal volume;

and optionally in which the method comprises the further step of:

arranging the second building section so that it provides an access route between an exterior of the building and the first building section;

or arranging the first and second building sections so that access between an exterior of the building and the first building section is provided through the second building section;

or arranging the second building so that its internal volume communicates both with the exterior of the building and the internal volume of the first building section, to thereby connect the internal volume of the first building section with the building exterior.

The method may comprise arranging the second building section so that the access route passes from the building exterior into the internal volume of the second building section, and from the internal volume of the second building section into the internal volume of the first building section.

According to a thirty-second aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with an internal volume that provides a first living space within the building and at least one further living space, the first living space and the at least one further living space optionally being isolated from one another within the first building section;

in which the step of constructing the second building section comprises providing the second building section with an internal volume;

and optionally in which the method comprises the further step of;

arranging the second building section so that it provides access between the first living space and the at least one further living space of the first building section when the first and second building sections are connected;

or arranging the first and second building sections so that access between the first living space and the at least one further living space of the first building section is provided through the second building section;

or arranging the second building section so that its internal volume communicates with both the first living space of the first building section and the at least one further living space of the first building section, to thereby connect said living spaces.

According to a thirty-third aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with a lower storey defining an internal volume that provides a lower living space within the building, and an upper storey defining an internal volume that provides an upper living space within the building;

in which the step of constructing the second building section comprises providing the second building section with an internal volume;

and optionally in which the method comprises the further step of arranging the second building section so that it defines a circulation space for the building, access between the upper and lower living spaces of the first building section being provided via the circulation space.

According to a thirty-fourth aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with an internal volume that provides a living space within the building;

in which the step of constructing the second building section comprises providing the second building section with an internal volume;

and optionally in which the method comprises the further step of;

arranging the second building section so that it defines a circulation space for the building which provides an access route between an exterior of the building and the first building section;

or arranging the second building section so that it defines a circulation space for the building which provides access between an exterior of the building and the first building section;

or arranging the second building section so that it defines a circulation space for the building which communicates both with the exterior of the building and the internal volume of the first building section, to thereby connect the internal volume of the first building section with the building exterior.

According to a thirty-fifth aspect of the present invention, there is provided a method of constructing a hybrid residential building comprising the steps of:

constructing a first building section at a final location for the building;

at a location away from the final location, constructing a second building section to a substantially assembled form;

transporting the second building section to the final location in the substantially assembled form; and connecting the first and second building sections to form the building;

in which the step of constructing the first building section comprises providing the first building section with an internal volume that provides a first living space within the building and at least one further living space, the first living space and the at least one further living space optionally being isolated from one another within the first building section;

in which the step of constructing the second building section comprises providing the second building section with an internal volume;

and optionally in which the method comprises the further step of;

arranging the second building section so that it defines a circulation space for the building which provides an access route between the first living space and the at least one further living space of the first building section;

or arranging the second building section so that it defines a circulation space for the building which provides access between the first living space and the at least one further living space of the first building section;

or arranging the second building section so that it defines a circulation space for the building which communicates both with the first living space and the at least one further living space of the first building section, to thereby connect the living spaces.

Optional further features of the methods set out in the twenty-ninth to thirty-fifth aspects of the invention are as follows.

The step of constructing the second building section may comprise arranging its internal volume so that it provides a further living space within the building.

The method may comprise constructing the first building section at the final location, and then connecting the second building section to the first building section. The second building section may be transported to the final location following construction of the first building section (or optionally following commencement of its construction, but prior to its completion).

Alternatively, the method may comprise transporting the second building to the final location, and then constructing the first building section and connecting it to the second building section. The second building section may be located on or in the final location prior to construction of the first building section. The first building section may be connected to the second building section during the construction process. The method may comprise building the first building section on or from the second building section, for example using the second building section as a support or platform.

The second building section may be constructed away from a site which forms the final location for the building, for example in a factory or facility that is distanced from the site, and which may be accessible by road and/or rail from the site. Alternatively, the second building section may be constructed in a factory or facility provided on or as part of a (larger) building site, away from a plot on the building site which may form the final location.

The step of connecting the building sections may comprise releasably connecting the second building section to the first building section. The method may comprise subsequently disconnecting the second building section from the first building section; transporting the second building section to a maintenance facility and performing maintenance on the second building section; and then transporting the second building section back to the final location and reconnecting it to the first building section. Alternatively, the method may comprise subsequently disconnecting the second building section from the first building section: transporting a further second building section (which may form a third building section) to the final location in a substantially assembled form; and connecting the further second building section to the first building section. The transport step may be carried out before or after the disconnection step. The third building section may have similar features to the second.

The step of constructing the first building section may comprise forming the first building section of: a blockwork/masonry construction; a timber frame and blockwork/masonry construction; a timber frame and cladding construction; a metal frame construction (optionally comprising panels connected to the frame e.g. structural insulated 'SIP' panels); a time-setting 3D printed construction; or combinations thereof.

The step of constructing the second building section may comprise providing the second building section with a staircase/stairs which: defines at least part of the access route; provides the required access; facilitates the internal volume relationship; or provides at least part of the relevant circulation space.

The step of constructing the second building section may comprise providing the section with one or more of a hallway and a landing, each of which may: define at least part of the access route; provide for the required access; facilitate the internal volume relationship; or provides at least part of the relevant circulation space.

The step of constructing the second building section may comprise providing the section with one or more of: a W/C, a washroom, a delivery drop-off area, a bathroom, an ensuite, a front door/doorway, a side door/doorway, and one or more window.

The step of constructing the second building section may comprise constructing a plurality of subsections or units which are configured to be fitted or coupled together to form the completed building section. The subsections may be independently transported to the final location (i.e. in a disconnected or decoupled state). The method may comprise connecting the subsections together at the final location, for example by stacking the subsections one on top of the other. The subsections may comprise a lower subsection and an upper subsection.

The method may comprise arranging the second building section so that a majority or all of the access route is defined by the second building section.

The method may comprise arranging the living space of the first building section so that it forms at least part of one or more room, which may be selected from the group comprising: a kitchen; a dining room; a living or sitting room; a bedroom; and an open plan room comprising a plurality of different usage areas.

The method may comprise arranging the first and second building sections so that at least one room is defined jointly by a living space of the first building section and a living space of the second building section.

The method may comprise configuring the first building section so that the internal volume defined by the lower storey is isolated from the internal volume defined by the upper storey.

The method may comprise configuring the second building section so that it provides access between internal volumes of upper and lower storeys of the first building section when the first and second building sections are connected. The method may comprise configuring the first and second building sections so that access between internal volumes of upper and lower storeys of the first building section is provided through the second building section.

The method may comprise configuring the second building section so that its internal volume communicates with both an internal volume defined by an upper storey of the first building section, and an internal volume defined by a lower storey of the first building section. In this way, the internal volumes of the upper and lower storeys are connected/coupled, when the building sections are connected.

The step of constructing the second building section may comprise providing at least part of a circulation space/zone (or transition space/zone) for the building within the second building section. The method may comprise configuring the circulation space to provide access into the first building section from the outside of the building. The method may comprise configuring the circulation space to provide access between upper and lower living spaces of the first building section. The circulation space may therefore define or may comprise at least part of the access route. The method may comprise arranging the circulation space so that it provides one or more of a staircase/stairs, hallway, landing, and one or more doorways. The circulation space may form a doorway into the second building section, which may provide a main access route into the first building section (and so the building). The doorway may form a main or front doorway of the building. The method may comprise configuring the first building section so that it is devoid of a main or front doorway, the doorway being provided by the second building section.

The method may comprise dividing a living space of the first building section into a first living space part and at least one further living space part. The method may comprise configuring the first living space part and the at least one further living space part so that they are isolated from one another within the first building section. The method may comprise configuring the second building section so that it provides access between the first living space part and the at least one further living space part of the first building section. This may be via the access route and/or circulation space. Where upper and lower living spaces are provided, the method may comprise dividing one or both of the living spaces into such living space parts.

The method may comprise configuring the second building section so that its internal volume communicates with both a lower living space of the first building section and an upper living space of the first building section, to thereby connect said living spaces, when the first and second building sections are connected.

The method may comprise providing the building with a ventilation system, and configuring the ventilation system: to supply external air into the building; and to withdraw internal air from the building and to discharge it to the building exterior, to thereby control ventilation of the first building section. The method may comprise configuring the ventilation system to draw external air from the exterior of the building, and to discharge the air into the internal volume of the first building section. The method may comprise configuring the ventilation system to supply external air directly or indirectly into said internal volume. The method may comprise configuring the ventilation system to supply external air into the internal volume of the second building section.

The method may comprise constructing the first building section at the final location, which may be a fixed, on-site location of the building, and configuring the first building section to receive the second building section. The method may comprise connecting the second building section to the first building section so that the second building section is received by the first building section. The method may comprise pre-configuring the first building section, during on-site construction at the final location, to receive the second building section.

The step of constructing the first building section may comprise configuring the first building section to removably receive the second building section. The second building section may be portable, in a form to be connected to and received by the first building section. The method may comprise the further step of disconnecting the second building section from the first building section, for example for replacement and/or maintenance purposes. The second building section may then be removed from the final location. The second building section may be replaced with a third building section having an internal volume that provides a further living space within the building. The third building section may be transported to the final location in a substantially assembled form. The first and third building sections may be connected at the site to form the building. The method may comprise arranging the third building section in the same way as the second building section. In a variation, the method may comprise performing maintenance on the second building section, suitably off-site, and subsequently reconnecting the second building section to the first building section.

The step of constructing the first building section may comprise providing the first building section with one or more open faces, and configuring it to removably receive or connect to the second building section at the one or more open faces. The method may comprise docking the second building section with or to the first building section to close the one or more open faces.

The step of constructing the second building section may comprise providing the second building section with one or more external walls, and connecting it to the first building section to provide the one or more external walls as one or more internal walls of the first building section. The method may comprise arranging one or more external walls of the second building section to form a separating wall between the second building section and the first building section.

The method may comprise servicing the building with one or more services via the second building section. The one or more services may be received by the second building section from external to one or more of the first building section, second building section and building. The method may comprise providing the building, optionally the first building section, with a services hub. The method may comprise servicing the second building section with one or more services via the services hub.

The step of constructing the first building section may comprise forming the section as a free-standing and/or self-supporting structure. Connecting the second building section with or to the first building section may provide additional support to the first building section.

The step of constructing the second building section may comprise providing the second building section with a metal (e.g. steel) frame support structure, optionally in a factory or facility away from the final location for the building. The step of connecting the second building section to the first building section may comprise securing one or more structural element of the first building section to the second building section, suitably to the metal frame.

Further features of the methods defined herein may be derived from the text set out elsewhere in this document, including from the text set out above relating to any one of the first to twenty-eighth aspects.

In a further aspect of the present invention, there is provided a first building section of a hybrid residential building (which may form part of any of the hybrid residential buildings defined in this document), in which the first building section is an on-site construction configured to be connected with or to a second building section of the building transported to a final location for the building in a substantially assembled form, and in which the first building section comprises a lower storey defining an internal volume that provides a lower living space within the building, and an upper storey defining an internal volume that provides an upper living space within the building: and optionally in which the constructed first building section is configured without a staircase between its upper and lower storeys, and/or without a main doorway (the second building section optionally providing the staircase and/or main doorway into the first building section, and so into the building). Further features of the first building section of this aspect may be derived from the text set out elsewhere in this document.

Further aspects and other optional features of the invention are defined in the accompanying claims, or can be derived from the text set out elsewhere in this document. These include claims directed to a hybrid residential building/system comprising: a ventilation system; a substantially air-tight seal at an interface between building sections: a second building section which defines a proportion of a total internal volume and/or an external surface area of the building; and a first building section having first and second non-parallel portions, the second building section being connected to both portions; as well as first and second building sections of such buildings and associated methods. Further features of such buildings, systems, building sections and methods may be derived from the text set out elsewhere in this document, particularly from dependent claims directed to buildings.

Embodiments of the present invention will now be described, by way of example only, with reference to the accompanying drawings, in which.

Figure 1:
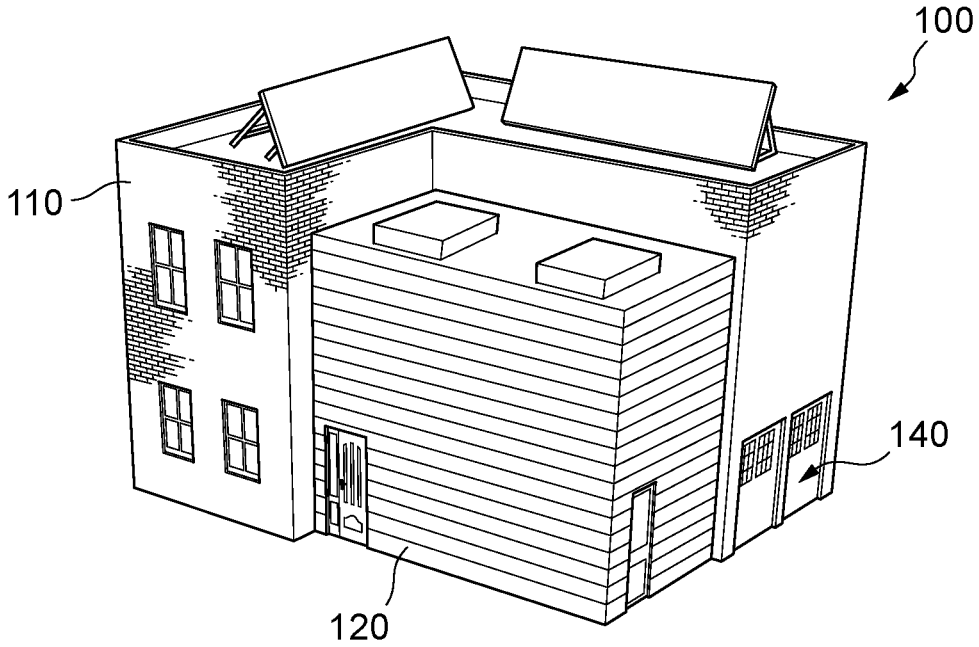
FIG. 1 is a perspective view of a hybrid residential building according to an embodiment of the invention.
Figure 2:
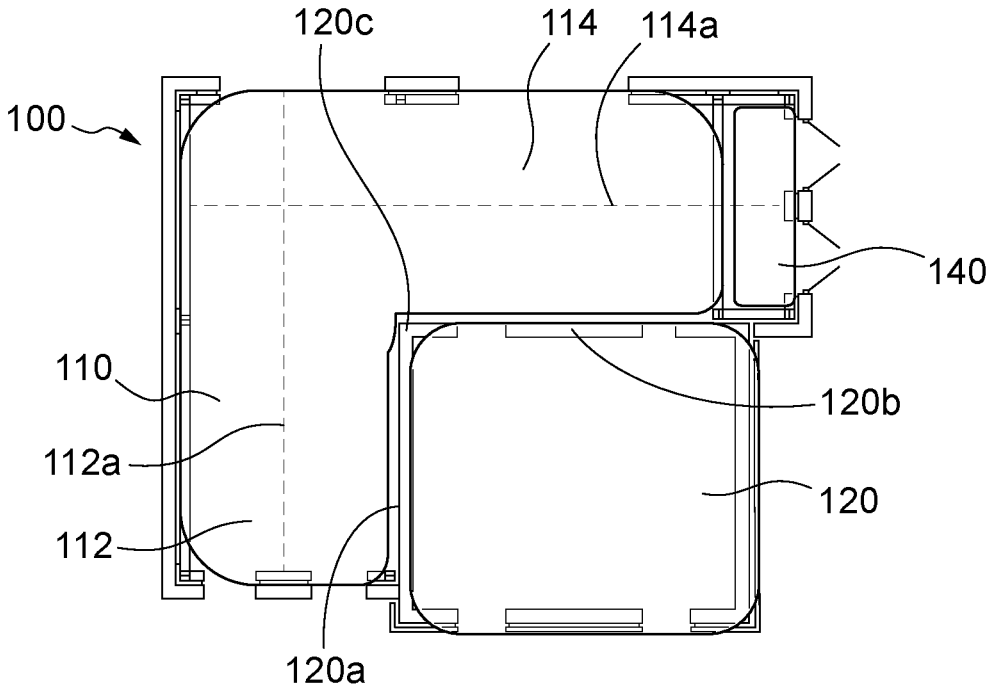
FIG. 2 is a plan cross-sectional view of the building shown in FIG. 1.
Figure 3:
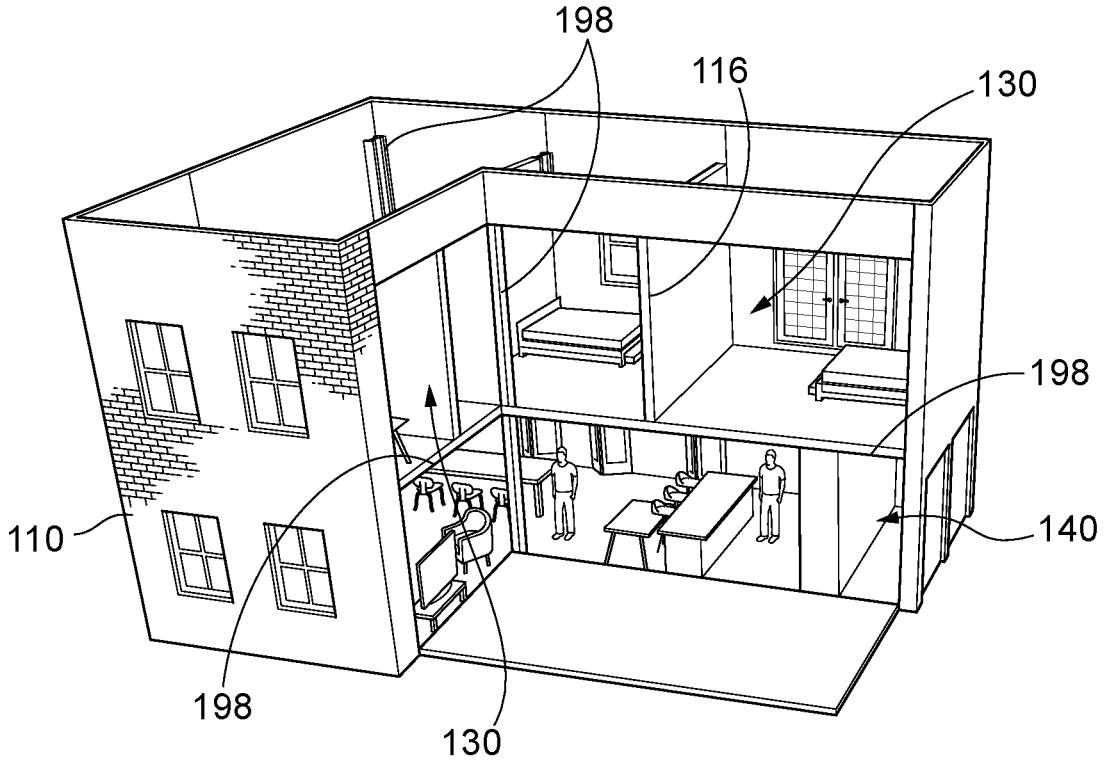
FIG. 3 is a cut-away perspective view of a first building section of the building shown in FIG. 1, with a second building section of the building removed.

Referring firstly to FIGS. 1 to 3, a hybrid building 100 (which may also be referred to as a modular building) is shown which comprises a first building section 110 and a second building section 120. In this exemplary embodiment, the building 100 is a residential building, or a domestic dwelling, for example a detached house.

The first building section 110 can take the form of a dock, reference to which may be made throughout this document. The term "dock" is used to describe a building section to which another building section may be docked, installed, connected, or attached. The first building section 110 is an on-site construction at a final location of the building 100, which may be a fixed, on-site location. That is, the building 100 has a final, fixed, on-site location. In this exemplary embodiment, said final, fixed, on-site location is determined by construction plans and fixed by virtue of building foundations. The term "on-site location" is used to refer to the building site, which will be understood to refer to the immediate proximity of the building 100 and the entire building site, including housing estate, on which the building 100 is to be built. It will be understood that the site may be a large building/construction site comprising a plurality of plots, the final location for the building 100 being provided by one of said plots.

The second building section 120 can take the form of a module, reference to which may be made throughout this document. The term "module" is used to describe a building section which is dockable, installable, connectable, or attachable to another building section, particularly a first building section in the form of a dock. The second building section 120 is transportable to the final location in a substantially assembled form.

In the illustrated embodiment, the first building section 110 is configured to receive the second building section 120. The second building section 120 is connected to and received by the first building section 110. The second building section 120 is connected to the first building section 110 at the final location of the building 100, thereby to provide said building 100 at the final, fixed, on-site location.

During construction of the first building section 110 at the on-site location, the first building section 110 is preconfigured to receive the second building section 120. That is, the first building section 110 is constructed with the knowledge and design that a second building section is to be subsequently connected, and the first building section 110 is thus preconfigured for connection and receipt of the second building section. This could relate to the shaping of the first building section 110, through to sealing and connection features.

The first building section 110, in the illustrated embodiment, is configured to removably receive the second building section 120. That is, the first building section 110 is configured to receive the second building section 120 in a receivable manner such that the second building section 120 can be removed, if and when desired, to facilitate replacement and/or modification of the second building section 120. The second building section 120 is portable, in a form to be connected to and received by the first building section 110. That is, the second building section 120 can be formed in a single piece, or as a structural whole, so that it can be transported to the first building section 110 in a constructed or substantially constructed form, to be connected to the first building section.

The first building section 110 is configured to receive the second building section 120, so that the first and second building sections may be connected. The first building section 110 and the second building section 120 may be provided with male-female structures, for facilitating the connection, or guiding the connection. This might also facilitate an at least partial sealing of or between the second building section 120 and the first building section 110. In another example, the first building section 110 might closely abut against the second building section 120, and there may be no male-female structures. This might also facilitate an at least partial sealing of or between the second building section 120 and the first building section 110.

As best shown in FIG. 2, the first building section 110 has first and second portions 112 and 114 which together define the first building section, and which are connected so that the first and second portions are disposed at a non-parallel angle relative to one another. The first and second portions 112 and 114 are substantially elongate, and have respective main axes 112*a* and 114*a*. The first and second portions 112 and 114 are arranged so that the first portion main axis 112*a* is disposed at a non-parallel angle relative to the second portion main axis 114*a*. Also and as shown, the second building section 120 is connected to both of the first and second portions 112, 114. The illustrated first building section 110 has a substantially L-shaped cross-section in plan view, the first and second axes 112*a* and 114*a* being disposed substantially perpendicular to one another.

Another way of describing this is that the first building section 110 has an L-shaped cross section, having two elongate regions 112, 114 perpendicularly connected and the second building section 120 is connected to both elongate regions 112, 114 of the L-shaped cross-section.

The second building section 120 comprises first and second external walls 120*a* and 120*b* disposed adjacent one another, and which together form a corner 120*c* of the second building section. The first and second external walls 120*a, b* are disposed at non-parallel angles relative to one another, and in the illustrated embodiment are substantially perpendicular. The first and second external walls 120*a, b* are each connected to a respective one of the first and second portions 112, 114 of the first building section 110, so that the corner 120*c* of the second building section 120 is disposed within the building 100, when the building sections are connected. The angle between the first and second portions 112, 114 of the first building section 110 is the same as the angle between the first and second external walls 120*a, b* of the second building section 120.

As best shown in FIG. 3, the first building section 110 has one or more open faces 130. In this exemplary embodiment, the module has two open faces. The first building section 110 is configured to removably receive the second building section 120 at the two open faces 130 of the dock.

Figure 4:
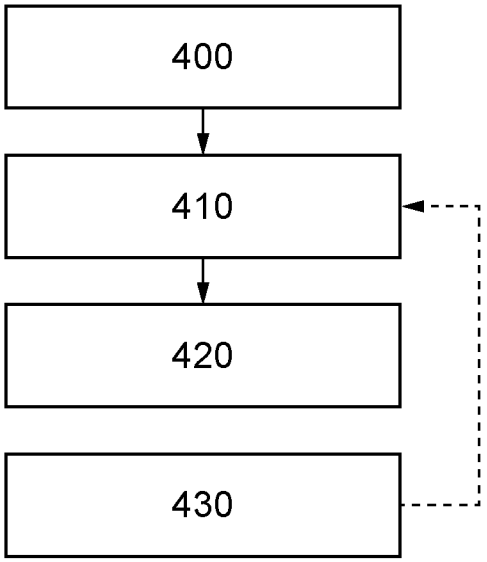
FIG. 4 illustrates general methodology principles of the invention.

Referring to FIG. 4, a method of constructing a hybrid residential building 100 is shown. Step 400 comprises forming a first building section 110 at a final (fixed, on-site) location of the building 100, the first building section 110 being configured to receive a second building section. Step 410 comprises transporting a second building section 120 from a different location to the on-site location. Step 420 comprises connecting the second building section 120 to the first building section 110 thereby to construct the building 100. The illustrated steps need not necessarily be carried out in the specified order. For example, and as will be described in more detail below, the second building section 120 could be transported to the site and positioned at the final location of the building 100, and the first building section 110 then constructed and connected to the second building section.

Optional step 430 comprises manufacturing the second building section at the different location. In one exemplary embodiment, the different location is an off-site location. In a preferred embodiment, the different location is a manufacturing factory/facility, or manufacturing building, for manufacturing the second building section to be used in constructing the building. The manufacturing facility is generally provided away from the construction of the first building section 110, and generally off-site, where there is space for a large-scale facility for manufacturing the second building sections 120. However, the manufacturing facility could be provided on or as part of such a larger building site (but distanced from a plot forming a final location for the building 100), and could be used for constructing a plurality of second building sections which are to be used in the construction of a plurality of buildings.

Figure 5:
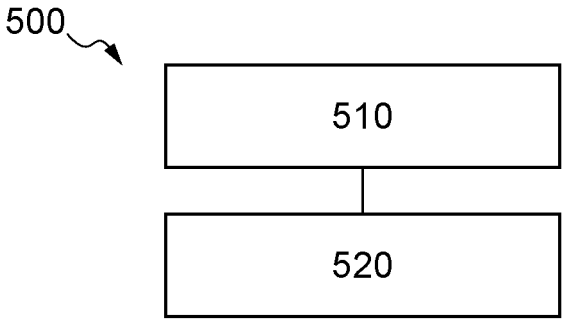
FIG. 5 illustrates a hybrid residential building system or kit according to an embodiment of the invention.

Referring to FIG. 5, a hybrid residential building system or kit 500 is shown. The building system 500 comprises a first building section 510 (which again may take the form of a dock) configured to be constructed on-site at a final location for a building 100, and which is configured to receive a second building section. The building system 500 further comprises a second building section 520 (which may take the form of a module) which is connectable to and receivable by the first building section 510. For the avoidance of doubt, the first building section 510 and second building section 520 may be the first building section 110 and second building section 120 as described above and herein in relation to the building 100.

Figure 6:
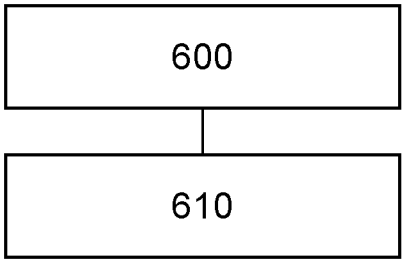
FIG. 6 illustrates further general methodology principles of the invention.

Referring to FIG. 6, a method of modifying a constructed hybrid residential building 100 is shown. The building 100 comprises a first building section 110 (which again may take the form of a dock) constructed at a final location of the building 100. The first building section 110 is configured to receive a second building section. The modular building 100 further comprises a connected second building section 120 (which may take the form of a module). The second building section 120 is removably connected to the first building section 110 in the constructed building 100. Step 600 comprises removing the second building section 120 from connection with the first building section 110. Step 610 comprises connecting a further second building section 150 to the first building section 110 thereby to modify the building 100.

Figure 7:
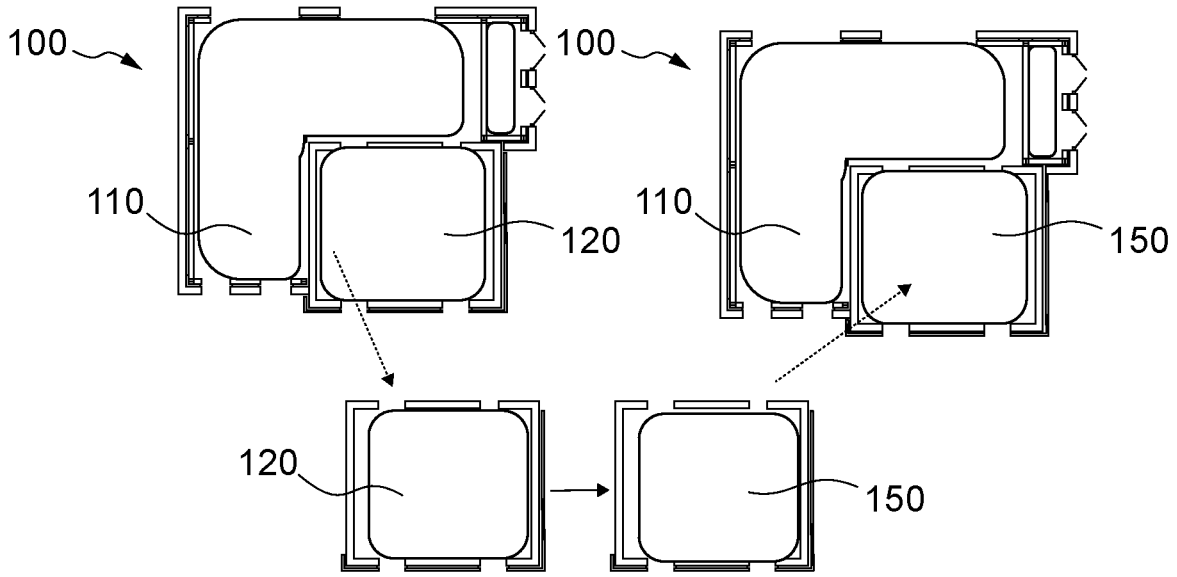
FIGS. 7 and 8 illustrate steps in methods of modifying a hybrid residential building according to embodiments of the invention.

As shown in FIG. 7, the method of modifying the building 100 comprises modifying the second building section 120 and connecting the modified building section, as the further second building section 150, to the first building section. In doing so, the second building section 120 is transported to an off-site location. The second building section 120 is moved to a module modification facility for modifying the second building section 120 to form the further second building section 150, which is to be connected to the first building section 110. The further second building section 150 is then transported back to the final (fixed, on-site location) where the building 100 is located. The second building sections 120 and 150 are both portable.

Figure 8:
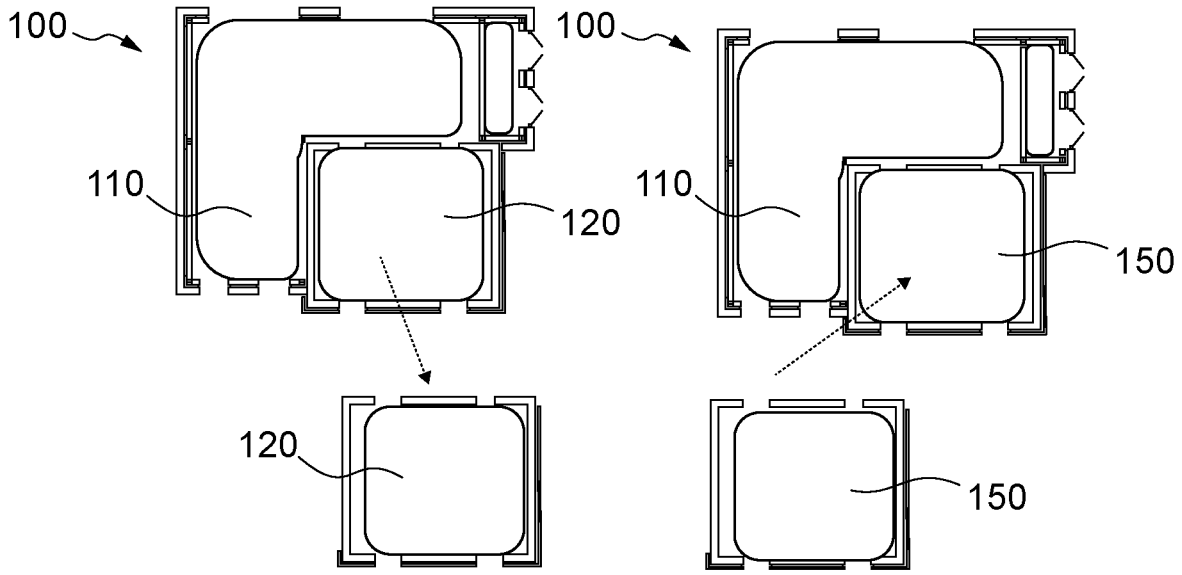

Referring to FIG. 8, in another exemplary embodiment, a further second building section 150 is manufactured without modification of the original second building section 120. That is, the further second building section 150 is manufactured independently without using or starting from the original second building section 120. The further second building section 150 has newer components than the original second building section 120. The further second building section 150 is separately constructed off-site and can be manufactured in a module manufacturing facility. The further second building section 150 is then transported from the module manufacturing facility to the location of the building 100.

The second building section 120 and/or the further second building section 150 of either embodiment (that is, where the further second building section 150 is formed from a modified original building section, or is a new second building section 150 that is different to the original building section 120) contains a staircase, W/C, washroom, delivery drop off area, hallway, bathroom, an en-suite, front doorway (and door), side doorway (and door), and windows. The skilled person will appreciate that the second building sections 120, 150 therefore comprise almost all of the important facilities and rooms of a residential building. In this way, modification of the building 100 is readily performed, by replacement of the original second building section 120 with the further second building section 150.

Figure 9:
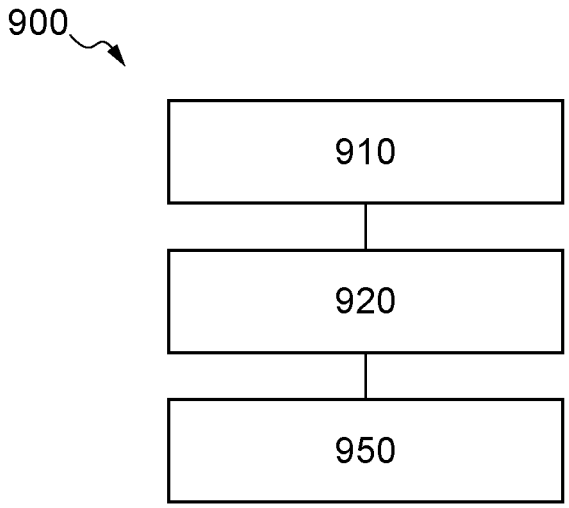
FIG. 9 illustrates another hybrid residential building system or kit according to an embodiment of the invention.

Referring to FIG. 9, another hybrid residential building system/modular building system or kit 900 is shown. The building system 900 comprises a first building section 910 (which again may take the form of a dock) configured to receive a second building section. The building system 900 further comprises a second building section 920 (which may take the form of a module). The building system further comprises a further second building section 950, which may again take the form of a module. For the avoidance of doubt, the first building section 910 and second building section 920 may be the first building section 110 and second building section 120 as described above and herein in relation to the building 100.

Figure 10:
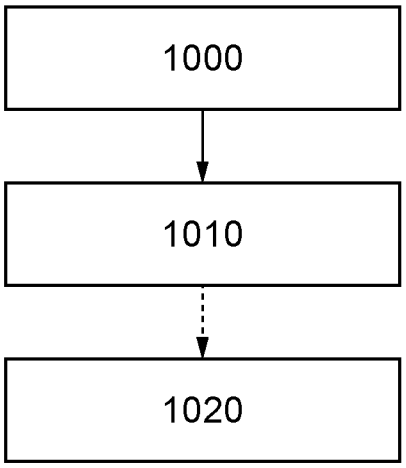
FIG. 10 illustrates further general methodology principles of the invention.

Referring to FIG. 10, a method of constructing a hybrid residential building 100 from a first building section 110 configured to receive a second building section 120 is shown. Step 1000 comprises providing a second building section 120, the second building section 120 having one or more external walls. Step 1010 comprises connecting the second building section 120 to the first building section 110 thereby to provide the one or more external walls of the second building section 120 as one or more internal walls of the first building section 110. That is, the second building section 120 is connected to the first building section 110 so that the external walls of the second building section 120 are provided as internal walls of the building 100.

Connecting the second building section 120 to the first building section 110 provides the one or more external walls of the second building section 120 as one or more separating walls between the second building section 120 and the first building section 110. The separating walls provide a fire break between the second building section 120 and the first building section 110. That is, the separating walls may be fire-resistant, or fire-proof, walls. The one or more external walls of the second building section 120 provide all walkway exits from the first building section 110. That is, the external walls of the second building section 120 comprise doors and other walkway openings from the first building section 110 to the second building section 120, and furthermore to outside the building 100 (and so to the building exterior).

In this exemplary embodiment, the first building section 110 has one or more open faces. Step 1020 comprises docking the second building section 120 to the first building section 110 to close the one or more open faces and thereby construct the building 100. Connecting the second building section 120 to the first building section 110 to provide the one or more internal walls of the first building section 110 closes internal building volumes provided within the first and second building sections 110 and 120.

In the illustrated embodiment, the second building section 120 and the first building section 110 are each self-supporting. That is, the second building section 120 and the first building section 110 are constructible independently as separate building section structures. The first building section 110 comprises external walls comprising a support structure for supporting the building section, and one or more internal walls. When the second building section 120 is connected to the first building section 110, the one or more external walls of the second building section 120 provide structural support to the first building section 110. Each of the second building section 120 and first building section 110 comprise a metal (typically steel) frame support structure, which is provided in the external walls of the second building section 120 and the first building section 110. Parts of the steel frame support structure of the first building section 110 are shown in FIG. 3 and indicated by reference numeral 198. The steel frame support structure comprises structural elements including e.g. beams and columns, which are typically hot-formed (e.g. hot rolled) and may for example be I-beams. The first building section 110 also comprises one or more relocatable (i.e. moveable) and removable internal walls. Said internal walls are absent the steel frame support structure.

The metal frame structure of the first and/or second building sections may comprise hot-formed (e.g. hot rolled) structural elements. This may be beneficial as such hot-formed structural elements can span reasonably large distances, which can facilitate the formation of apertures (e.g. doorways) at perimeters of the building sections.

Referring back to FIGS. 1 to 3, a hybrid residential building 100 comprises a first building section 110 (which again may take the form of a dock) and a second building section 120 (which may take the form of a module). The second building section 120 has one or more external walls and is connected to the first building section 110 thereby to provide one or more external walls as one or more internal walls of the first building section 110. The one or more external walls of the second building section 120 form a separating wall between the second building section 120 and the first building section 110.

Figure 11:
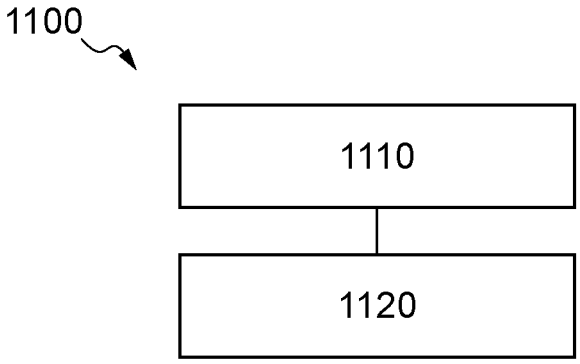
FIG. 11 illustrates a further hybrid residential building system or kit according to an embodiment of the invention.

Referring to FIG. 11, a hybrid residential building system or kit 1100 is shown. The building system 1100 comprises a first building section 1110 (which again may take the form of a dock). The building system 1100 further comprises a second building section 1120 (which may take the form of a module), the second building section 1120 having one or more external walls providable as one or more internal walls of the first building section 1110. The second building section 1120 is connectable to and receivable by the first building section 1110 to provide the external walls as one or more internal walls of the first building section. For the avoidance of doubt, the first building section 1110 and second building section 1120 may be the first building section 110 and second building section 120 as described above and herein in relation to the building 100.

Referring back to FIGS. 1 to 3, a hybrid residential building 100 comprises a first building section 110 (which again may take the form of a dock), the first building section 110 being configured to receive a second building section. A second building section 120 (which may take the form of a module) is connected to and received by the first building section 110. The building 100 is serviced with one or more services via the second building section 120. The one or more services are optionally received by the second building section 120 from external to the building 100. In this exemplary embodiment, the one or more services are water; gas; electric; telecoms and air supply.

Where the one or more services comprise an electrical power supply and telecoms, the electrical power and telecoms can be wirelessly transmitted to the first building section 110 by the second building section 120, for example using a wireless power transfer (WPT) system and Wi-Fi technology. The second building section 120 and first building section 110 comprise connectors between the building sections for facilitating the provision of services from the second building section 120 to the first building section 110. Where the one or more services comprise a water supply, all wet facilities may be provided within the second building section 120, which leads to a better arrangement of fluidic conduits and management of water flow in the building 100.

The first building section 110 comprises internal walls 116. The internal walls 116 are devoid of electrical cabling and fluidic conduits. The internal walls 116 are relocatable (i.e. moveable) and removable. As described above, said internal walls 116 are absent the steel frame support structure.

As shown in FIGS. 1 to 3, the first building section 110 further comprises a services hub 140. A services hub 140 is sometimes referred to as a "plant room", "mechanical room" or "boiler room". The second building section 120 is serviced with one or more services via the services hub 140. That is, the second building section 120 is serviced with one or more services via the services hub 140, and the building 100 is serviced with one or more services via the second building section 120. The services hub 140 is accessible externally to the building 100. In this exemplary embodiment, the services hub 140 is only accessible externally to the building 100, although options include an internal access route. The services hub 140 is thermally insulated relative to a remainder of the building, and may comprise a thermal envelope which insulates the remainder of the building from air exterior to the building. This can be achieved by insulating walls of the building defining the hub, or indeed walls of the hub itself. In another exemplary embodiment, the services hub 140 does not form part of the modular building, and may be, for example, an outbuilding.

Figure 12:
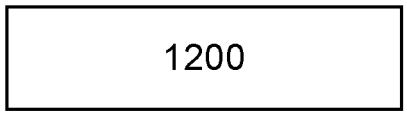
FIG. 12 illustrates further general methodology principles of the invention.

Referring to FIG. 12, a method of servicing a hybrid residential building 100 is shown. The building 100 comprises a first building section 110 (which again may take the form of a dock), the first building section 110 being configured to receive a second building section. The building 100 further comprises a second building section 120 (which may take the form of a module), which is connected to and received by the first building section 110. Step 1200 comprises servicing the building 100 with one or more services via the second building section 120.

Figure 13:
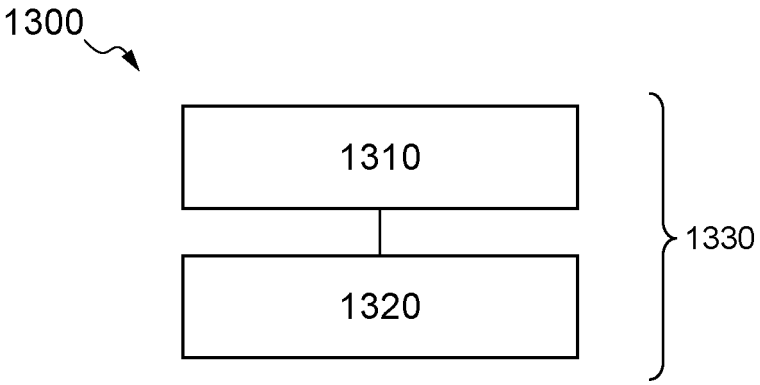
FIG. 13 illustrates another hybrid residential building system or kit according to an embodiment of the invention.

Referring to FIG. 13, a hybrid residential building system or kit 1300 is shown. The building system 1300 comprises a first building section 1310 (which again may take the form of a dock), the first building section 1310 being configured to receive a second building section. The building system 1300 further comprises a second building section 1320 (which may take the form of a module), which is connectable to and receivable by the first building section to form a hybrid residential building 1330. The building 1330 is serviceable with one or more services via the second building section 1320 when connected to the first building section 1310. For the avoidance of doubt, the first building section 1310 and second building section 1320 forming the building 1330 may be the first building section 110 and second building section 120 as described above and herein in relation to the building 100.

Referring back to FIGS. 1 to 3, a hybrid residential building 100 comprises a first building section 110 (which again may take the form of a dock) having one or more open faces 130. The building 100 further comprises a second building section 120 (which may take the form of a module) docked to the first building section 110 and closing the one or more open faces 130. In this exemplary embodiment, the first building section 110 has two open faces 130.

As described above, in the illustrated embodiment, the second building section 120 and the first building section 110 are each self-supporting. That is, the second building section 120 and the first building section 110 are constructible independently as separate building section structures. The first building section 110 comprises external walls comprising a support structure for supporting the first building section 110, and one or more internal walls. When the second building section 120 is connected to the first building section 110, the one or more external walls of the second building section 120 provide structural support to the first building section 110. Each of the second building section 120 and the first building section 110 comprise a metal (e.g. steel) frame support structure, which is provided in the external walls of the building sections. The first building section 110 comprises one or more relocatable (i.e. moveable) and removable internal walls. Said internal walls are absent the steel frame support structure.

In this exemplary embodiment, the second building section 120 extends over the open face of the first building section 110. The second building section 120 connects to the first building section structure, thereby to form the hybrid residential building 100.

Figure 14:
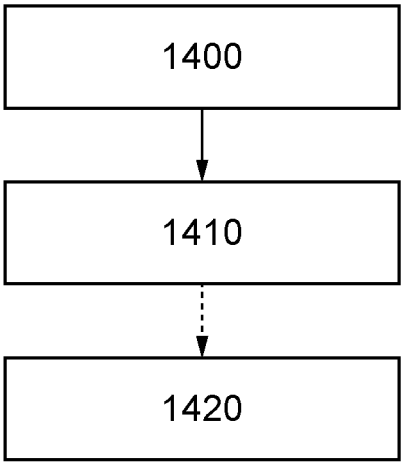
FIG. 14 illustrates further general methodology principles of the invention.

Referring to FIG. 14, a method of constructing a hybrid residential building 100 from a first building section 110 (which again may take the form of a dock) configured to receive a second building section 120, the first building section 110 having one or more open faces, is shown. Step 1400 comprises providing a second building section 120. Step 1410 comprises docking the second building section 120 to the first building section 110 to close the one or more open faces.

Docking the second building section 120 to the first building section 110 to close the one or more open faces closes internal building volumes defined within the first and second building sections. Docking the second building section 120 to the first building section 110 closes all open faces of the first building section 110. Docking the second building section 120 to the first building section 110 to close the open faces provides the external structure of the building 100 and some of the external walls of the building 100, which are provided by some of the external walls of the second building section 120.

Where the second building section 120 comprises external walls, step 1420 comprises connecting the second building section 120 to the first building section 110 thereby to provide the one or more external walls of the second building section 120 as one or more internal walls of the first building section 110.

Figure 15:
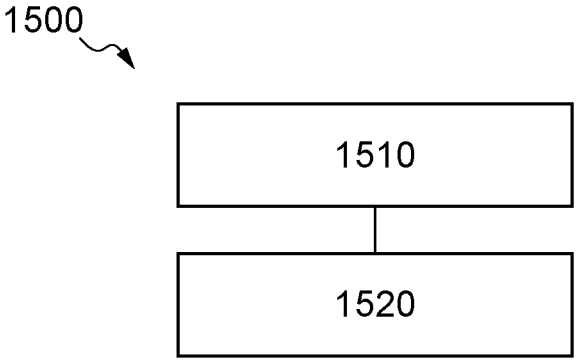
FIG. 15 illustrates another hybrid residential building system or kit according to an embodiment of the invention.

Referring to FIG. 15 a hybrid residential building system or kit 1500 is shown. The building system 1500 comprises a first building section 1510 (which again may take the form of a dock) having one or more open faces. The building system 1500 further comprises a second building section 1520 (which may take the form of a module) dockable to the first building section to close the one or more open faces of the first building section 1510. For the avoidance of doubt, the first building section 1510 and second building section 1520 may be the first building section 110 and second building section 120 as described above and herein in relation to the building 100.

The hybrid residential buildings shown in FIGS. 1 to 15 and described above can be formed by constructing the respective first building section at the final, fixed, on-site location of the building and then connecting their second building section to the dock. However, the buildings can also be formed by transporting their respective second building section to the site and positioning them at the final location, and then constructing their first building section and connecting it to the second building section.

Figure 16:
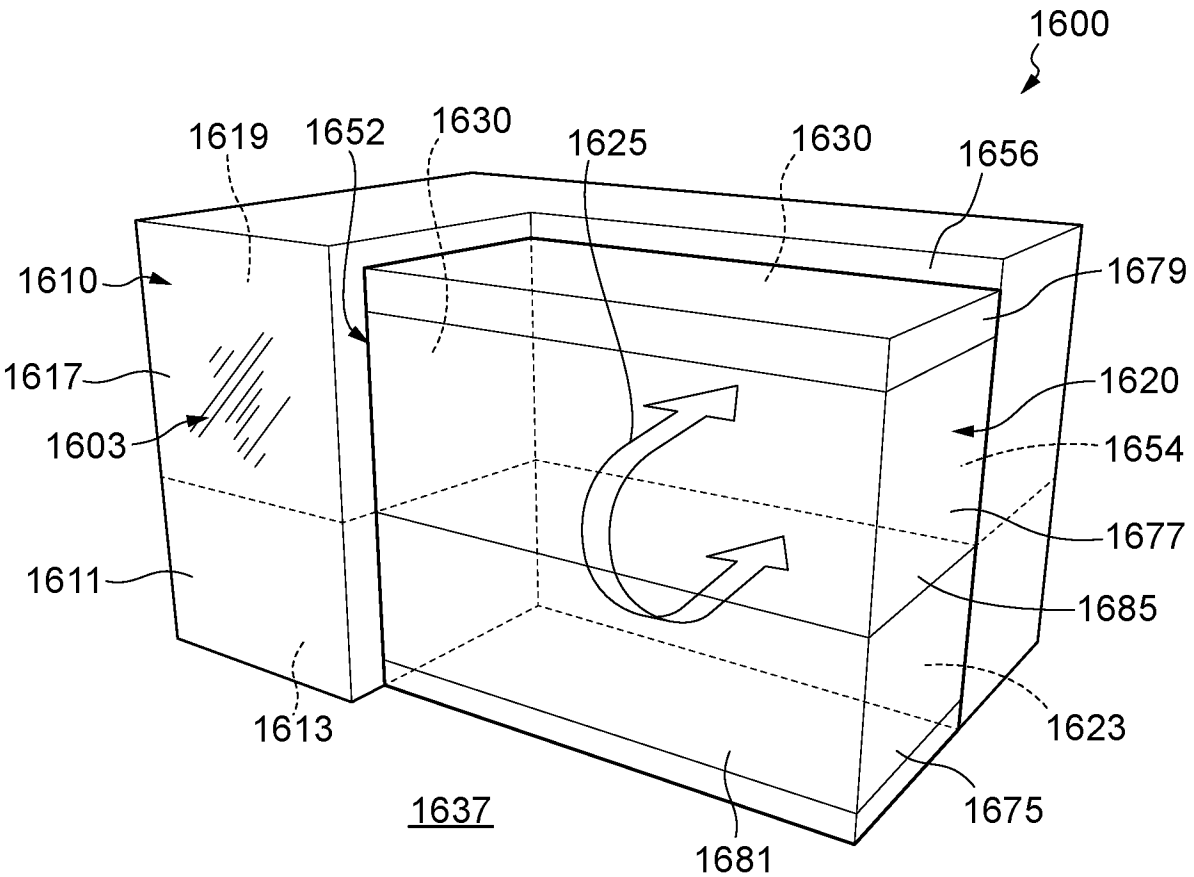
FIG. 16 is a perspective view of a hybrid residential building in accordance with another embodiment of the invention.
Figure 17:
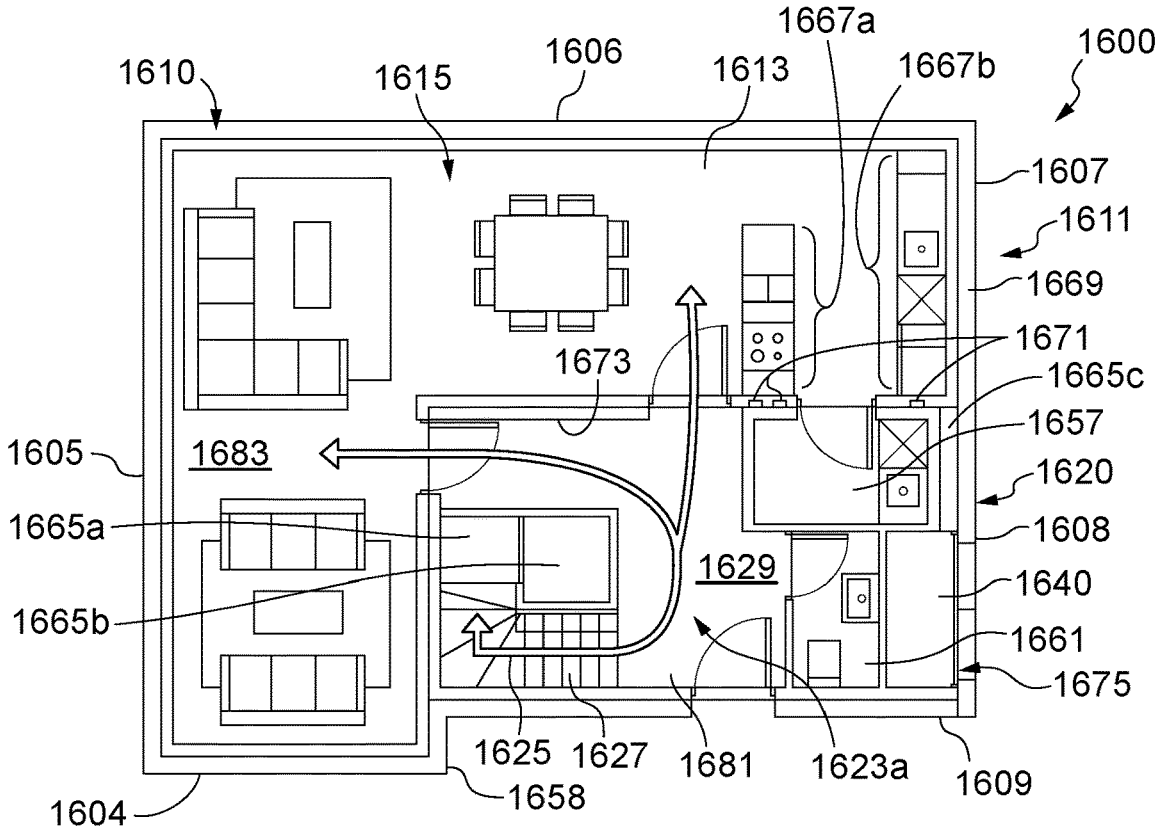
FIGS. 17 and 18 are plan cross-sectional views of the building illustrated in FIG. 16, showing lower and upper storeys respectively of the building.
Figure 18:
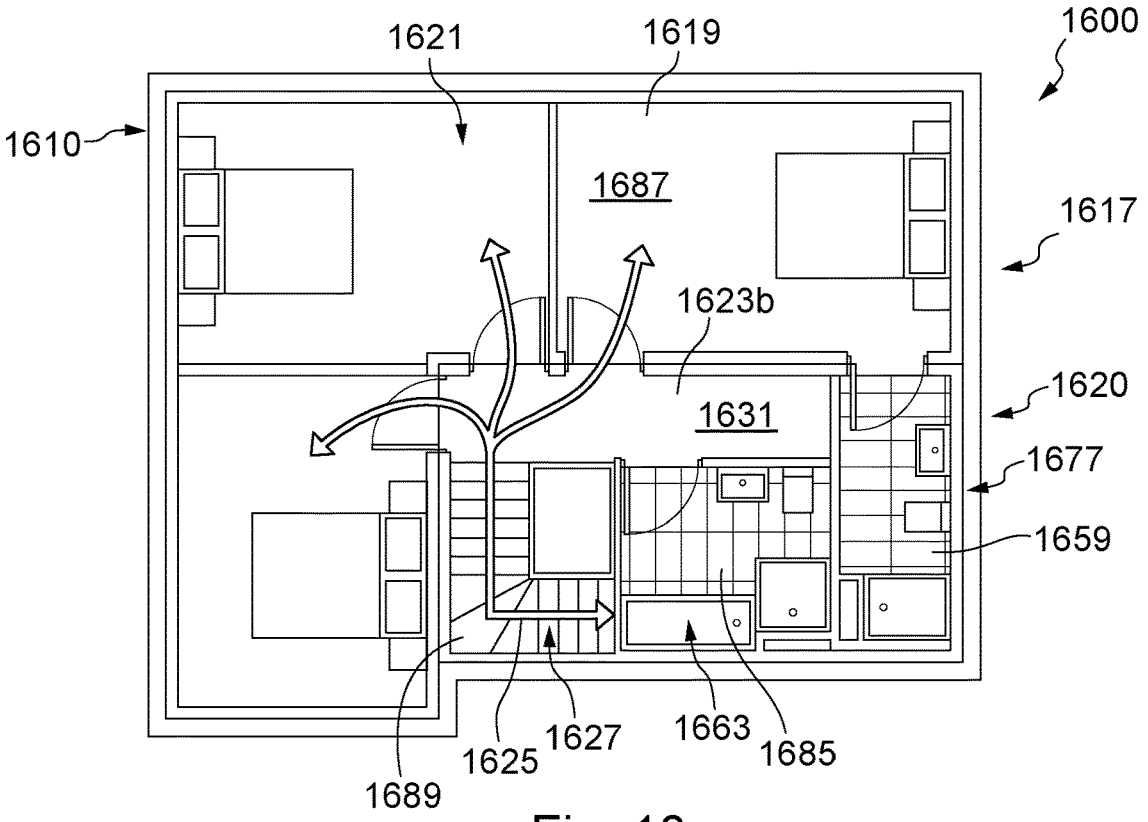

Turning now to FIG. 16, there is shown a perspective view of a hybrid residential building in accordance with another embodiment of the invention, the building indicated generally by reference numeral 1600. FIGS. 17 and 18 are also referred to, which are plan cross-sectional views showing lower and upper storeys respectively of the building 1600.

The building 1600 again takes the form of a detached house or dwelling, and comprises a first building section 1610 and a second building section 1620. The first building section 1610 is an on-site construction at a final location for the building, and comprises a lower storey 1611 defining an internal volume 1613 that provides a lower living space 1615 within the building, and an upper storey 1617 defining an internal volume 1619 that provides an upper living space 1621 within the building 1600. The second building section 1620 also defines an internal volume 1623, and is transportable to the final location (e.g. from an off-site manufacturing facility) in a substantially assembled form. The first and second building sections 1610 and 1620 are connectable at the final location to form the building 1600.

The residential building 1600 is a hybrid building in that part of the building is an on-site construction at the final location (the first building section 1610), and part is constructed separately and transported to the final location (the second building section 1620). The building 1600 is formed at the final location by connecting the first and second building sections 1610 and 1620 together. It will be understood that this definition of a hybrid residential building applies to the further buildings described elsewhere in this document, including the embodiments of FIGS. 1 to 15.

In the embodiment of FIG. 16, the first and second building sections 1610 and 1620 are configured so that an access route between the upper and lower living spaces 1621 and 1615 of the first building section 1610 passes through the second building section 1620. The access route is shown schematically in FIGS. 16 to 18, and indicated by reference numeral 1625. The access route 1625 facilitates movement between the upper and lower living spaces 1621, 1615 of the first building section 1610 by an occupant of the building. The access route 1625 passes from the internal volume of one of the upper and lower storeys 1617, 1611 of the first building section 1610, into the internal volume 1623 of the second building section 1620, and from the internal volume of the second building section to the internal volume of the other one of the upper and lower storeys of the first building section. In the illustrated embodiment, substantially the entire access route 1625 (and optionally the entire route) is defined by the second building section 1620.

The provision of an access route 1625 which passes through the second building section 1620 offers numerous advantages which are discussed elsewhere in this document. Particular advantages however include that: wear and tear occurring due to the movement of people between the upper and lower living spaces 1621 and 1615 occurs primarily in the second building section 1620 (which can be removable and replaceable); and that on-site construction of the first building section 1610 can be achieved relatively cheaply and quickly.

It will be understood that the first building section 1610 is an on-site construction in that it is constructed on the building site, at the final location for the building 1600, suitably using an arrangement of parts, components and/or materials which are provided at the site. Options include: a blockwork/masonry construction e.g. of clay bricks and/or cement blocks: a timber frame and blockwork/masonry construction; a timber frame and cladding construction; a metal frame construction (optionally comprising panels coupled to the frame e.g. structural insulated 'SIP' panels); a time-setting 3D printed construction e.g. of a cementitious material; and combinations thereof.

As discussed above, the second building section 1620 is transportable to the final location in a substantially assembled form. To enable this, it may be preferred that the second building section 1620 is constructed to a state in which: it can be transported safely to the site for connection to the first building section 1610 (i.e. it has sufficient structural integrity/rigidity for transport purposes); minimal further work is required to be carried out in order to connect the second building section 1620 to the first building section 1610; and/or minimal further work is required to complete a portion of the building 1600 formed by the second building section 1620. Such further work may be of a structural and/or weatherproofing nature, and may exclude work associated with a final fit-out of the second building section 1620, for example of a decorative nature (in particular the application of 'perishable' materials such as plaster/plasterboard, decorative panels and surface finishes such as paint). The first building section 1610 is substantially L-shaped, as discussed above. The second building section 1620 defines or forms a corner (external) of the building, when connected to the first building section 1610, and closes two open faces 1630 of the first section. The second building section 1620 also includes a corner disposed within the building 1600, when the sections 1610 and 1620 are connected, which is defined by first and second perpendicularly disposed (adjacent) external walls of the second section, which form internal walls in the assembled building.

The access route 1625 passing through the second building section 1620 is defined primarily by a staircase 1627 provided within the second building section, which is shown in the plan sectional views of FIGS. 17 and 18. The staircase 1627 passes upwardly from a ground level 1629 of the second building section 1620 to an upper floor level 1631.

As can be seen by comparing FIGS. 17 and 18, the internal volume 1613 of the first building section lower storey 1611 is isolated from the internal volume 1619 of its upper storey 1617. The internal volumes 1613 and 1619 are isolated in that they are physically out of communication with one another. As a result, access between the internal volumes 1613 and 1619 solely within the first building section 1610 is restricted, so that it is not possible to pass from one of the internal volumes to the other internal volume solely within the first building section 1610. The second building section 1620 provides access between the internal volumes of the different storeys 1611 and 1617 when the first and second building sections 1610 and 1620 are connected, the access being provided through the second building section. An occupant wishing to pass from the lower storey internal volume 1613 to the upper storey internal volume 1619 (or vice-versa) must therefore enter the second building section 1620 in order to access the staircase 1627.

The second building section 1620 is configured so that its internal volume 1623 communicates with both the internal volume 1619 defined by the upper storey 1617 of the first building section 1610, and with the internal volume 1613 defined by the lower storey 1611 of the first building section, when the first and second building sections are connected. The second building section 1620 therefore serves to connect the internal volumes 1613 and 1619 of the lower and upper storeys 1611 and 1617.

Figure 19:
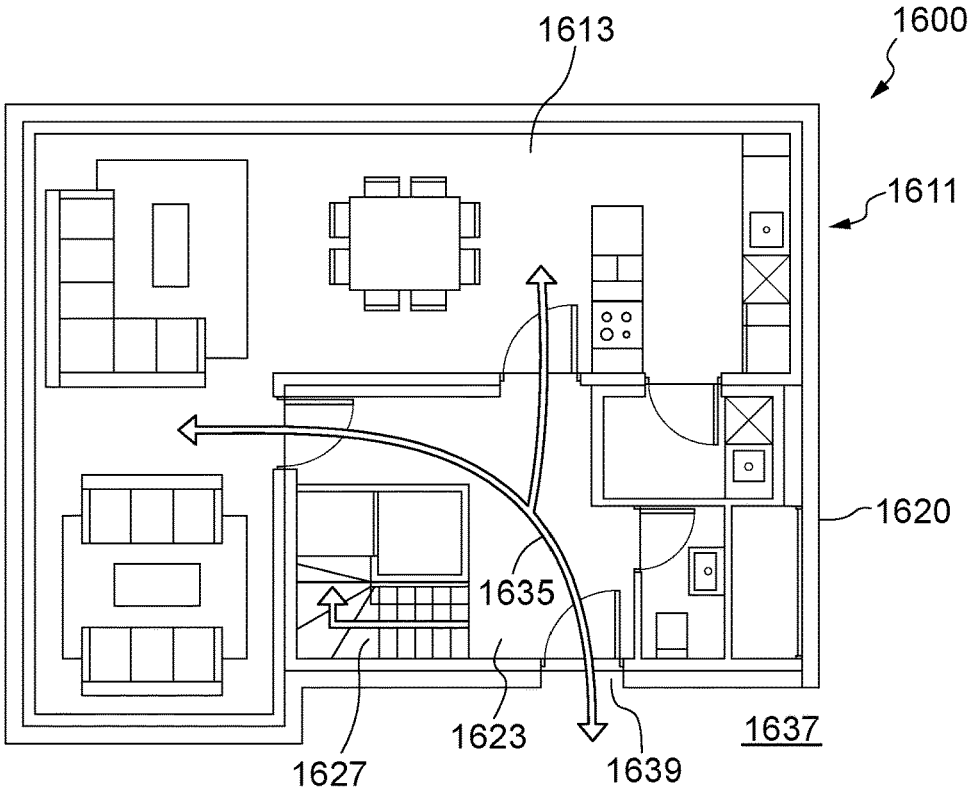
FIGS. 19 and 20 are further views of the building corresponding to those of FIGS. 17 and 18, showing other features.

The second building section 1620 is additionally configured to facilitate access between an exterior 1637 of the building 1600 and the internal volumes 1613, 1619 of the first building section 1610 (and so into the building 1600). This is best shown in FIG. 19, which is a view of the building 1600 corresponding to that of FIG. 17, and so showing its lower storey 1611. As can be seen, the second building section 1620 provides an access route 1635 between the building exterior 1637 and the lower storey internal volume 1613. The access route 1635 passes through or includes a main/front doorway 1639 for the building 1600, which is provided in the second building section 1620. Access between the building exterior 1637 and the lower storey internal volume 1613 is therefore provided through the main doorway 1639 into the second building section internal volume 1623. The second building section 1620 is configured so that its internal volume 1623 communicates both with the building exterior 1637 and the internal volume 1613 of the first building section lower storey, to thereby connect the internal volume 1613 with the exterior. The front doorway 1639 also provides access to the staircase 1627 (which is within the second building section internal volume 1623), and so to the internal volume 1613 of the upper storey 1611.

It will be understood that the principle outlined above is applicable not just to multi-storey buildings of the type shown in the drawings. Access between a building exterior and an internal volume of a building (particularly a first building section) can similarly be provided in a single storey house or dwelling, such as a bungalow.

Figure 20:
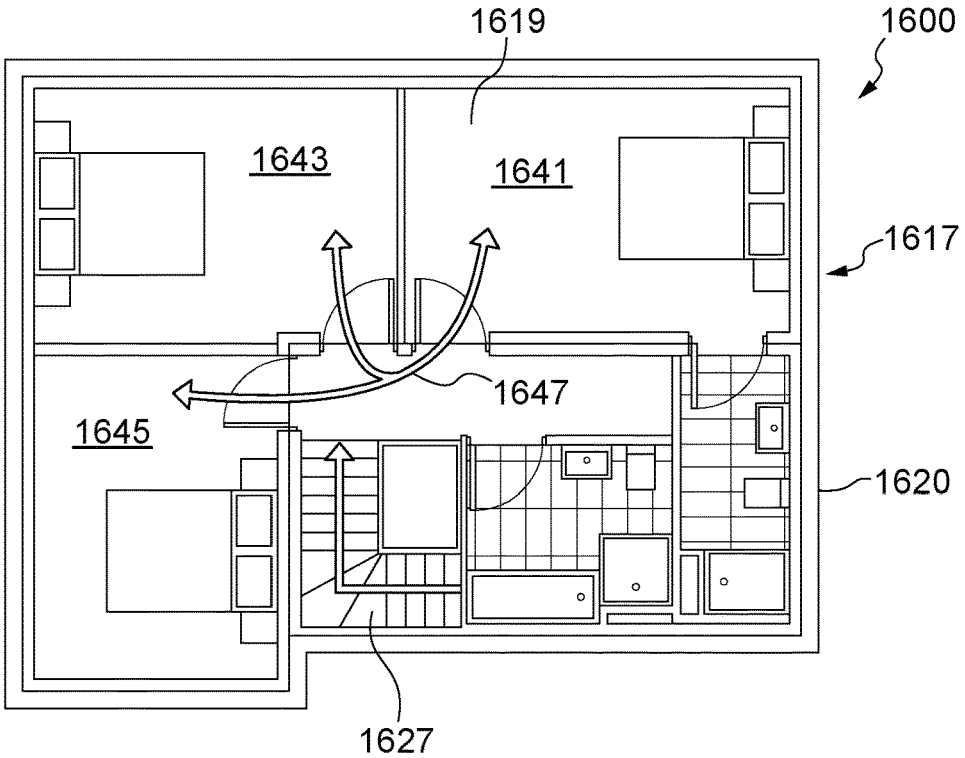

Referring now to FIG. 20, there is shown a view of the building 1600 corresponding to that of FIG. 18, and so showing its upper storey 1617. The internal volume 1619 defined by the upper storey 1617 provides a first living space 1641 within the building 1600, and at least one further living space. In the illustrated embodiment, the internal volume 1619 defines two such further living spaces, indicated by reference numerals 1643 and 1645. The first living space 1641 forms a master bedroom of the building 1600, whilst the living spaces 1643 and 1645 each form further bedrooms. These living spaces 1641 to 1645 are isolated from one another within the first building section 1610, so that access between the bedrooms cannot be achieved from solely within the first building section. In line with other embodiments, internal walls within the building 1600 can be movable and/or removable to define a desired arrangement of rooms/living spaces.

The second building section 1620 is configured to provide access between the living spaces 1641 to 1645, and so between the various bedrooms, when the first 1610 and second 1620 building sections are connected. The access between the living spaces 1641 to 1645 is provided through the second building section 1620. For example, the first and second building sections 1610 and 1620 can be configured so that an access route 1647 between the various living spaces 1641 to 1645 of the first building section 1610 passes through the second building section 1620.

The second building section is additionally configured so that its internal volume 1623 communicates with both the first living space 1641 of the first building section 1610, and with the further living spaces 1643 and 1645, when the first and second building sections are connected. In this way, the second building section 1620 serves to connect the living spaces 1641 to 1645, and so the various bedrooms.

Figure 21:
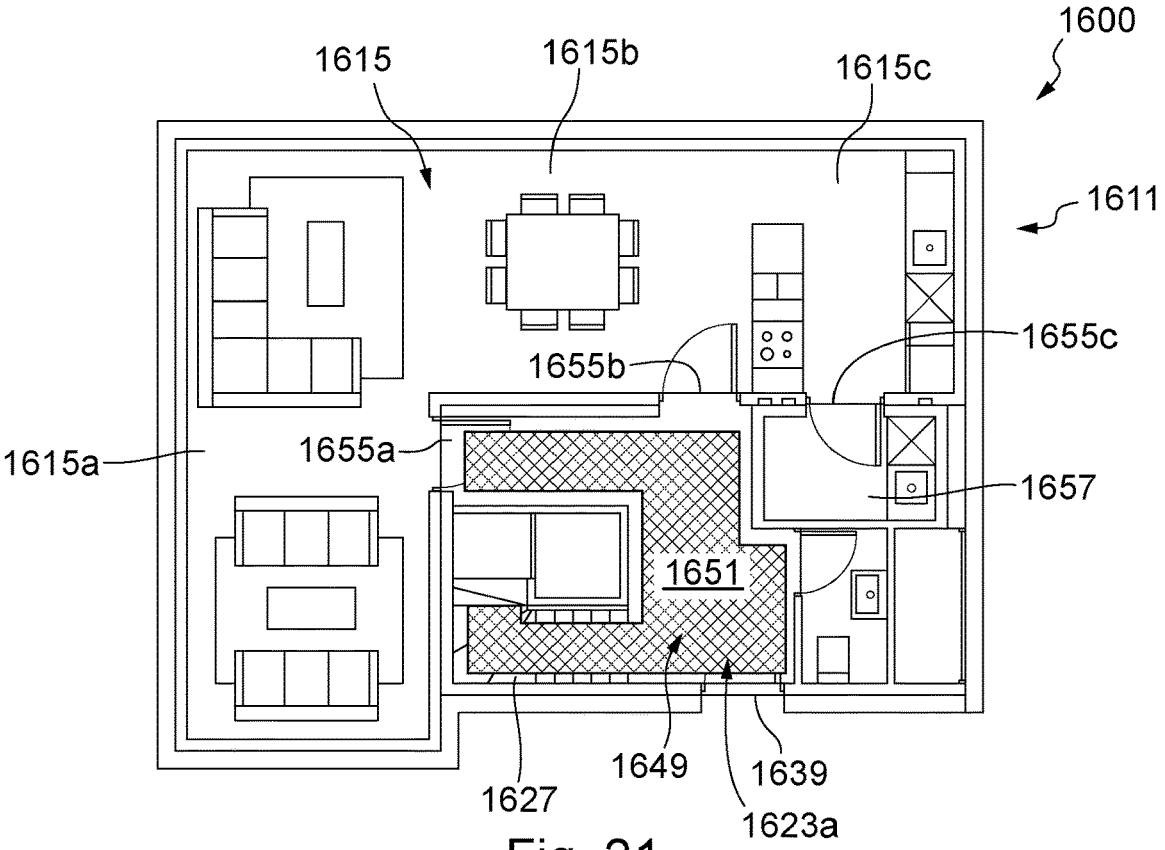
FIGS. 21 and 22 are further views of the building corresponding to those of FIGS. 17 and 18, showing other features.
Figure 22:
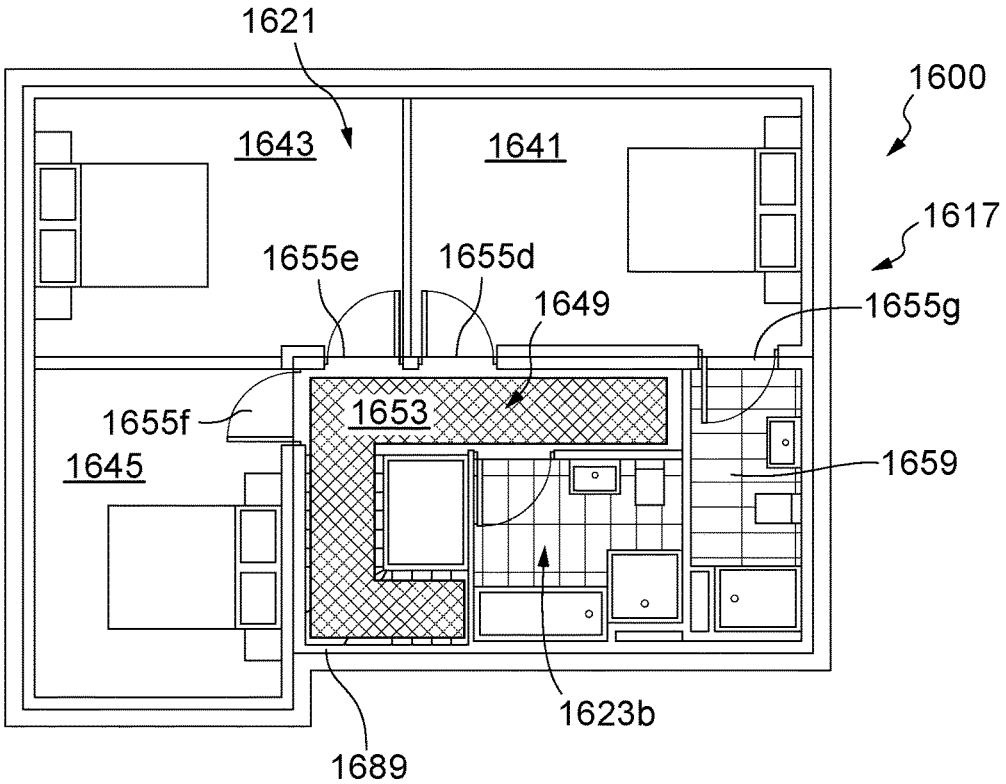

Referring now to FIGS. 21 and 22, there are shown views of the building 1600 corresponding respectively to FIGS. 17 and 18, and so of its lower and upper storeys 1611 and 1617. As can be seen from these drawings, the second building section 1620 (in particular its internal volume 1623) defines a circulation space or zone for the building 1600. The circulation space is indicated in cross-hatching and given the reference numeral 1649. The circulation space 1649 may also be referred to in this document as a transition space or zone, and can have various functions.

For example, access between the upper living space 1621 and the lower the living space 1615 of the first building section 1610 is provided via the circulation space 1649. The circulation space 1649 defines the access route 1625 between the living spaces 1615 and 1621, and provides the required access.

Access into the first building section 1610 from the outside or exterior 1623 of the building 1600 is also provided via the circulation space 1649. The circulation space 1649 defines the access route 1635 between the building exterior 1637 and the lower storey internal volume 1613 (and also the upper storey internal volume 1619, via the staircase 1627).

The circulation space 1649 also facilitates communication between the internal volume 1623 of the second building section 1620 and the internal volumes 1613 and 1619 of the first building section lower and upper storeys 1611 and 1617.

The circulation space 1649 also provides access between different living spaces within the first building section 1610, as well as between different usage areas of the building section. Specifically, the circulation space 1649 provides the access route 1647 between the various bedrooms 1641 to 1645 in the upper storey 1617 of the first building section 1610. The circulation space 1649 also provides access/an access route between different usage areas 1615*a* to *c* of the first building section 1610. The circulation space 1649 communicates with both the various usage areas 1615*a* to *c*, and with the various bedrooms 1641 to 1645, to thereby connect these different usage areas/living spaces.

The circulation space 1649 comprises the staircase 1627, a downstairs or lower storey hallway 1651, an upstairs or upper storey landing 1653, and one or more doorway. In the illustrated embodiment, the second building section 1620 provides all doorways between the building exterior 1637 and the interior of the building 1600, as well as between different rooms or areas of the first building section 1610 and the second building section itself. The circulation space 1649 therefore includes all doorways required to gain access to the rooms/areas within the first building section 1610. This is of particular benefit as the fitting of doorways (and mounting of doors in the doorways) is a skilled job which can be carried out in a verifiable manner in the off-site manufacturing facility.

Also, it is well known that light switches are typically provided adjacent doorways. Providing the circulation space 1649 including all such doorways allows all (or most) of the switches associated with lights in the first building section rooms 1641 to 1645, and areas 1615*a* to 1615*c*, to be provided in the second building section 1620. A benefit of this is that power for operating the lights can be routed into the second building section 1620 (optionally via a services hub as described elsewhere in this document), and then to the light switches. This can simplify construction of the first building section 1610, as it may then only be necessary to connect light fittings in the rooms/areas to the switches, which may be via connectors provided on or in the second building section 1620 (or via wireless transmission, as explained elsewhere in this document).

The doorways include the front doorway 1639, and internal doorways 1655*a* to *g*. The internal doorways 1655*a* and *b* provide access between the second building section 1620 and the different usage areas 1615*a* to *c* of an open plan room of the lower living space 1615. Doorway 1655*a* provides access to a leisure/living area 1615*a* of the open plan room 1615, whilst doorway 1655*b* provides access to a dining area 1615*b* and a kitchen area 1615*c*. Doorway 1655*c* provides access between the kitchen area 1615*c* and a utility room 1657 in the second building section 1620. Doorways 1655*d* to *f* provide access respectively to the bedrooms 1641 to 1645. Doorway 1655*g* provides access between the master bedroom 1641 and an ensuite 1659 in the second building section 1620. A void or space 1665*c* can be provided in the utility room 1657 (or between a wall of the utility room and an external wall of the building section 1620), which can be used as a riser or passage for passing services upwardly within the second building section 1620 (such as water pipes, air ducts, and electrical, data or telecommunication cables). Options for the leisure/living area (and indeed for other rooms or areas in the building 1600) include a home office, and play, gaming or cinema rooms.

As can be seen from the drawings, the first building section 1610 is devoid of a main or front doorway, the main doorway 1639 being provided by the second building section 1620, when connected. In the illustrated embodiment, the first building section 1610 is devoid of any doorway to the building exterior 1637, so that the sole access route/access between the exterior 1637 and the interior of the first building section is provided by the main doorway 1639 in the second building section 1620. The first building section 1610 is also devoid of any internal doorways, all doorways providing access within the completed building 1600 being in the second building section 1620.

The second building section 1620, in particular its circulation space 1649, is therefore configured to provide the doorway 1639 which communicates with the exterior 1637, and all of the internal doorways 1639 and 1655*a-g* which permit circulation within the building 1600 and between the building sections (or in a variation, a majority of the internal doorways).

Residential building doorways are typically at least around 800 mm in width, and optionally up to around 900 mm in width. A sum of the widths of the doorways provided by the second building section 1620 which communicate with the first building section 1610, optionally for each storey of the first building section, is typically: greater than about 1800 mm (i.e. more than two doorways per storey); optionally at least about 2400 mm (i.e. at least three doorways); and may be at least about 2700 mm. In the illustrated embodiment, a sum of the width of such doorways at a lower storey level of the second building section 1620 (comprising doorways 1639 and 1655*a* to *c*) is at least 3200 mm, and optionally up to 3600 mm. A sum of the width of such doorways at an upper storey level of the second building section 1620 (comprising doorways 1655*d* to *g*) is similarly at least 3200 mm, and optionally up to 3600 mm.

Whilst the circulation space 1649 in the building 1600 provides functions including access between upper and lower storeys 1617 and 1611 of its first building section 1610, the circulation space 1649 also has a use in single storey residential buildings of the type described above. Specifically, the circulation space 1649 can provide access/an access route into a first building section of such a building.

The circulation space 1649 is configured to provide access to three or more rooms of the building, which rooms are all be provided by a living space of the first building section 1610, and can be on a single level or storey of the building 1600. In the illustrated embodiment, the circulation space 1649 provides access to the three bedrooms 1641 to 1645 in the first building section upper storey 1617, which are defined by the upper living space 1621, and at a common level. The circulation space 1649 can also be configured to provide access to a plurality of rooms of the building 1600 provided by the lower storey living space 1615 of the first building section 1610. In the illustrated embodiment however, the circulation space 1649 provides access to the plurality of different usage areas 1615*a* to *c* of the single room defined by the lower living space 1615, some of the areas (and optionally all in other embodiments) being accessed using different doorways 1655*a/b*.

The first building section 1610 has a total internal volume, which is the sum of the internal volume defined by its lower storey 1611, and the internal volume defined by its upper storey 1617. In situations where there is only one storey then the total internal volume would be the volume of that storey. In situations where there are more than two storeys then the total internal volume would be the sum of the volumes of all its storeys.

The hybrid residential building 1600 also has a total internal volume, which is the sum of the total internal volume of the first building section 1610, and the internal volume 1623 of the second building section 1620.

The second building section 1620 suitably defines at least around 15% of the total internal volume of the building 1600, optionally at least around 20%, optionally at least around 25%, and optionally up to around 30% of said volume. The first building section 1610 suitably defines no more than around 85% of the total internal volume of the building 1600, optionally no more than around 80%, optionally no more than around 75%, and optionally no more than around 70% of said volume. A ratio of the total internal volume of the building 1600 provided by the second building section 1620 relative to the total internal volume of the building provided by the first building section 1610 is suitably around 15:85, optionally around 20:80, optionally around 25:75, and optionally around 30:70. In a variation, which may apply particularly to smaller buildings, the second building section could provide up to around 50% of the total internal volume of the building (and so around a 50:50 ratio of second building section volume relative to the total).

Arranging the second building section 1620 to provide between around 15% to 30% of the total internal volume of the building 1600, and in particular up to around 30% of the internal volume, provides sufficient volume for a usable space (optionally comprising a living space) within the second building section, and for the required access to be provided passing through it. Restricting the proportion of the total living space provided by the second building section 1620 to no more than around 30% of the building 1600 total may also facilitate construction of the second building section, and/or its transportation to the final location (by effectively limiting its size). In the illustrated embodiment, the second building section 1620 provides up to around 30% of the total internal volume of the building 1600. Particular ranges for illustrated embodiments are around 24% to around 28%.

The internal volume 1623 of the second building section 1620 provides a further living space within the building 1600. In particular, and referring back to FIGS. 17 and 18, the second building section 1620 living space comprises: the utility room 1657 and a W/C 1661 (both at the ground or lower storey level 1629); the ensuite 1659 and a bathroom 1663 (both at the upper floor or storey level 1631). The second building section 1620 can also provide further usable space within the building 1600, which may be non-living space such as storage or technical space. In the illustrated embodiment, the second building section 1620 comprises a service hub 1640, storage cupboard/closet 1665*a* and a water storage tank cupboard 1665*b*. However, a void or space may be provided where the cupboard 1665*b* is shown, which could again be used as a riser or passage for passing services upwardly within the second building section 1620. In general terms, the second building section 1620 may be considered to define 'transient space' (e.g. that comprising or providing the access routes/circulation space discussed herein), as well as 'stationary space' (e.g. living space such as that providing a W/C, bathroom or ensuite, as well as other usable non-living space).

Referring to FIGS. 16 and 17, the building 1600 also has an external (or outer) surface 1603, which is provided by walls 1604 to 1609 and 1658 of the building (and which excludes a roof of the building). Part of the external surface 1603 is provided by the first building section 1610, and part by the second building section 1620. In the illustrated embodiment, the part of the external surface 1603 provided by the first building section 1610 comprises the external surfaces of the walls 1604, 1605, 1606, 1607 and 1658. The part of the external surface 1603 provided by the second building section 1620 comprises the external surfaces of the walls 1608 and 1609.

The walls 1608 and 1609 of the second building section 1620 therefore provide an external or outwardly facing wall of the building 1600.

The second building section 1620 suitably defines at least around 20% of the total external surface area of the building 1600 (provided by the external/outer surface 1603), optionally at least around 25%, and optionally up to around 30% of said surface area. In a preferred option, the second building section 1620 defines between around 24% and around 28% of said surface area. The first building section 1610 defines no more than around 80% of the total surface area of the building 1600, optionally no more than around 75%, and optionally no more than around 70% of said surface area. Arranging the second building section 1620 so that it provides between around 15% to 30% of the total surface area of the building 1600, and in particular up to around 30% of the surface area, provides sufficient usable internal space within the second building section, and for the required access passing through it. Restricting the proportion of the total surface area (and so internal space) provided by the second building section 1620 to no more than around 30% also facilitates construction of the second building section, and its transportation to the final location. In a variation, which may apply particularly to smaller buildings, the second building section could provide up to around 50% of the total surface area of the building.

The principles of the invention apply to buildings of alternative types, including semi-detached and terraced houses (one of which will be described below). It will be understood that buildings of these further types share one or more wall with an adjacent building. In buildings of these types, at least some of the walls that form a perimeter of the building may not be external walls, in that they may be shared with an adjacent building (and so effectively form interior walls of the buildings). In these situations, the surface area sharing principles outlined above may apply to proportions of a perimeter of the building defined by first and second building sections (including any such shared internal walls), and/or portions of the external surface defined by such internal walls may comprise surfaces which face outwardly of the building e.g. into an adjacent building.

Reference is made in this document to living spaces defined by different parts of the building 1600 (e.g. by the storeys 1611 and 1617 of the first building section 1610, and by the second building section 1620). In the context of the invention, a living space should be taken to mean an area within which a person can live, and which may exclude: storage areas (e.g. cupboards, closets, garage); technical areas (e.g. boiler rooms or cupboards, water storage tank cupboards); attics, lofts, basements and cellars (unless they provide a livable space e.g. a bedroom); and outdoor spaces (e.g. decks, patios, balconies and verandas). Living spaces will typically be covered or enclosed (in the completed building), and heated. A non-limiting list of rooms or areas that may fall within the definition of 'living space' includes: kitchens, bedrooms, living/sitting and leisure rooms, dining rooms, bathrooms, W/Cs and ensuites.

As explained above, living spaces provided by the first building section 1610 form at least part of a plurality of rooms. The one or more room may be selected from the group comprising: a kitchen; a dining room; a living or sitting room (or leisure room); a bedroom; and an open plan room comprising a plurality of different usage areas. The usage areas may be selected from the group comprising: a kitchen area: a dining area; and a living, sitting and/or leisure area. Whilst it may be preferable to provide a kitchen in the first building section 1610 (as shown in the drawings), the second building section 1620 could optionally include a kitchen.

In the illustrated embodiment, the upper living space 1621 of the first building section 1610 forms the bedrooms 1641 to 1645, and the lower living space 1615 forms the open plan room 1615 (which includes the living/leisure, dining and kitchen areas 1615*a* to *c*). The lower living space 1615 may however comprise at least some separate rooms, which are isolated from one another within the first building section 1610 (in a similar way to the bedrooms 1641 to 1645), and which may e.g. define a living or sitting room, dining room and/or kitchen. Also, and depending on factors including building design and ground conditions (e.g. a slope or inclination of the land), the room or rooms provided by the upper 1621 and lower 1615 living spaces may be reversed, or varied from that shown. For example, the lower living space 1615 may provide at least part of a bedroom or bedrooms, and the upper living space 1621 may provide at least part of a kitchen, dining room and/or living room. Bedrooms could be provided in both living spaces 1615 and 1621.

As explained above, the open plan room 1615 comprises a kitchen area 1615*c*. A kitchen positioned in the kitchen area 1615*c* comprises two sets of kitchen units 1667*a* and 1667*b* (FIG. 17), which are disposed adjacent the second building section 1620. Parts of the kitchen are connected or coupled to the second building section 1620. Specifically, an end of the set of kitchen units 1667*a* is connected to the second building section 1620, which serves for locating the set of units within the kitchen area 1615*a*. An end of the other set of kitchen units 1667*b* may also be connected to the second building section 1620. However, the set of units 1667*b* is located adjacent a gable end wall portion 1669 of the first building unit 1610, and may be connected to the gable end wall portion instead of (or in addition to) the second building section 1620.

Services for the kitchen (including electrical power, water supply, sewerage/wastewater outlet and/or gas supply) are provided by the second building section 1620. The second building section 1620 comprises connectors (indicated schematically at 1671) for providing the services to the kitchen. The set of kitchen units 1667*a* (and optionally set 1667*b*) can be connected to an external wall 1673 of the second building section 1620, which forms an internal wall of the building 1600 when the building sections 1610 and 1620 are connected. The kitchen units 1667*a/b* can be hung from the external wall 1673 if desired. The kitchen may comprise a mounting panel (not shown) to which the set of kitchen units 1667*a* is mounted, the panel being coupled or connected to the external wall 1673.

Referring to FIGS. 16 to 18, it can be seen that the second building section 1620 comprises a plurality of subsections or units which are configured to be fitted or coupled together to form the completed building section. In the illustrated embodiment, the second building section 1620 comprises a lower subsection 1675 and an upper subsection 1677, each of which defines a respective part 1623*a*/1623*b* of the internal building volume 1623 of the second building section. The subsections 1675 and 1677 are configured so that the parts 1623*a* and 1623*b* of the internal building volume 1623 communicate with one-another, to permit movement (i.e. access) between the different parts. The volume parts 1623*a* and 1623*b*: define respective portions of the access route 1625 between the first building section storeys 1611 and 1617: together provide for the required access between the storeys: and together facilitate the internal volume relationship/communication set out above.

The subsections 1675 and 1677 are independently transportable and connectable on the building site (at the final location). The subsections 1675 and 1677 are stackable (directly or indirectly), and suitably arranged so that they can be stacked one on top of the other, as shown in FIG. 16. The subsections 1675 and 1677 interconnect, suitably via male and female connectors (not shown) provided on the subsections. The subsections 1675 and 1677 have common floor plans and shapes, so that they reside within a common perimeter. In a variation however, one of the subsections may have a different shape or perimeter, e.g. an upper subsection (optionally a third or top subsection) could be provided which has a different shape and/or smaller or larger perimeter. The upper subsection 1677 comprises a roof 1679 for the second building section 1620, or the roof 1679 can be provided as a separate subsection and connected to the upper subsection 1679 on-site.

The lower subsection 1675 forms a lower storey of the second building section 1620, which communicates with the internal volume 1613 defined by the lower storey 1611 of the first building section 1610. The lower subsection 1675 comprises a floor 1681 which is at a level that is substantially the same as that of a floor 1683 of the first building section lower storey 1611. The upper subsection 1677 forms an upper storey of the second building section 1620, which communicates with the internal volume 1619 defined by the upper storey 1617 of the first building section 1610. The upper subsection comprises a floor 1685 which is at a level that is substantially the same as that of a floor 1687 of the first building section upper storey 1617 (and which is vertically above the floor level 1683 of the first building section lower storey 1611).

The lower subsection 1675 comprises the staircase 1627. The upper subsection 1677 comprises an aperture or opening 1689 which communicates with the staircase 1627 when the subsections 1675 and 1677 are connected, to permit passage between the subsections via the staircase. The aperture 1689 opens on to the landing 1653 (FIG. 22) within the upper subsection 1677. The staircase 1627 and the aperture 1689 are both provided on/in, or form part of: the circulation space 1649; and the access route 1625; and/or: provide for the required access; and facilitate the internal volume relationship/communication outlined above.

The first and second building sections 1610 and 1620 can also be configured so that there is a substantially air-tight seal between the building sections. This may be advantageous in restricting air ingress into the building 1600, and air egress from the building, at an interface 1652 (FIG. 16) between the building sections 1610 and 1620. The seal may be between an external surface 1654 of the second building section 1620 and an external surface 1656 of the first building section 1610, and may be provided at the interface 1652. As shown in the enlarged cross-sectional side view of FIG. 16A (presented on the same sheet as FIG. 16), one of the first and second building sections 1610, 1620 can including sealing elements or structures, one shown and given the reference numeral 1648. These seal elements 1648 sealingly abut the other one of the first and second building sections 1610, 1620 to provide the required seal between the building sections. The other one of the building sections 1610, 1620 defines or comprises a surface configured to cooperate with the seal elements 1648 to provide the required seal, which may simply be a suitably arranged part of the relevant external surface 1654 or 1656. The seal elements 1648 are compressed when the building sections 1610, 1620 are connected. The seal that is provided by the seal elements 1648 is substantially air-tight in that air egress/ingress between the building sections 1610, 1620 at the region of the interface 1652 is restricted, and optionally substantially entirely prevented. The seal elements 1648 may suitably extend around an entire perimeter of the interface 1652 between the building sections 1610, 1620.

Figure 16A:
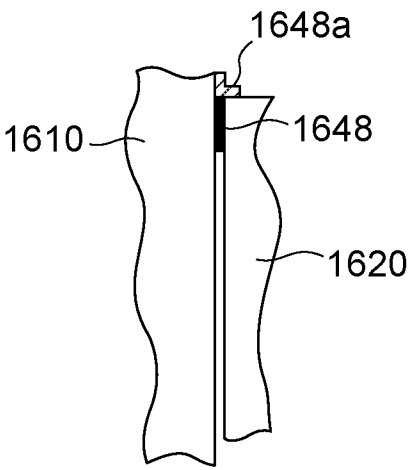
FIG. 16A is an enlarged cross-sectional side view of the building shown in FIG. 16, illustrating an interface between first and second building sections of the building.

In a variation, a seal may be provided which is arranged to overlie at least part of one of the building sections 1610 and 1620, and may be arranged so that it overlies the interface 1652. An exemplary seal element 1648*a* providing such a seal is shown in FIG. 16A, which overlies the roof 1679 of the second building section 1620 (or which could be provided between the roof and the upper subsection 1677). It will be understood that a plurality of such sealing elements 1648*a* may be provided extending around the entire perimeter of the interface 1652. A combination of the two different sealing elements 1648 and 1648*a* may be used if desired.

Figure 23:
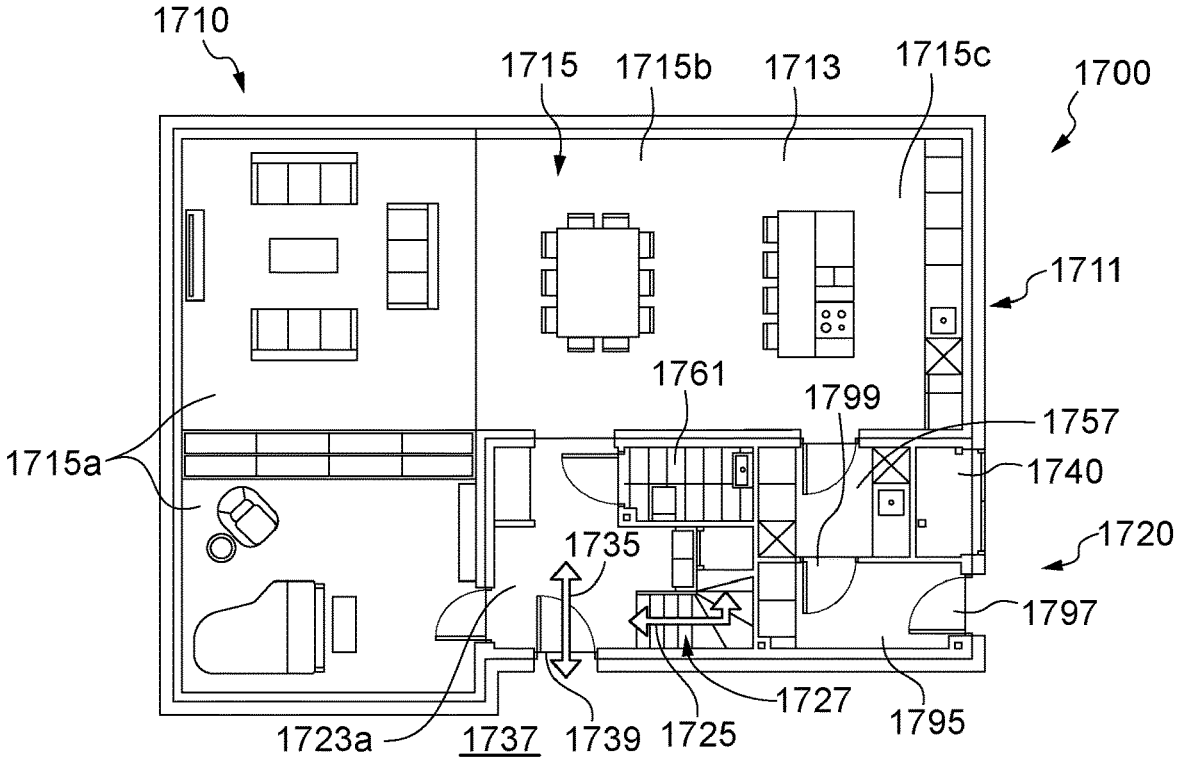
FIGS. 23 and 24 are plan cross-sectional views of a building according to another embodiment of the invention, showing lower and upper storeys respectively of the building.
Figure 24:
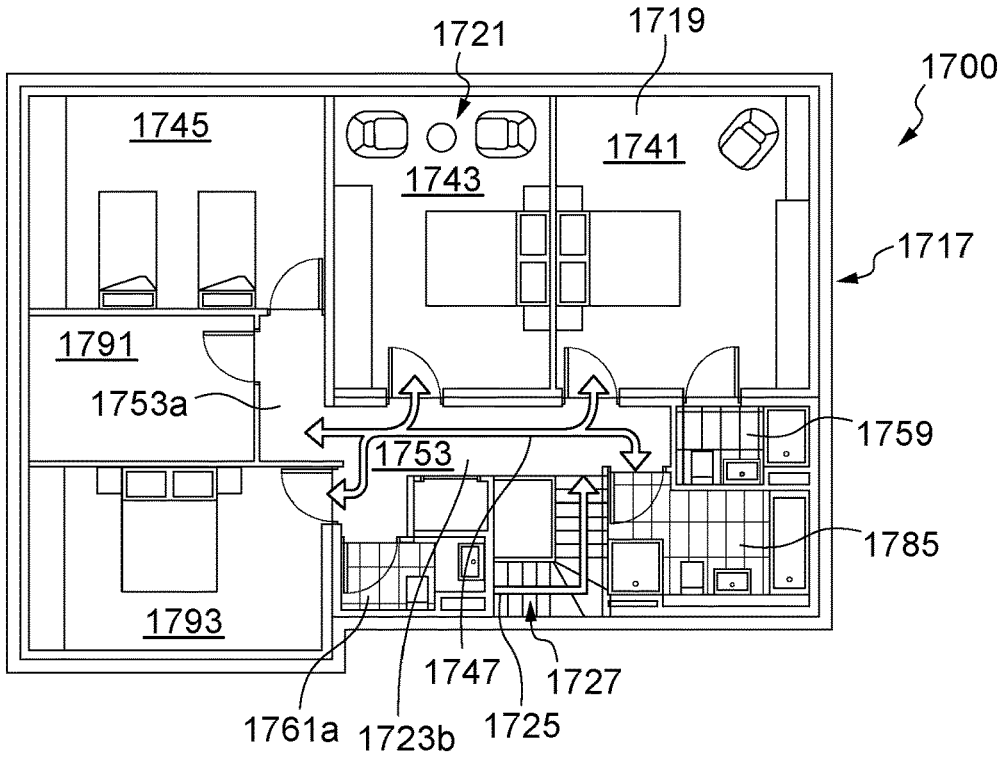

FIGS. 23 and 24 are now referred to, which illustrate a building 1700 according to another embodiment of the invention. FIG. 23 is a plan cross-sectional view of a lower storey of the building 1700, and FIG. 24 a plan cross-sectional view of an upper storey of the building. The building 1700 comprises first and second building sections 1710 and 1720 which share many of the features of the first and second building sections 1610 and 1620 forming the building 1600. The building 1700 differs from the building 1600 largely in terms of dimensions and internal layouts of the first and second building sections 1710 and 1720, in comparison to the first and second building sections 1610 and 1620. Mainly substantive differences will be described here.

The building 1700 again takes the form of a detached house, and its first building section 1710 has a lower storey 1711 and an upper storey 1717. The lower storey 1711 has an internal volume 1713 defining a lower living space 1715, which again forms an open plan room. The open plan room 1715 includes a living/leisure area 1715*a*, dining area 1715*b* and kitchen area 1715*c*. The upper storey 1717 has an internal volume 1719 defining an upper living space 1721. In this case, the upper living space 1721 provides a master bedroom 1741, as well as further bedrooms 1743, 1745 and 1793, plus a supplementary bedroom (or family room/office) 1791.

The second building section 1720 again comprises a main or front doorway 1739, and a staircase 1727. An access route 1725 between the upper and lower living spaces 1721 and 1715 of the first building section 1710 again passes through the second building section 1720. In addition, the second building section 1720 is configured so that its internal volume 1723 (comprising lower and upper storey parts 1723*a* and *b*) communicates with both the internal volume 1719 defined by the upper storey 1717 of the first building section 1710, and with the internal volume 1713 defined by the lower storey 1711 of the first building section, when the first and second building sections are connected.

The second building section 1720 is additionally configured to facilitate access between an exterior 1737 of the building 1700 and the internal volumes 1713, 1719 of the first building section 1710 (and so into the building 1700). The second building section 1720 provides an access route 1735 between the building exterior 1737 and the lower storey internal volume 1713. The access route 1735 passes through or includes the main doorway 1739.

The first and second building sections 1710 and 1720 are also configured so that an access route 1747 between the various bedrooms 1741 to 1745, 1791 and 1793 passes through the second building section 1720. The second building section 1720 (in particular its internal volume 1723) further defines a circulation space or zone for the building 1700 (not shown, but similar to that shown at 1649 in FIGS. 21 and 22).

It will be understood from the above and from the drawings that the first and second building sections 1710 and 1720 are therefore configured in a similar way to the building sections 1610 and 1620 in terms of the access routes, access, internal volume communication and circulation space which is provided within the building 1700. Certain areas of difference are however as follows.

The second building section 1720 includes a delivery drop-off area 1795 which can be accessed from the building exterior 1737 via a doorway 1797. A utility room 1757 in the second building section 1720 can again be accessed from its kitchen area 1715*c*, but in this case also provides access to the delivery drop-off area 1795, through an internal doorway 1799. A further access route from the building exterior 1737 into the first building section 1710 can therefore be provided through the drop-off area 1795 and the utility room 1757. A services hub 1740 is once again accessible from the building exterior 1737, but could potentially be accessed also via the utility room 1757 (e.g. via another internal doorway). In addition to a downstairs W/C 1761, an ensuite 1759 for the master bedroom 1741 and a bathroom 1785, the second building section includes an upstairs W/C 1761*a*.

Although most of the bedrooms 1741 to 1745, 1791 and 1793 are isolated from one another in the first building section 1710, access is provided between the bedrooms 1745 and 1791 without requiring that an occupant pass into the second building section 1720. However, access from any of the other bedrooms 1741, 1743 or 1793 into either bedroom 1745 or 1791 does require that the occupant pass into the second building section 1720. This is achieved via a landing 1753*a* provided in the first building section 1710 and which communicates with both a landing 1753 of the second building section 1720, and with the bedrooms 1745 and 1791 (via internal doorways of the bedrooms). The second building section 1720 therefore again provides sole access into three bedrooms of the building 1700, access into the two remaining bedrooms being facilitated by the landing 1753*a*. This may be advantageous in that a dimension of the landing 1753 (and so ultimately of the second building section 1720) can be optimised to provide the best balance of access and size (for transportation purposes).

Figure 25:
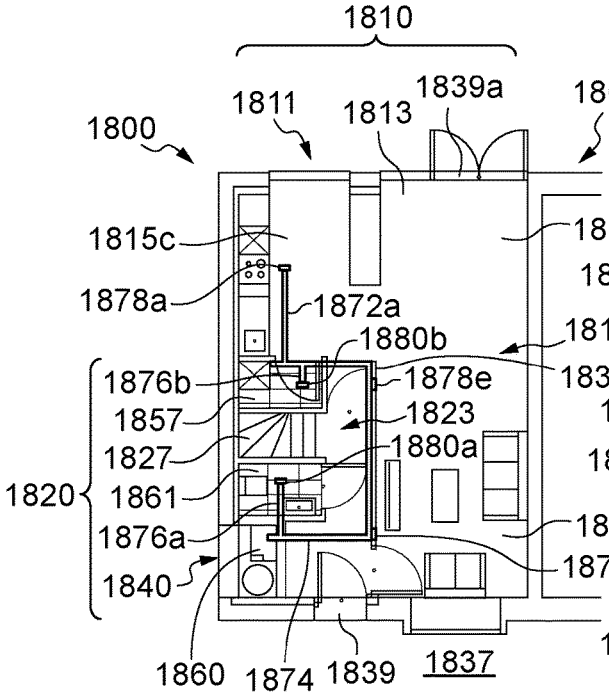
FIGS. 25 and 26 are plan cross-sectional views of a building according to another embodiment of the invention, showing lower and upper storeys respectively of the building.
Figure 26:
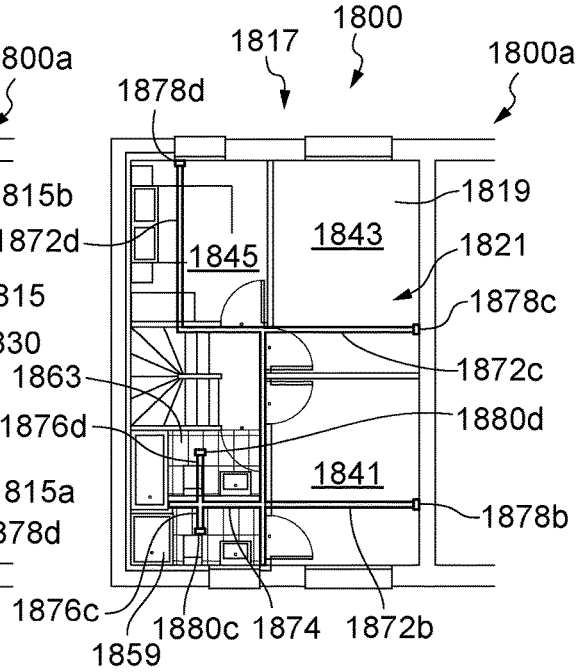

FIGS. 25 and 26 are now referred to, which illustrate a building 1800 according to another embodiment of the invention. FIG. 25 is a plan cross-sectional view of a lower storey of the building 1800, and FIG. 26 a plan cross-sectional view of an upper storey of the building. The building 1800 comprises first and second building sections 1810 and 1820 which share many of the features of the first and second building sections 1610 and 1620 forming the building 1600. The building 1800 differs from the building 1600 largely in terms of dimensions and internal layouts of the first and second building sections 1810 and 1820, in comparison to the first and second building sections 1610 and 1620. Mainly substantive differences will be described here.

The building 1800 in this embodiment takes the form of a semi-detached house. Part of a further building of the same type is shown to the right in the drawing and indicated at 1800*a*. The further building 1800*a* shares a common wall with the building 1800, and is a mirror image of the building 1800. The first building section 1810 has a lower storey 1811 and an upper storey 1817. The lower storey 1811 has an internal volume 1813 defining a lower living space 1815, which forms an open plan room. The open plan room 1815 includes a living/leisure area 1815*a*, dining area 1815*b* and kitchen area 1815*c*. The upper storey 1817 has an internal volume 1819 defining an upper living space 1821. In this case, the upper living space 1821 provides a master bedroom 1841, and further bedrooms 1843 and 1845.

The second building section 1820 again comprises a main or front doorway 1839, and a staircase 1827. It will be understood from FIGS. 25 and 26, and the discussion of the buildings 1600 and 1700, that the first and second building sections 1810 and 1820 are configured in a similar way to the building sections 1610/1620 and 1710/1720 in terms of the access routes, access, internal volume communication and circulation space which is provided within the building 1800. Certain areas of difference are however as follows.

The second building section 1820 includes a patio-type doorway 1839*a* which provides a further access route from the building exterior 1837 into the first building section 1810, in this case directly into the first building section. The second building section 1820 again includes a services hub 1840 which is accessible from the building exterior. The second building section also comprises a ventilation system which is controlled from the services hub 1840, the ventilation system indicated generally by reference numeral 1860. The ventilation system 1860 is configured to supply external air into the building 1800, and to withdraw internal air from the building and to discharge it to the building exterior 1837, to thereby control ventilation of the building.

Figure 27:
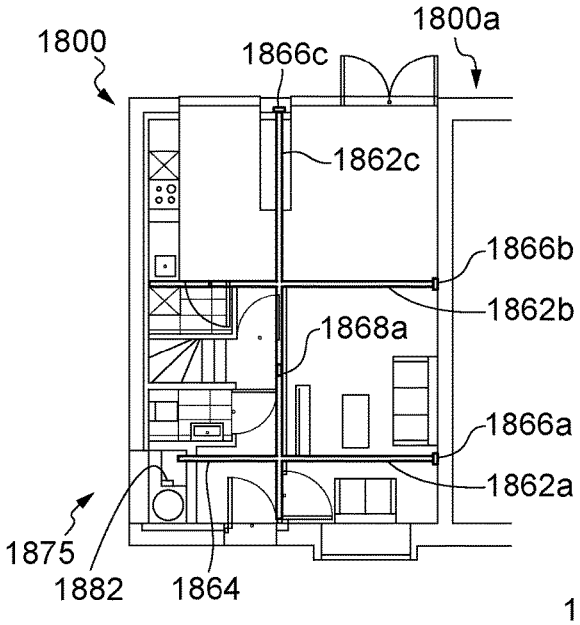
FIGS. 27 and 28 are further views of the building corresponding to those of FIGS. 25 and 26, showing other features.
Figure 28:
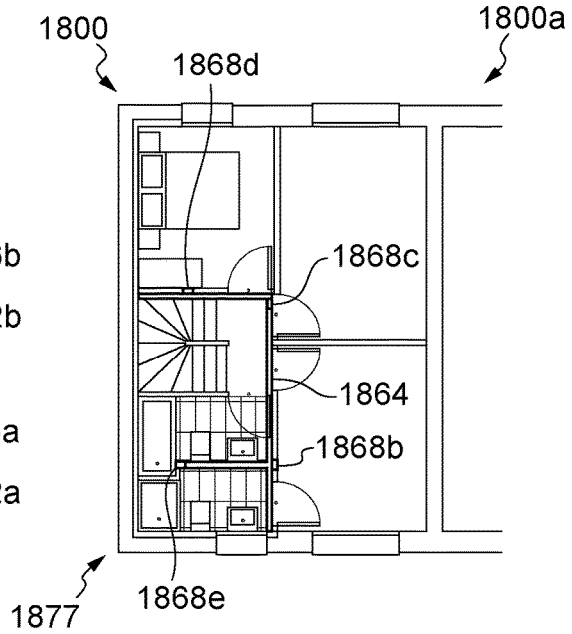

In the illustrated embodiment, the ventilation system 1860 is configured to supply external air into the internal volumes 1813 and 1821 of the first building section, as well as into an internal volume 1823 of the second building section 1820. The ventilation system 1860 is configured to supply external air both directly and indirectly into these internal volumes 1813, 1821 and 1823. This is achieved using an arrangement of ducts/conduits and vents in the first and second building sections 1810 and 1820, which are shown in FIGS. 27 and 28 (which drawings correspond respectively to FIGS. 25 and 26).

Supply ducts 1862*a, b* and *c* in the first building section 1810 connect with the ventilation system 1860 for the supply of external air into different regions of the open plan room 1815. As can be seen from the drawings, each one of the ducts 1862*a, b* and *c* is associated with a different usage area of the room, respectively the living area 1815*a*, dining area 1815*b* and kitchen area 1815*c*. The ducts 1862*a* to *c* connect with a supply manifold 1864 in the second building section, for the indirect supply of external air into the room 1815 via respective vents 1866*a* to *c*. The supply manifold 1864 extends around both the lower and upper subsections 1875 and 1877 of the second building section 1820. The supply manifold 1864 also comprises various vents 1868*a* to *e* which serve for supplying external air to different rooms/areas in the first and second building sections 1810 and 1820.

The ducts 1862*a* to *c* and the various vents 1868*a* to *e* are supplied with external air via the supply manifold 1864. The ventilation system 1860 comprises an integral filter and heat exchanger (not shown) positioned in the services hub 1840, which serve for conditioning the air prior to discharge into the building 1800. The external air is drawn in from the building exterior 1837 by a pump (not shown) in the ventilation system 1860, passing through the heat exchanger and the filter before flowing into the supply manifold 1864. The filter serves for removing contaminants (e.g. particulates and pollen), whilst the heat exchanger serves for transferring thermal energy between incoming and outgoing air streams, to heat the incoming air (or cool the incoming air, depending on the temperature differential between the building exterior and interior, and a desired temperature within the building 1800). The ventilation system 1860 may also comprise, or may be configured to cooperate with, a heating and/or cooling device (not shown), for heating or cooling the external air prior to discharging it into the building 1800. The heating device may be a conventional boiler or other heat source (such as a heat pump), and the cooling device may be an air conditioning device. The heat exchanger, filter and/or heating/cooling device may form part of a conditioning unit of the ventilation system 1860.

Various extraction ducts in the first building section 1810 similarly connect with the ventilation system 1860, for the indirect withdrawal of internal air from within the first building section. An extraction duct 1872*a* is provided in the kitchen area 1815*c* of the open plan room 1815. Extraction ducts 1872*b* to *d* are also provided in the bedrooms 1841 to 1845. The ducts 1872*a* to *d* connect with an extraction manifold 1874 in the second building section 1820. Internal air is drawn into the extraction manifold 1874 by a pump (not shown) in the ventilation system 1860, before being discharged to the exterior 1837. The internal air passes through the heat exchanger before exiting the building 1800, to transfer thermal energy to or from the incoming external air, as discussed above.

Branch ducts 1876*a* to *d* are distributed around the second building section 1820 and connect with the extraction manifold 1874, for withdrawing internal air from various areas, specifically: a W/C 1861; a utility room 1857; an ensuite 1859; and a bathroom 1863. The ducts 1872*a* to *c* comprise respective vents 1878*a* to *c* through which air is drawn into the ducts. Vents 1878*d* and *e* are also provided in the second building section 1820, for drawing air directly from the living and dining areas 1815*a* and *b* of the room 1815. The ducts 1876*a* to *d* similarly comprise respective vents 1880*a* to *d* through which air is drawn into the ducts.

As can be seen from FIGS. 25 to 28, the ventilation system 1860 is configured to supply air into certain areas of the building 1800, and to withdraw air from further areas which are spaced or distanced from the supply areas. This promotes a flow of air within the building 1800. For example, external air is supplied into the living area 1815*a* through the supply vent 1866*a*, and internal is withdrawn from the living area through the extraction vent 1878*d*, which is spaced (vertically and/or horizontally) from the supply vent.

The ventilation system 1860 also comprises a control unit 1882 for controlling the supply of external air into, and the withdrawal of internal air from, the building 1800. The control unit 1882 is also arranged to monitor operation of the filter and the heat exchanger, and to cooperate with a heating system (not shown) of the building to achieve an optimum desired temperature in the building 1800. It will be understood that the heating or cooling effect applied will depend on factors including a temperature differential between the external and internal air, and a desired temperature for the air within the building. The ventilation system 1860 can take the form of a Mechanical Ventilation and Heat Recovery (MVHR) system, in which the heat exchanger provides the heat recovery function. The heat exchanger can also beneficially remove moisture from the incoming external air, which may be drained from the heat exchanger.

In a variation on the illustrated embodiment, the ventilation system 1860 can be configured to supply external air into the internal volume 1823 of the second building section 1820, for subsequent flow or bleed into the first building section 1810 (e.g. under positive pressure—above the pressure in the first building section—applied to the air in the internal volume of the second building section). This may be achieved by directing external air into the volume 1823 through suitable vents. The ventilation system 1860 may similarly be configured to withdraw internal air from the internal volume 1823 of the second building section 1820, to thereby draw internal air from the first building section 1810 (e.g. under negative pressure applied to the air in the internal volume of the second building section). Again this can be achieved using suitable vents.

In another variation, the ventilation system 1860 may be configured to supply external air into a space or cavity between the first and second building sections 1810 and 1820, for subsequent flow or bleed into the first building section (e.g. under positive pressure), and optionally also into the second building section. The ventilation system 1860 may similarly be configured to withdraw internal air from the space or cavity between the first and second building sections (e.g. under negative pressure). The location of one such space is indicated by numeral 1830 in FIG. 25.

In a further variation, the ventilation system 1860 may be provided in the first building section 1810. The arrangement of ducts/vents set out above may then be reversed, for example with ducts in the second building section 1820 which connect with ducts of the ventilation system in the first building section 1810. Parts of the ventilation system could be provided in both of the building sections, and ducts/vents provided as appropriate.

Figure 29:
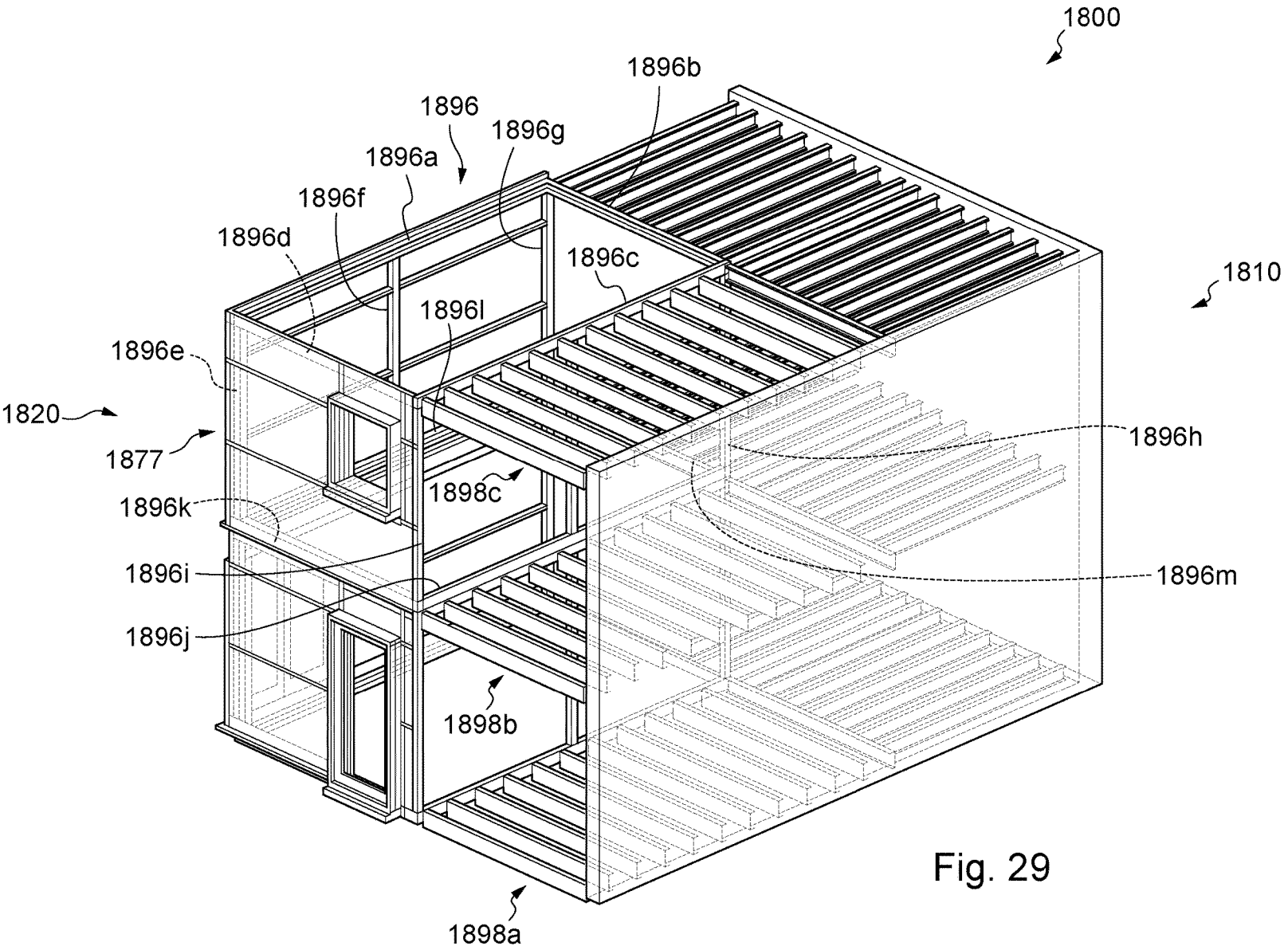
FIG. 29 is a partially cut-away perspective view of the building shown in FIG. 25.

Turning now to FIG. 29, there is shown a partially cut-away perspective view of the building 1800 shown in FIG. 25. Only part of the building 1800 is shown in the drawing. The second building section 1820 comprises a metal (e.g. steel) frame support structure, which is indicated generally at 1896 in the drawing. In line with the discussion above, this facilitates construction in a factory or facility away from the final location for the building, and provides sufficient rigidity for the second building section 1820 to be transported to the final location. Certain structural elements 1896*a* to 1896*m* of the steel frame support structure 1896 are shown, and together form a structural frame for an upper subsection 1877 of the second building section 1820. The structural elements comprise beams 1896*a-d* forming a roof portion of the structural frame, beams 1896*j-m* forming a floor portion, and main columns 1896*e-i* which connect the floor and roof portions. The structural elements of the frame structure 1896 are hot-formed (e.g. hot rolled), and may for example be I-beams. Hot-formed structural elements are beneficial as they can support relatively high loads (including point loads), and can span reasonably large distances. This may facilitate the formation of apertures (e.g. doorways and window apertures) such as at a perimeter of the second building section 1820.

The first building section 1810 is connected to and supported by the second building section 1820, in particular by the metal frame structure 1896. The first building section 1810 comprises structural elements 1898*a-c*, at least some of which are connected to and supported by the second building section 1820. In the illustrated embodiment, the structural elements are floor joists 1898*a* and 1898*b*, and roof beams 1898*c* (typically also hot formed steel, but optionally wooden). As can be seen from the drawing, the floor joists 1898*a, b* and roof joists 1898*c* are directly connected to (and so supported by) the metal frame structure 1896 in the second building section 1820, suitably via releasable connectors such as nuts and bolts. In this way, the second building section 1820 provides support for the first building section 1810 both during construction, and subsequently during use of the building 1800. This can be advantageous for numerous reasons.

For example, the second building section 1820 can provide predetermined anchor or connection points for parts of the first building section 1810, in particular its various structural elements 1898. The connection between the structural elements 1898 and the metal frame structure 1896 is also such that the metal frame structure provides support for the first building section 1810 both during construction, and during subsequent use of the building 1800. In particular, the first and second building sections 1810 and 1820 can flex and/or move under applied external loading (e.g. due to wind loading or ground settlement) in a relatively homogenous manner. This can reduce a likelihood of relative movement between the building sections 1810 and 1820, which could otherwise lead to shear loads and potentially cracking and/or water ingress.

In this embodiment, the second building section 1820 is transported to the site and positioned at the final location, suitably on a pre-prepared foundation. The first building section 1810 is then constructed and connected to the second building section 1820 employing any one of the techniques described elsewhere in this document. In this way, the second building section 1820 is effectively constructed from (or around) the first building section 1810.

Figure 30:
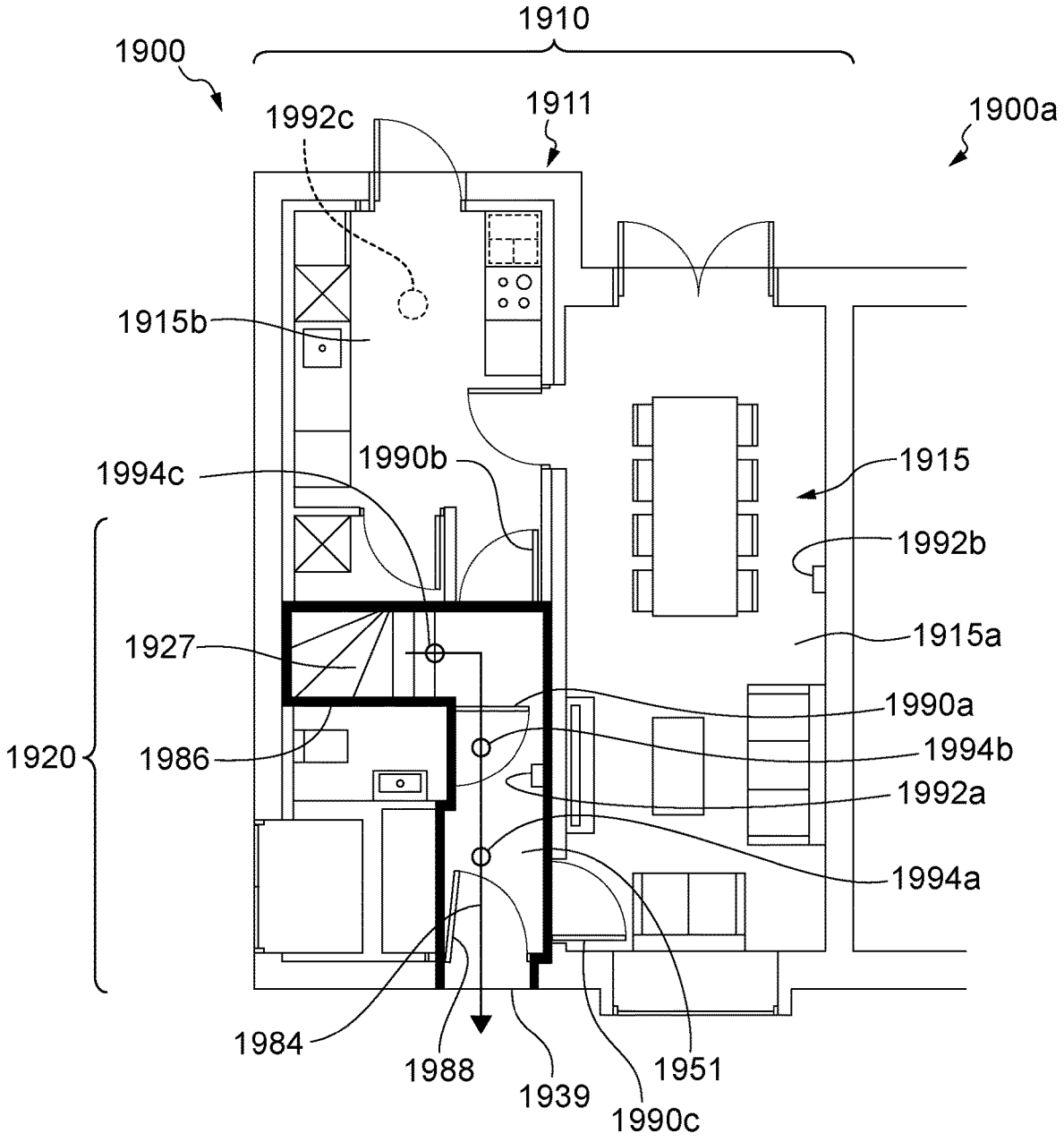
FIG. 30 is a plan cross-sectional view of a building according to another embodiment of the invention, showing a lower storey of the building.

FIG. 30 is now referred to, which illustrates a building 1900 according to another embodiment of the invention. The drawing shows a plan cross-sectional view of a lower storey of the building 1900. The building 1900 comprises first and second building sections 1910 and 1920 which share many of the features of the first and second building sections 1610 and 1620 forming the building 1600. The building 1900 differs from the building 1600 largely in terms of dimensions and internal layouts of the first and second building sections 1910 and 1920, in comparison to the first and second building sections 1610 and 1620. Only substantive differences will be described here.

The building 1900 in this embodiment again takes the form of a semi-detached house, and is very similar to the building 1800. Part of a further building of the same type is therefore shown to the right in the drawing and indicated at 1900*a*. The further building 1900*a* shares a common wall with the building 1900, and is a mirror image of the building 1900. The first building section 1910 has a lower storey 1911 comprising an internal volume 1913 which defines a lower living space 1915. The lower living space 1915 comprises an open plan room 1915*a* providing living and dining areas, and a kitchen 1915*b*.

The second building section 1920 again comprises a main or front doorway 1939, and a staircase 1927. It will be understood from FIG. 29, and the discussion of the buildings 1600 to 1800, that the first and second building sections 1910 and 1920 are configured in a similar way to the previously described building sections in terms of the access routes, access, internal volume communication and circulation space which is provided within the building 1900.

The second building section 1920 provides a fire escape route 1984 for the building. The fire escape route 1984 comprises the main doorway 1939, the staircase 1927, and a hallway 1951, all of which are provided by the second building section 1920. The fire escape route can optionally include further parts of the second building section 1920, for example an upstairs landing (not shown). The second building section 1920 comprises fire-proof or fire-resistant structures which define the fire escape route 1984. In the illustrated embodiment, the fire escape route 1984 is bound or bordered by fire-resistant or fire-proof walls of the second building section 1920, which walls provide at least part of the staircase 1927 and the hallway 1951, and which connect the main doorway 1939 to the staircase. Walls or wall portions forming the fire escape route 1984 are indicated in heavy outline and marked with the reference numeral 1986. Doors of the second building section in the fire escape route (and optionally further doors in the building section, potentially all doors) are fire-resistant or fire-proof. Thus a main or front door 1988 and internal doors 1990*a* to *c*, are fire-resistant. The fire escape route may include at least part of one or more of the circulation spaces defined by the building (similar to those explained elsewhere in this document).

The second building section 1920 can additionally or alternatively comprise a fire suppression system. The fire suppression system may be operable: to define the fire escape route 1984; to suppress a fire within the fire escape route; or to suppress a fire in order to restrict or prevent it from spreading into the fire escape route. The fire suppression system may comprise a plurality of fire alarms and/or detectors 1992*a* to *c*, and a plurality of water sprinklers 1994*a* to *c* (or other fluid suppressant delivery devices).

Figure 31:
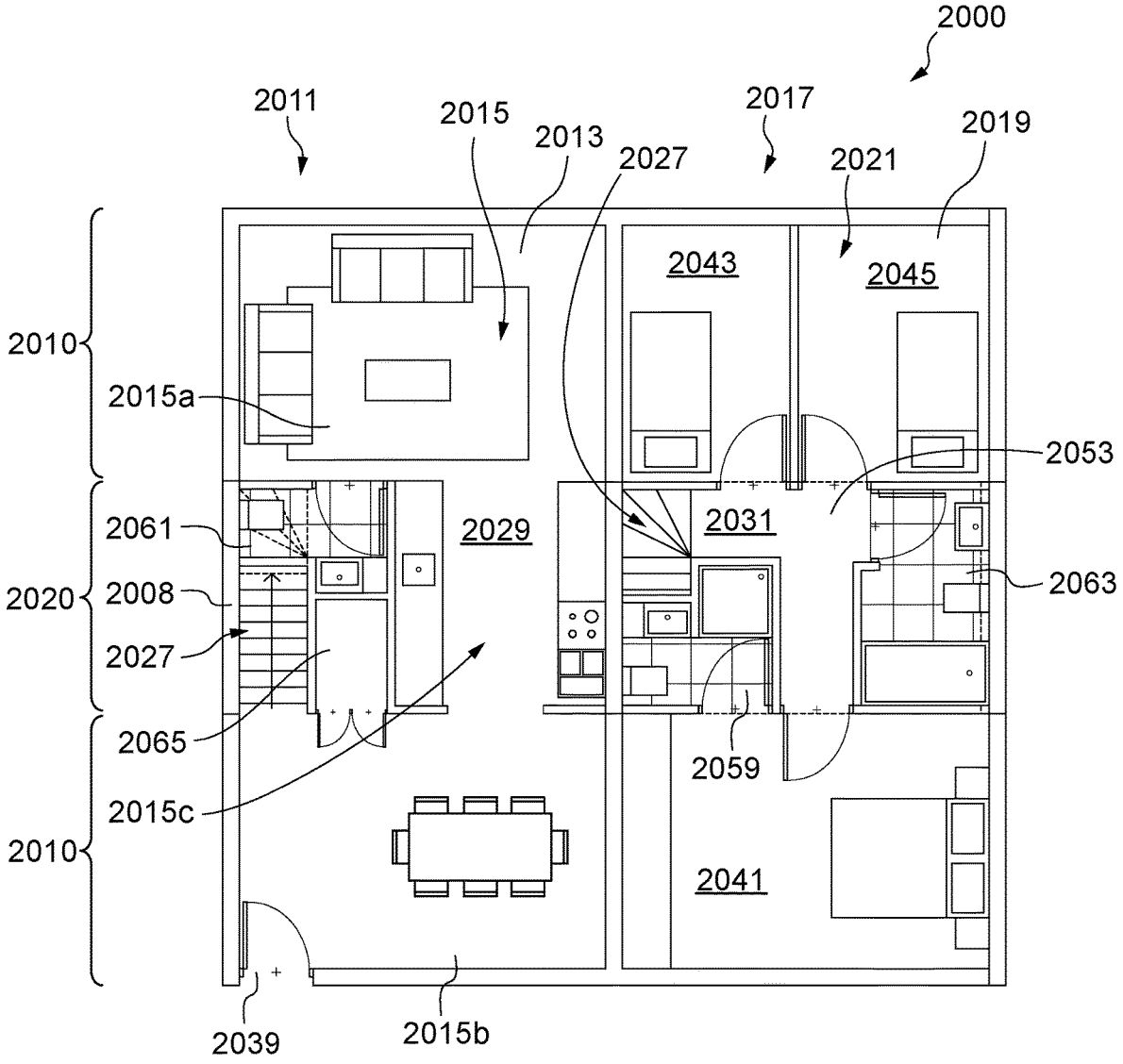
FIG. 31 shows plan cross-sectional views of lower and upper storeys of a building according to another embodiment of the invention, the storeys presented side-by-side.

FIG. 31 is now referred to, which shows plan cross-sectional views of lower and upper storeys of a building 2000 according to another embodiment of the invention. The building 2000 comprises first and second building sections 2010 and 2020 which share many of the features of the first and second building sections 1610 and 1620 forming the building 1600. The building 2000 differs from the building 1600 largely in terms of dimensions and internal layouts of the first and second building sections 2000 and 2000, in comparison to the first and second building sections 1610 and 1620. Only substantive differences will be described here.

The building 2000 in this embodiment again takes the form of a semi-detached house. The first building section 2010 has a lower storey 2011 comprising an internal volume 2013 which defines a lower living space 2015. The lower living space 2015 is an open plan room comprising a living area 2015*a* and a dining area 2015*b*. In this embodiment, the first building section lower storey 2011 also comprises a main or front doorway 2039 providing access into the building 2000. The first building section 2010 also has an upper storey 2017 comprising an internal volume 2019 which defines an upper living space 2021. The upper living space 2021 comprises a master bedroom 2041, and further bedrooms 2043 and 2045.

The second building section 2020 in this embodiment again comprises a staircase 2027. It will be understood from FIG. 31, and the discussion of the buildings 1600 to 1900, that the first and second building sections 2010 and 2020 are configured in a similar way to the previously described building sections in terms of relevant access routes, access, internal volume communication and circulation space which is provided within the building 2000. These apply to movement between the upper and lower storeys 2011 and 2017, as well as between the living and dining areas 2015*a/b*, and the bedrooms 2041 to 2045.

In contrast to the buildings described above, the second building section 2020 also comprises a kitchen 2015*c* at a ground level 2029. The provision of a kitchen 2015*c* in the second building section 2020 may be more suited to smaller buildings, in particular a smaller semi-detached building of the type shown. The second building section 2020 further comprises a W/C 2061 and a cupboard 2065 at its ground level 2029. An ensuite 2069 and bathroom 2063 are provided at an upper level 2031, as well as a landing 2053. The landing 2053 provides access to all of the bedrooms 2041 to 2045, as well as to the bathroom 2063.

In this embodiment, the second building section 2020 is positioned within a structure of the building 2000 provided by the first building section 2010. The first building section 2010 is constructed so that it includes a cavity shaped to receive the second building section 2020 (or is built around the second building section so that the second section is positioned within the first structure on completion). The first and second building sections 2010, 2020 are arranged so that access between the living room 2015*a* and dining room 2015*b* is provided through the second building section, specifically through its kitchen 2015*c*.

In the same way as the previously described embodiments, the second building section 2020 can form part of the external surface of the building, for example with a wall 2008 of the second building section defining part of the external building surface. However, the second building section 2020 can be arranged so that it is built-in to the building 2000. This may be achieved by encapsulating or enveloping the second building section 2020 within an outer layer of the building 2000, which might for example be formed using blocks (e.g. clay bricks) or cladding panels (not shown).

Reference is made throughout this document to the provision of a stairs or staircase in the building, suitably provided by the second building section. A lift or any other suitable means of moving between storeys of the building may be provided in place of (or in addition to) a stairs/staircase. Therefore wherever a stairs or staircase is referred to, it will be understood that a lift may be provided. Where the second building section comprises a plurality of subsections, each subsection may define part of a lift (e.g. a part of a lift shaft), which parts may cooperate when the subsections are connected, so that a lift vehicle may move between the storeys (e.g. through the aligned shaft parts).

Numerous features or principles of the invention are set out in the preceding description, and shown in the accompanying drawings. These features are shown and described in relation to at least one embodiment of the invention. It will be understood that the illustrated embodiments are not limited to the features shown in the drawings and described above, but may comprise further features derived from one or more of the further embodiments disclosed herein.

Optional further features or principles of the invention, which may form part of any one of the embodiments/aspects of the invention discussed above, are as follows. In the following text, references are made to features of a first building section in the form of a 'dock', and a second building section in the form of a 'module'. It will be understood that further features of the first and second building sections described elsewhere in this document may be derived from the subsequent text discussing docks and modules. Accordingly, a reference generally to a dock should be understood to encompass a first building section, and a reference to a module to encompass a second building section. This also applies to buildings, systems/kits and methods described elsewhere.

According to a further aspect of the present invention there is provided a modular building (which may be a hybrid residential building) comprising: a first building section in the form of a dock constructed at a final, fixed, on-site location of the building, the dock optionally being configured to receive a module; and a second building section in the form of a module, the module connected to (and optionally received by) the dock.

In one example, the dock is preconfigured, during construction of the dock at the on-site location, to receive the module. Unlike existing building construction, where any dock is not configured to receive a module, here the dock is preconfigured, during construction of the dock to receive the module. That is, the dock is constructed in the knowledge that a module is to be connected. In this way, build-times are reduced as the dock need not be further modified to facilitate the connection of a module.

In one example, the dock is configured to receive the module without removal or modification of external walls of the dock and/or the module. Conventional construction techniques require removal or modification of external walls to facilitate connection of further building sections, for example removal of a wall to build an extension onto a house. The present invention is absent this requirement. In this way, construction is simplified. Moreover, the construction process is less destructive and disruptive. Material waste is also reduced.

In one example, the dock comprises wall regions configured to be removable to facilitate connection of additional second building sections. In one example, the wall regions are window regions. The window regions may be removable to provide a walkway or doorway. Following removal of the window region, a second building section in the form of a module may be connectable to and receivable by the dock. The module may be connectable to and receivable by the dock at, over or around the walkway or doorway. The wall regions, or window regions, or regions surrounding the wall region or window region, may be originally arranged (that is, upon construction) to receive a module, and following removal of the wall region or window region a module may be connected to the dock. In this way, a plurality of second building sections in the form of modules are connectable to and receivable by the dock.

In one example, the dock is configured to removably receive the module. In this way, the module may be readily removed to facilitate replacement and/or modification of the module. The dock remains structurally sound despite removal or absence of the module, which simplifies the construction process and amount of support equipment and size of the construction team necessary to perform removal and installation of the module. Furthermore, removal of the module from the dock does not impact or damage the components, fixtures and fittings, or décor of the dock. In this way, the dock need not require substantial alteration or redecoration following connection of a further module to the dock, which may for example be a second module. Similarly, removal of the module from the dock does not impact or damage the components, fixtures and fittings, or décor of the module. In this way, the module may retain its appearance and need not require modification or upgrading, or require substantial alteration or redecoration, beyond that planned in order to modify the module, for example to provide a second module for subsequent reconnection to the dock. In other words, the module may be conveniently and relatively simply undocked from the dock.

In one example, the dock comprises an internal building volume, which might define a living or working space. That is, the dock is not simply a foundation structure, such as a concrete slab. Instead, the dock has an internal volume or internal space, defined in some examples by walls, ceiling and floor.

In one example, the module is portable, in a form to be connected to and received by the dock. In one example, the module is moveable and/or transportable in a single-piece form, or substantially constructed form.

That is, the module is moveable and/or transportable, for example on a flatbed truck. In this way, the module may be substantially or wholly constructed at a site away from the dock, transported to the dock and connected to the dock. Skilled tradespeople may work remotely from the dock to construct the module and install, for example, electrics and plumbing, which can be tested in a controlled environment away from the dock. The constructed and tested module can then be transported to the site for connection to the dock. The module could be lowered into position, and/or be provided with one or more rollers or slide elements, allowing the module to be rolled or slid into connection with the dock.

In one example, each of the dock and the module are absent any perishable material (e.g. prior to connection). In one example, the connected dock and module do not (immediately) comprise any perishable material. Such material may be added at a later time.

Perishable materials include timber, plasterboard, and other materials which are impacted by weather, and might include furnishings or final fittings. By each of the dock and the module not comprising perishable material, weather resistance of the building sections is provided. In this way, it is ensured that the dock and module do not suffer from water ingress early in the construction process. The connected dock and module not comprising perishable material may be the structure formed immediately after connection and prior to any finalising of the building. The connected dock and module may then provide a weatherproof internal building volume, such that perishable materials can be introduced without risk of weather damage.

In one example, the dock has one or more open faces, and the dock is configured to removably receive the module at the one or more open faces of the dock. In this way, the dock can be constructed from less material, as one or more faces are left open where the module is to be received. Installation of the module is also less destructive and disruptive, as walls need not be removed to connect the module to the dock.

In one example, in plan view, the dock and/or module has a cross-section having two elongate regions perpendicularly connected and the module and/or dock is connected to both elongate regions. In this way, the module can provide a connection between the regions of the dock. A building in a more traditional rectangular shape is thereby constructed, which improves use of the building volume. In one example, the dock has an L-shaped cross-section and the module is connected to both elongate regions of the L-shaped cross-section. In another example, the module has an L-shaped cross-section and the module is connected to the dock at both elongate regions of the L-shaped cross-section of the module. In one example, the dock and/or module has a H-shaped cross-section and the module and/or dock has a rectangular cross-section. In one example, in plan view, the dock has an internal opening, such as a courtyard, and the module is provided to substantially fill the opening. In this way, a courtyard space may be repurposed as additional building volume of the building. The module can then provide connection between regions of the dock. Any building cross-section is possible where the building has intersecting external walls (i.e. a vertex between two external walls). Although typically angular, the module or dock could define a curved surface, and a curved section of the module could be received by and be connected to a curved section of the dock.

In one example, the modular building is a residential building. In this way, construction of residential buildings is improved. Build-times are shortened, and costs are reduced, as the building sections are constructed more efficiently and with reduced material waste. In another example, the modular building is a commercial building and/or an office space. Reducing build-times and costs are highly desirable in the constructing of commercial buildings and office space.

According to a still further aspect of the present invention there is provided a method of constructing a modular building (which may be a hybrid residential building), comprising: forming a first building section, in the form of a dock, at a final, fixed, on-site location of the building, the dock optionally being configured to receive a module; transporting a second building section, in the form of a module, from a different location to the on-site location; and connecting the module and the dock (optionally the module to the dock) thereby to construct the modular building.

Such a method of construction has numerous advantages. Module installation is facilitated as the dock is configured to receive a module when the dock is initially formed. Transporting the module from a different location to the on-site location allows the module to be constructed remotely from the on-site location, which allows the module construction team to be based off site, and advantageously in a specific module construction facility. Build times can be shortened, as construction of the dock does not impact construction of the module and vice versa.

In one example, the method further comprises manufacturing the module at the different location. In one example, the different location is an off-site location. In one example, the different location is a module manufacturing facility for manufacturing the module to be used in constructing the modular building.

In this way, the module is manufactured away from the dock, which allows the dock and module to be constructed separately and subsequently connected. This is advantageous in reducing build times, and also in organizing teams of tradespeople. The module manufacturing facility may be an on-site facility or an off-site facility. Benefits are obtained by reducing the amount of construction, installation and testing which is to be performed on-site in that build times are reduced leading to reduced build costs.

In one example, the method further comprises forming the dock to provide at least one open face for receiving the module, the module being connected to the dock thereby to close the open face.

In this way, the dock can be constructed from less material, as one or more faces are left open where the module is to be received. Installation of the module is also less destructive and disruptive, as walls need not be removed to connect the module to the dock.

In one example, the method comprises connecting the module to the dock, the module and dock not comprising perishable materials. In one example, method comprises connecting the module to the dock to form the building and subsequently incorporating all perishable materials into the building. In one example, the method comprises connecting the module to the dock before plastering the module and/or dock. By each of the dock and the module not comprising perishable material, weather resistance of the building sections is provided. In this way, it is ensured that the dock and module do not suffer from water ingress early in the construction process. The connected dock and module not comprising perishable material may be the structure formed immediately after connection and prior to any finalising of the building. The connected dock and module may then provide a weatherproof internal building volume, such that perishable materials can be introduced without risk of weather damage.

In one example, the module is portable, in a form to be connected to and received by the dock.

That is, the module is moveable and/or transportable, for example on a flatbed truck. In this way, the module may be substantially or wholly constructed at a site away from the dock, transported to the dock and connected to the dock. Skilled tradespeople may work remotely from the dock to construct the module and install, for example, electrics and plumbing, which can be tested in a controlled environment away from the dock. The constructed and tested module can then be transported to the site for connection to the dock. The module could be lowered into position, and/or be provided with one or more rollers or slide elements, allowing the module to be rolled or slid into connection with the dock.

According to a still further aspect of the present invention there is provided a modular building kit (which may be a hybrid residential building kit or system) comprising a first building section in the form of a dock optionally configured to receive a module: and a second building section in the form of a module connectable with or to (and optionally receivable by) the dock.

Such a modular building kit has numerous advantages, including reduced build times, reduced costs, and better organization of teams of tradespeople.

According to a still further aspect of the present invention there is provided a method of modifying a constructed modular building (which may be a hybrid residential building), the modular building comprising a first building section in the form of a dock constructed at a final, fixed, on-site location of the building, the dock optionally being configured to receive a module; and a connected second building section in the form of a first module, the first module being removably connected to the dock in the constructed building, the method comprising: removing the first module from connection with the dock; and connecting a second module to the dock thereby to modify the building.

In this way, the modular building is modifiable by connection of a second module. The second module may comprise new and upgraded componentry, as required or desired by building regulations and/or desires of the consumer. The first module being removably connected to the dock facilitates removal of said module and replacement with a second module.

In one example, the dock comprises an internal building volume. That is, the dock is not simply a foundation structure, such as a concrete slab. Instead, the dock has an internal volume or internal space, defined in some examples by walls, ceiling and floor.

In one example, the method comprises modifying the first module and connecting the modified first module, as the second module, to the dock. That is, the first module can be removed, modified (which may involve upgrading or replacing components) and reconnected to the dock, thereby to modify the building. This is advantageous in reducing costs and material use, as the modules are reusable.

In one example, the method further comprises transporting the first module to an off-site location. In this way, work on the first module to is facilitated, by transporting the module to a location suited to module modification. Alternatively, disposal of the first module is made possible away from the site, where it may be desired to minimise building construction (for example, on a residential housing estate).

In one example, the method further comprises moving the first module to a module modification facility for modifying the first module to be used in connecting the modified first module, as the second module, to the dock.

Modifying the first module at a module modification facility is beneficial as it allows tradespeople to work in an environment suited to module modification. In this way, it is not necessary to modify the module on-site, where conditions may be inappropriate for electrical/plumbing installation, for example. Moreover, modifying the module in a specially designed facility improves efficiency, as teams of people can be easily organised and collaborative work is facilitated. Moreover, modules from different sites may be brought to the same module modification facility for modification, before transport back to their respective sites. In another example, the module modification facility may be provided on-site. This is particularly advantageous where many, for example 500, modular buildings at a single site are to be provided with modified modules. That is, the first modules may be removed from connection with a plurality of buildings and moved to the module modification facility for modification.

In one example, the method further comprises transporting the second module back to the final, fixed, on-site location where the modular building is located. In this way, the second module is brought to the site for installation. In this way, the second module need only be installed, and not constructed, tested or modified, on site which improves efficiency and resulting in reduced build times and increased cost savings.

In one example, the first module and second module are portable. That is, the first module and second module are moveable and/or transportable, for example on a flatbed truck. In this way, the second module may be substantially or wholly constructed at a site away from the dock, transported to the dock and connected to the dock. Skilled tradespeople may work remotely from the dock to construct the or modify the modules and install, for example, electrics and plumbing, which can be tested in a controlled environment away from the dock. The constructed and tested modules can then be transported to the site for connection to the dock.

In one example, the method comprises manufacturing a second module. That is, the second module may be a newly constructed module. After a period of reuse of the first module (or even without reuse of the first module) it may be appropriate or necessary to manufacture a new second module.

In one example, the second module may be manufactured at a module manufacturing facility. The module manufacturing facility may be provided on-site or off-site. By providing the module manufacturing on-site, where many buildings on a single site, for example 500 buildings, are to be provided, second modules may be manufactured with improved efficiency as teams of people can be easily organised and collaborative work is facilitated in such a facility, whilst it is not necessary to transport second modules long distances to their respective docks. Alternatively, by providing the module manufacturing facility off-site, conditions for module manufacture may be improved and large teams of tradespeople need not be present on-site.

In one example, the second module is separately manufactured off-site. Benefits are obtained by reducing the amount of construction, installation and testing which is to be performed on-site in that build times are reduced leading to reduced build costs.

In one example, the first and/or second module contains one or more of: staircase. W/C, washroom, delivery drop off area, hallway, bathroom, en-suites, front door, side door, and windows. In traditional construction, replacement of components in these areas or performing upgrades and/or testing in these areas is costly and time consuming. As a result of these areas being contained in the modules, upgrade and modification is made easier as the module can be removed from connection with the dock.

According to a still further aspect of the present invention there is provided a constructed modular building (which may be a hybrid residential building) modified according to the method of the preceding aspect of the present invention.

In one example, the modular building is a residential building. In this way, construction of residential buildings is improved. Build-times are shortened, and costs are reduced, as the building sections are constructed more efficiently and with reduced material waste. In another example, the modular building is a commercial building and/or an office space. Reducing build-times and costs are highly desirable in the constructing of commercial buildings and office space.

According to a still further aspect of the present invention there is provided a modular building kit (which may be a hybrid residential building kit or system) comprising a first building section in the form of a dock which is optionally configured to receive a module, a second building section in the form of a first module, a third building section in the form of a second module.

Such a modular building kit has numerous advantages, including reduced build times, reduced costs, and better organization of teams of tradespeople.

According to a still further aspect of the present invention there is provided a method of constructing a modular building (which may be a hybrid residential building) from a first building section in the form of a dock optionally configured to receive a second building section in the form of a module, comprising: providing a module, the module having one or more external walls; and connecting the module and the dock (optionally the module to the dock) thereby to provide the one or more external walls of the module as one or more internal walls of the dock.

In this way, construction of the dock is simplified as internal walls of the dock are provided by external walls of the module, without the need to construct some internal walls of the dock. That is, in some instances, providing external walls of the module as internal walls of the dock is simpler than providing internal walls of the dock and subsequently connecting the module to the dock. When connecting the module to the dock to thereby provide the one or more external walls of the module as one or more internal walls of the dock, this might be alternatively or additionally defined or described as providing the one or more external walls of the module as one or more internal walls of the building. This is because, when connected, the dock and module will together form the building. In other words, the one or more external walls of the module provide walls to the dock and the building, and these are internal to the building.

In one example, the dock comprises an internal building volume. That is, the dock is not simply a foundation structure, such as a concrete slab. Instead, the dock has an internal volume or internal space, defined in some examples by walls, ceiling and floor.

In one example, connecting the module to the dock provides the one or more external walls of the module as one or more separating walls between the module and dock. In this way, a double wall construction is avoided. Moreover, the external walls of the module provide internal separating walls in the constructed modular building. In this way, the amount of material required to construct the modular building is reduced.

In one example, the one or more separating walls provide a fire break between the module and dock. Building safety is thereby improved.

In one example, the one or more external walls of the module provide all walkway exits from the dock. Construction of the dock is thereby simplified, as walkway exits need not be provided in the dock and may instead be provided in the module.

In one example, the dock has one or more open faces, the method further comprising: docking the module to the dock to close the one or more open faces and thereby construct the modular building. In this way, the dock can be constructed from less material, as one or more faces are left open where the module is to be received. Installation of the module is also less destructive and disruptive, as walls need not be removed to connect the module to the dock.

In one example, connecting the module to the dock to provide the one or more internal walls of the dock defines an internal building volume within the module and dock. In this way, simple construction of a modular building is facilitated by connection of a dock and module.

In one example, the module and dock are each self-supporting. In this way, the dock and module can be constructed separately. Moreover, the module can be removed from the dock without either the dock or module requiring a support structure to be temporarily installed.

In one example, the dock comprises: external walls comprising a support structure for supporting the dock; and one or more internal walls. In this way, the external walls provide the necessary structural support to the dock, which is particularly advantageous when the dock and module are disconnected. The internal walls may be absent a support structure. In this way, the internal walls may be readily removable or removable, for example to easily create an open plan space. The internal walls being readily removeable facilitates a reorganisation of the internal structure of the building without substantial modification or redecoration of the dock. Moving or removing the internal walls does not impact or damage the components, fixtures and fittings, or décor of the dock.

In one example, one or more external walls of the module, when the module is connected to the dock, provide structural support to the dock. That is, connecting the module to the dock may provide some level of additional structural support to the dock, thereby to provide a structurally sound modular building.

In one example, the external walls of the module and/or the external walls of the dock comprise a steel frame support structure. Steel frame support structures are particularly advantageous in modular building construction.

In one example, the dock comprises one or more removable and/or relocatable internal walls. In this way, the internal walls may be removed or repositioned, as desired by the homeowner. For example, an open plan living space may be easily formed, or room shapes and sizes may be adjusted without structural modification.

According to a still further aspect of the present invention there is provided a modular building (which may be a hybrid residential building) comprising: a first building section in the form of a dock; and a second building section in the form of a module, the module having one or more external walls, wherein the module and the dock are connected (optionally the module is connected to the dock) thereby to provide the one or more external walls as one or more internal walls of the dock.

In this way, construction of the dock is simplified as internal walls of the dock are provided by external walls of the module, without the need to construct some internal walls of the dock. That is, in some instances, providing external walls of the module as internal walls of the dock is simpler than providing internal walls of the dock and subsequently connecting the module to the dock.

In one example, the one or more external walls of the module forms a separating wall between the module and dock.

In this way, a double wall construction is avoided. Moreover, the external walls of the module provide internal separating walls in the constructed modular building. In this way, the amount of material required to construct the modular building is reduced.

In one example, the modular building is a residential building. In this way, construction of residential buildings is improved. Build-times are shortened, and costs are reduced, as the building sections are constructed more efficiently and with reduced material waste. In another example, the modular building is a commercial building and/or an office space. Reducing build-times and costs are highly desirable in the constructing of commercial buildings and office space.

According to a still further aspect of the present invention there is provided a modular building kit (which may be a hybrid residential building kit or system) comprising a first building section in the form of a dock, a second building section in the form of a module, the module having one or more external walls providable as one or more internal walls of the dock.

Such a modular building kit has numerous advantages, including reduced build times, reduced costs, and better organization of teams of tradespeople.

According to a still further aspect of the present invention there is provided a modular building (which may be a hybrid residential building) comprising: a first building section in the form of a dock, the dock optionally being configured to receive a module; and a second building section in the form of a module connected to (and optionally received by) the dock, wherein the modular building is serviced with one or more services via the module.

In this way, the provision of services to the modular building is greatly simplified. In particular, in one example, servicing the building with services via the module enables all complex cabling and plumbing to be localized at the module, which increases ease of maintenance of the modular building. Generally, thinking, planning, and implementation of the provision of services is made more focused and efficient. Moreover, improvements in safety of the building are obtained.

In one example, the one or more services are received by the module from external to one or more of the dock, module and building. That is, services are routed through the module and into the building from external to the building. In one example, services are received by the module from external to the dock and module, and are received at a services hub which is external to the module. The services hub may be separate to, attached to, or integral with the dock.

In one example, the one or more services are: water; gas; heating: electric; telecoms; air supply. It is advantageous to simplify provision of such services to the modular building by servicing the building via the module.

In one example, the one more services comprise an electrical power supply and/or telecoms, and the electrical power and/or telecoms is wirelessly transmitted to the dock from the module. Wireless power and/or telecoms transmission reduces the need to install cabling within the dock, which allows the walls of the dock to be absent cabling, or have reduced complexity of cabling, thereby enabling flexibility of internal wall placement within the dock.

In one example, the module and dock comprise one or more connectors for facilitating the provision of services from the module to the dock. That is, in one example, the module and dock may be electrically and/or fluidically connected. The provision of services to the dock is simplified by such connectors as the module can be connected to the dock in a "plug-and-play" manner, without further wiring or other modification of the dock or module by the user. Additionally, in some examples, the connectors may facilitate the provision of services from the dock to the module.

In one example, the one or more services comprise a heat supply. The one or more connectors may facilitate the provision of thermal energy from the module to the dock. That is, in one example, the module and dock are thermally connected. The provision of services to the dock is simplified by such connectors as any requirement for the dock to comprise a dedicated heat supply or heating system may be negated by the provision of a module comprising a heat supply or heating system and the dock being in thermal connection with the module. In one example, the module and dock may be configured and/or connected to facilitate the transfer of thermal energy from the module to the dock. The module may comprise a heat exchanger. The heat exchanger may be located so that, when the module is connected to the dock, the heat exchanger is between the module and the dock. The heat exchanger may be located so that, when the module is connected to the dock, the heat exchanger is between the module and the dock. The heat exchangers may be configured to connect, or be in thermal connection, with each other. The heat exchangers may provide a thermal coupling, or thermal interface, between the dock and module.

In one example, the dock comprises internal walls, the internal walls being devoid of electrical cabling and/or fluidic conduits. The walls may be entirely or largely devoid of electrical cabling and/or fluidic conduits. If largely devoid, this might mean that the majority of any conduits for the building are present in the module. Construction of the dock is thereby greatly simplified. Moreover, subsequent modification and/or upgrade of the modular building is easier as, in some cases, only the module need be removed and worked upon to upgrade the electrics and/or plumbing of the building. The dock need only provide conduit outlets or connection points.

In one example, the internal walls are relocatable and/or moveable. In this way, the internal walls may be removed or repositioned, as desired by the homeowner. For example, an open plan living space may be easily formed, or room shapes and sizes may be adjusted without structural modification.

In one example, the dock comprises a services hub and the module is serviced with one or more services via the services hub.

In this way, the services can be routed to the module via the services hub. The services hub is a specific hub (also known as a boiler room or plant room) which houses fuse boxes, the boiler, and other apparatus. Providing these in a services hub can improve building safety, simplify construction, and also simplify ongoing maintenance of the building. For example, meter readings can be performed simply by access to the services hub which is accessible from outside of the modular building.

According to a still further aspect of the present invention there is provided a modular building (which may be a hybrid residential building) according to the preceding aspect and a services hub wherein the module is serviced with one or more services via the services hub, wherein the services hub does not form part of the modular building.

Such a construction can improve building safety. Moreover, further advantages are obtained in that inspection and maintenance (e.g., meter readings) can be performed without access to the modular building.

In one example, the modular building is a residential building. In this way, construction of residential buildings is improved. Build-times are shortened, and costs are reduced, as the building sections are constructed more efficiently and with reduced material waste. In another example, the modular building is a commercial building and/or an office space. Reducing build-times and costs are highly desirable in the constructing of commercial buildings and office space.

In one example, the services hub is accessible externally to the modular building, optionally wherein the services hub is only accessible externally to the modular building. In this way, meter readings and maintenance may be performed without access to the modular building.

In one example, the one or more services comprise a water supply, and all (or at least one or more) wet facilities are (e.g. entirely) provided within the module. In one example, wet facilities include bathroom facilities. In this way, building safety is improved, as is ease of maintenance.

For example, in the event of leaking, water can be directed to flow away from the dock to prevent flooding. Also, little or no access or action may be required with regard to the dock.

According to a still further aspect of the present invention there is provided a method of servicing a modular building (which may be a hybrid residential building) comprising a first building section in the form of a dock, the dock optionally being configured to receive a module; and a second building section in the form of a module connected to (and optionally received by) the dock, the method comprising servicing the modular building with one or more services via the module.

In this way, the provision of services to the modular building is greatly simplified. In particular, servicing the building with services via the module enables all complex cabling and plumbing to be localized at the module, which increases ease of maintenance of the modular building. Moreover, improvements in safety of the building are obtained.

According to a still further aspect of the present invention there is provided a modular building kit (which may be a hybrid residential building kit or system) comprising: a first building section in the form of a dock, the dock optionally being configured to receive a module; and a second building section in the form of a module connectable to (and optionally receivable by) the dock to form a modular building, wherein the modular building is serviceable with one or more services via the module when connected to the dock.

Such a modular building kit has numerous advantages, including reduced build times, reduced costs, improved building safety and better organization of teams of tradespeople.

According to a still further aspect of the present invention there is provided a method of constructing a modular building (which may be a hybrid residential building) from a first building section in the form of a dock configured to be connected to (and optionally to receive) a second building section in the form of a module, the dock having one or more open faces, the method comprising: providing a module; and docking the module and the dock (optionally the module to the dock) to close the one or more open faces.

In this way, the dock can be constructed from less material, as one or more faces are left open where the module is to be received. Installation of the module is also less destructive and disruptive, as walls need not be removed to connect the module to the dock. Closing the one or more open faces weatherproofs and seals the building. In one example, the docking the module to the dock to close the open or more open faces defines an internal building volume within the module and dock. In this way, simple construction of a modular building is facilitated by connection of a dock and module.

In one example, the method further comprises docking the module to the dock to close all open faces of the dock. In this way, construction is simplified as additional external walls need not be built, installed or fitted to the dock to close the open faces. Connection of the module to the dock closes the open faces in a single installation step.

In one example, the method comprises docking the module to the dock to close the one or more open faces thereby to provide the external structure and/or one or more external walls of the modular building. In this way, construction of the building structure and/or the provision of external building walls is simplified.

In one example, the module comprises one or more external walls, and the method comprises: connecting the module to the dock thereby to provide the one or more external walls of the module as one or more internal walls of the dock. In this way, construction of the dock is simplified as internal walls of the dock are provided by external walls of the module, without the need to construct some internal walls of the dock. That is, in some instances, providing external walls of the module as internal walls of the dock is simpler than providing internal walls of the dock and subsequently connecting the module to the dock.

According to a still further aspect of the present invention there is provided a modular building (which may be a hybrid residential building) comprising: a first building section in the form of a dock having one or more open faces; and a second building section in the form of a module docked with or to the dock and closing the one or more open faces of the dock.

In this way, the dock can be constructed from less material, as one or more faces are left open where the module is to be received. Installation of the module is also less destructive and disruptive, as walls need not be removed to connect the module to the dock. Closing the one or more open faces weatherproofs and seals the building.

In one example, the module and dock are each self-supporting. In this way, the dock and module can be constructed separately. Moreover, the module can be removed from the dock without either the dock or module requiring a support structure to be temporarily installed.

In one example, the dock comprises: external walls comprising a support structure for supporting the dock; and one or more internal walls. In this way, the external walls provide the necessary structural support to the dock, which is particularly advantageous when the dock and module are disconnected. The internal walls may be absent a support structure. In this way, the internal walls may be readily removable or removable, for example to easily create an open plan space. The internal walls being readily removeable facilitates a reorganisation of the internal structure of the building without substantial modification or redecoration of the dock. Moving or removing the internal walls does not impact or damage the components, fixtures and fittings, or décor of the dock.

In one example, one or more external walls of the module, when connected to the dock, provide structural support to the dock. That is, connecting the module to the dock may provide some level of additional structural support to the dock, thereby to provide a structurally sound modular building.

In one example, the external walls of the module and/or the external walls of the dock comprise a steel frame support structure. Steel frame support structures are particularly advantageous in modular building construction.

In one example, the module extends over the open face of the dock. In this way, simple construction of a modular building is facilitated by connection of a dock and module.

In one example, the module connects to the dock structure. In this way, the dock and module may provide mutual structural support to one another.

In one example, the modular building is a residential building. In this way, construction of residential buildings is improved. Build-times are shortened, and costs are reduced, as the building sections are constructed more efficiently and with reduced material waste. In another example, the modular building is a commercial building and/or an office space. Reducing build-times and costs are highly desirable in the constructing of commercial buildings and office space.

According to a still further aspect of the present invention there is provided a modular building kit (which may be a hybrid residential building kit or system) comprising a first building section in the form of a dock having one or more open faces; and a second building section in the form of a module dockable with or to the dock to close the one or more open faces of the dock.

Such a modular building kit has numerous advantages, including reduced build times, reduced costs, and better organization of teams of tradespeople.

According to a still further aspect, there is provided a first building section in the form of a dock according to, or suitable for use with or as part of, any of the earlier aspects. According to a still further aspect, there is provided a second building section in the form of a module according, or suitable for use with or as part of, to any of the earlier aspects.

Various modifications may be made to the foregoing without departing from the spirit or scope of the present invention.

For example, the second building section can comprise more than one upper subsection, and may comprise: a lower subsection, a first upper subsection, and a second upper subsection. The first upper subsection may form a middle subsection, and the second upper subsection a top subsection. The top subsection may be stacked or seated on the middle subsection. The middle subsection may be stacked or seated upon the lower subsection. The lower subsection may comprise a lower staircase/stairs. The middle subsection may comprise a middle staircase/stairs. The lower staircase and the middle staircase may communicate with one another, or be otherwise associated, so to permit passage between the lower and upper subsections. The middle subsection may comprise an aperture or opening which communicates with the staircase in the lower subsection, when the subsections are connected, to permit passage between the lower and middle subsections via the lower staircase. The aperture may open on to a middle landing defined by or within the middle subsection. The top subsection may comprise an aperture or opening which communicates with the staircase in the middle subsection, when the subsections are connected, to permit passage between the middle and top subsections via the middle staircase. The aperture may open on to a top landing defined by or within the top subsection.

In another variation, the second building section may be provided as a single unit or structure defining a lower subsection/portion and an upper subsection/portion, and optionally at least one further subsection/portion (e.g. lower, middle and top). The subsections may be provided within a single or unitary outer structure or envelope which contains all of the subsections.

Where the second building section comprises middle and upper subsections, the first building section may comprise a middle storey defining an internal volume, which may provide a middle living space within the building. The middle subsection may form a middle storey of the second building section, which may communicate with the internal volume defined by the middle storey of the first building section. The middle storey formed by the middle subsection may comprise a floor, and the floor may be at a level which is substantially the same as that of a floor of the first building section middle storey.

The first and/or second building sections may comprise more than two storeys. The number of storeys in the first and second building sections may be equal. However, one of the first and second building sections may comprise more stories than the other section. For example, the second building section may comprise a top (third) storey which is positioned above the upper storey of the first building section when the sections are connected.

In variations on the illustrated embodiments, at least one room of the building may be defined jointly by a living space of a first building section and by a second building section (suitably its living space). Connection of the building sections may therefore complete the room or rooms. For example, an upper living space of a first building section may define part of a bedroom, and a living space of a second building section may define a further part of the bedroom. When the building sections are connected, said parts may together define the complete bedroom. The second building section can optionally include one or more bedroom, and can include a kitchen or at least part of a kitchen.

Where the first building section comprises first and second portions which together define the first building section, the first building section may comprise at least one further portion which may be arranged relative to an adjacent portion (e.g. the first and/or second portion) so that said portions are disposed at such a non-parallel angle relative to one another. Axes of said portions may be disposed as set out in relation to said first and second portions. The second building section may be connected to two, or more than two, of such portions.

Further aspects and/or embodiments of the invention may combine the features of one or more aspect and/or embodiment disclosed in this document. Accordingly, such further aspects and/or embodiments may comprise one or more feature selected from one or more aspect or embodiment of the invention disclosed in this document.

Unless explicitly implied by context or stated in the document, the features of any method or process disclosed in this document need not necessarily be performed in the precise order set out in the relevant text and/or drawings. Accordingly, any method or process disclosed in this document may be capable of being performed in an order other than that specifically set out in the relevant text/drawings, if circumstances permit.

Features disclosed in this document (including any accompanying claims, abstract and drawings) may be replaced by alternative features serving the same, equivalent or similar purpose, unless expressly stated otherwise. Accordingly, features disclosed in this document may represent only one example of a generic series of equivalent or similar features. Like reference numerals are used to denote like features throughout the accompanying drawing figures.

The invention claimed is:

1. A hybrid residential building comprising a first building section and a second building section, in which:

the first building section is an on-site construction at a final location for the building and defines an internal volume that provides a living space within the building;

the second building section defines an internal volume that provides a further living space forming at least one room within the building, and is transportable to the final location in a substantially assembled form;

the first and second building sections are connected at the final location to form the building;

the second building section comprises a ventilation system which is configured to supply external air into the first building section, and to withdraw internal air from the first building section and to discharge it to the building exterior, to thereby control ventilation of the building, the ventilation system comprising at least one supply duct in the second building section and at least one extraction duct in the second building section; and the first building section comprises at least one supply duct which is configured to be connected to the ventilation system, for indirect supply of external air into the first building section, and at least one extraction duct which is configured to be connected to the ventilation system, for indirect withdrawal of internal air from the first building section.

2. A hybrid residential building comprising a first building section and a second building section, in which:

the first building section is an on-site construction at a final location for the building and defines an internal volume that provides a living space within the building;

the second building section defines an internal volume that provides a further living space forming at least one room within the building, and is transportable to the final location in a substantially assembled form;

the first and second building sections are connected at the final location to form the building;

the second building section comprises a ventilation system which is configured to supply external air into the first building section, and to withdraw internal air from the first building section and to discharge it to the building exterior, to thereby control ventilation of the building, the ventilation system comprising at least one supply duct in the second building section and at least one extraction duct in the second building section;

the first building section comprises at least one supply duct which is configured to be connected to the ventilation system, for indirect supply of external air into the first building section; and the ventilation system further comprises at least one extraction vent provided in a wall of the second building section, for direct withdrawal of internal air from the first building section.

3. A hybrid residential building comprising a first building section and a second building section, in which:

the first building section is an on-site construction at a final location for the building and defines an internal volume that provides a living space within the building;

the second building section defines an internal volume that provides a further living space forming at least one room within the building, and is transportable to the final location in a substantially assembled form;

the first and second building sections are connected at the final location to form the building;

the second building section comprises a ventilation system which is configured to supply external air into the first building section, and to withdraw internal air from the first building section and to discharge it to the building exterior, to thereby control ventilation of the building, the ventilation system comprising at least one supply duct in the second building section and at least one extraction duct in the second building section;

the ventilation system further comprises at least one supply vent provided in a wall of the second building section, for direct supply of external air into the first building section; and the first building section comprises at least one extraction duct which is configured to be connected to the ventilation system, for indirect withdrawal of internal air from the first building section.

4. A hybrid residential building comprising a first building section and a second building section, in which:

the first building section is an on-site construction at a final location for the building and defines an internal volume that provides a living space within the building;

the second building section defines an internal volume that provides a further living space forming at least one room within the building, and is transportable to the final location in a substantially assembled form;

the first and second building sections are connected at the final location to form the building;

the second building section comprises a ventilation system which is configured to supply external air into the first building section, and to withdraw internal air from the first building section and to discharge it to the building exterior, to thereby control ventilation of the building, the ventilation system comprising at least one supply duct in the second building section and at least one extraction duct in the second building section; and the ventilation system further comprises at least one supply vent provided in a wall of the second building section, for direct supply of external air into the first building section, and at least one extraction vent provided in a wall of the second building section, for direct withdrawal of internal air from the first building section.

5. A hybrid residential building comprising a first building section and a second building section, in which:

the first building section is an on-site construction at a final location for the building and defines an internal volume that provides a living space within the building;

the second building section defines an internal volume that provides a further living space forming at least one room within the building, and is transportable to the final location in a substantially assembled form;

the first and second building sections are connected at the final location to form the building;

the second building section comprises a ventilation system which is configured to supply external air into the first building section, and to withdraw internal air from the first building section and to discharge it to the building exterior, to thereby control ventilation of the building, the ventilation system comprising at least one supply duct in the second building section and at least one extraction duct in the second building section;

the first building section comprises at least one supply duct which is configured to be connected to the ventilation system, for indirect supply of external air into the first building section, and at least one extraction duct which is configured to be connected to the ventilation system, for the indirect withdrawal of internal air from the first building section; and the ventilation system further comprises at least one supply vent provided in a wall of the second building section, for direct supply of external air into the first building section, and at least one extraction vent provided in a wall of the second building section, for direct withdrawal of internal air from the first building section.

6. A building as claimed in claim 1, in which the ventilation system is configured to supply external air into the internal volume of the second building section, and to withdraw internal air from said internal volume.

7. A building as claimed in claim 1, in which the at least one supply duct in the second building section connects with said at least one supply duct in the first building section.

8. A building as claimed in claim 2, in which the at least one supply duct in the second building section connects with said at least one supply duct in the first building section.

9. A building as claimed in claim 1, in which the at least one extraction duct in the second building section connects with said at least one extraction duct in the first building section.

10. A building as claimed in claim 3, in which the at least one extraction duct in the second building section connects with said at least one extraction duct in the first building section.

11. A building as claimed in claim 3, in which the at least one supply duct in the second building section connects with the at least one supply vent in the wall of the second building section.

12. A building as claimed in claim 4, in which the at least one supply duct in the second building section connects with the at least one supply vent in the wall of the second building section.

13. A building as claimed in claim 2, in which the at least one extraction duct in the second building section connects with the at least one extraction vent in the wall of the second building section.

14. A building as claimed in claim 4, in which the at least one extraction duct in the second building section connects with the at least one extraction vent in the wall of the second building section.

15. A building as claimed in claim 5, in which the at least one supply duct in the second building section connects with the at least one supply duct in the first building section and with the at least one supply vent in the wall of the second building section, and the at least one extraction duct in the second building section connects with the at least one extraction duct in the first building section, and with the least one extraction vent in the wall of the second building section.

16. A building as claimed in claim 1, in which:

the ventilation system is configured to supply air into a first area of the first building section, and to withdraw air from a further area of the first building section which is spaced from the first area, to promote a flow of air within the building.

17. A building as claimed in claim 1, in which the ventilation system comprises one or more of:

a heat exchanger for transferring thermal energy between internal air drawn from the building and incoming external air;

a filter for filtering the external air prior to supplying the external air into the building;

a heating device for heating the external air prior to supplying the external air into the building; and a cooling device for cooling the external air prior to supplying the external air into the building.

18. A building as claimed in claim 1, in which the ventilation system comprises a manifold in the second building section, which provides the at least one supply duct and at the least one extraction duct in the second building section.

* * * * *